US008635893B2

(12) United States Patent
Miller et al.

(10) Patent No.: US 8,635,893 B2
(45) Date of Patent: Jan. 28, 2014

(54) HIGH SECURITY LOCK

(71) Applicant: Lock II, L.L.C., Nicholasville, KY (US)

(72) Inventors: J. Clayton Miller, Titusville, FL (US); Donald P. Cooke, Jr., Nicholasville, KY (US); Michael P. Harvey, Laguna Niguel, CA (US); Brian T. Craycraft, Lexington, KY (US); Philip D. Mason, LaGrange, KY (US); Kenneth H. Mimlitch, Lexington, KY (US); Craig Volk, Lexington, KY (US)

(73) Assignee: Lock II, L.L.C., Nicholasville, KY (US)

( * ) Notice: Subject to any disclaimer, the term of this patent is extended or adjusted under 35 U.S.C. 154(b) by 0 days.

(21) Appl. No.: 13/828,141

(22) Filed: Mar. 14, 2013

(65) Prior Publication Data

US 2013/0180298 A1 Jul. 18, 2013

Related U.S. Application Data

(63) Continuation-in-part of application No. 13/331,222, filed on Dec. 20, 2011, now Pat. No. 8,516,863, and a continuation of application No. 12/554,372, filed on Sep. 4, 2009, now Pat. No. 8,091,392.

(60) Provisional application No. 61/094,730, filed on Sep. 5, 2008.

(51) Int. Cl.
*E05B 1/00* (2006.01)

(52) U.S. Cl.
USPC ..... 70/332; 70/303 A; 70/333 A; 70/416; 70/283

(58) Field of Classification Search
USPC ..... 70/303 A, 333 A, 275–277, 278.1, 278.7, 70/283, 416; 292/142, 144
See application file for complete search history.

(56) References Cited

U.S. PATENT DOCUMENTS

| | | | |
|---|---|---|---|
| 572,988 | A | 12/1896 | Hecker |
| 686,073 | A | 11/1901 | Hollar et al. |
| 1,804,277 | A | 5/1931 | Ruiz |
| 2,399,906 | A | 5/1946 | Bentley |
| 3,024,452 | A | 3/1962 | Leonard |
| 3,097,327 | A | 7/1963 | Bloor et al. |
| 3,318,625 | A | 5/1967 | Bogosian |
| 3,320,490 | A | 5/1967 | Beck et al. |

(Continued)

FOREIGN PATENT DOCUMENTS

| | | | |
|---|---|---|---|
| DE | 1065871 | B | 9/1959 |
| DE | 3817696 | C1 | 11/1989 |

(Continued)

OTHER PUBLICATIONS

Locksmith Ledger International, X-07: A Safe Lock That Operates Electronically, No. 9, Jul. 1991.

(Continued)

*Primary Examiner* — Suzanne Barrett
(74) *Attorney, Agent, or Firm* — Wood, Herron & Evans, L.L.P.

(57) ABSTRACT

A high security lock includes a lock bolt movable between extended and retracted positions, a bolt retraction gear coupled to the lock bolt, and a manually-driven gear. When a controller verifies that user-input information is correct for unlocking the lock, the bolt retraction gear and manually-driven gear are operatively coupled such that the gear can drive the lock bolt from the extended position to the retracted position.

31 Claims, 47 Drawing Sheets

(56) References Cited

U.S. PATENT DOCUMENTS

| | | | |
|---|---|---|---|
| 3,468,143 | A | 9/1969 | Douglas et al. |
| 3,633,167 | A | 1/1972 | Hedin |
| 3,718,764 | A | 2/1973 | Deschenes et al. |
| 3,733,861 | A | 5/1973 | Lester |
| 3,796,889 | A | 3/1974 | Fradkin et al. |
| 3,812,403 | A | 5/1974 | Gartner |
| 3,878,511 | A | 4/1975 | Wagner |
| 3,881,171 | A | 4/1975 | Moorman et al. |
| 3,950,678 | A | 4/1976 | Brewer |
| 3,958,231 | A | 5/1976 | Hoffman |
| 3,978,376 | A | 8/1976 | Wilson |
| 4,095,239 | A | 6/1978 | Gerry |
| 4,114,147 | A | 9/1978 | Hile |
| 4,232,354 | A | 11/1980 | Mueller et al. |
| 4,372,590 | A | 2/1983 | Pilat et al. |
| 4,379,245 | A | 4/1983 | Goldstein |
| 4,387,918 | A | 6/1983 | Dunphy et al. |
| 4,416,127 | A | 11/1983 | Gomez-Olea Naveda |
| 4,433,355 | A | 2/1984 | Chew et al. |
| 4,438,962 | A | 3/1984 | Soloviff et al. |
| 4,446,707 | A | 5/1984 | Mullich et al. |
| 4,457,148 | A | 7/1984 | Johansson et al. |
| 4,502,048 | A | 2/1985 | Rehm |
| 4,609,780 | A | 9/1986 | Clark |
| 4,625,848 | A | 12/1986 | Meyers et al. |
| 4,631,940 | A | 12/1986 | Krivec et al. |
| 4,643,010 | A | 2/1987 | Krivec et al. |
| 4,671,087 | A | 6/1987 | Olenfalk et al. |
| 4,684,945 | A | 8/1987 | Sanderford, Jr. |
| 4,745,784 | A | 5/1988 | Gartner |
| 4,754,625 | A | 7/1988 | McGourty et al. |
| 4,755,799 | A | 7/1988 | Romano |
| 4,759,062 | A | 7/1988 | Traub et al. |
| 4,766,746 | A | 8/1988 | Henderson et al. |
| 4,770,012 | A | 9/1988 | Johansson et al. |
| 4,773,243 | A | 9/1988 | Lukich |
| 4,813,250 | A | 3/1989 | Yeh |
| 4,832,385 | A | 5/1989 | Llort |
| 4,833,465 | A | 5/1989 | Abend et al. |
| 4,899,562 | A | 2/1990 | Gartner et al. |
| 4,912,460 | A | 3/1990 | Chu |
| 4,977,765 | A | 12/1990 | Legault et al. |
| 5,021,776 | A | 6/1991 | Anderson et al. |
| 5,061,923 | A | 10/1991 | Miller et al. |
| 5,070,714 | A | 12/1991 | Bedford |
| 5,083,122 | A | 1/1992 | Clark |
| 5,182,705 | A | 1/1993 | Barr et al. |
| 5,265,452 | A | 11/1993 | Dawson et al. |
| 5,299,436 | A | 4/1994 | Spitzer |
| 5,307,656 | A | 5/1994 | Gartner et al. |
| 5,487,290 | A | 1/1996 | Miller et al. |
| 5,517,184 | A | 5/1996 | Miller et al. |
| 5,632,169 | A | 5/1997 | Clark et al. |
| 5,647,235 | A | 7/1997 | Clark et al. |
| 5,653,135 | A | 8/1997 | Miller et al. |
| 5,684,457 | A | 11/1997 | Miller et al. |
| 5,715,716 | A | 2/1998 | Miller et al. |
| 5,720,194 | A | 2/1998 | Miller et al. |
| 5,777,559 | A | 7/1998 | Dawson et al. |
| 5,847,656 | A | 12/1998 | Dawson et al. |
| 5,862,692 | A | 1/1999 | Legault et al. |
| 5,896,026 | A | 4/1999 | Higgins |
| 5,960,655 | A | 10/1999 | Miller et al. |
| 5,973,624 | A | 10/1999 | Miller et al. |
| 6,034,616 | A | 3/2000 | Harvey et al. |
| 6,052,063 | A | 4/2000 | Miller et al. |
| 6,265,973 | B1 | 7/2001 | Brammall et al. |
| 6,314,773 | B1 | 11/2001 | Miller et al. |
| 6,420,958 | B1 | 7/2002 | Miller et al. |
| 6,502,438 | B1 | 1/2003 | Miller et al. |
| 6,546,769 | B2 | 4/2003 | Miller et al. |
| 6,813,917 | B2 | 11/2004 | Miller et al. |
| 6,843,084 | B2 | 1/2005 | Porter |
| 6,911,897 | B2 | 6/2005 | Miller et al. |
| 6,965,295 | B2 | 11/2005 | Shimonomoto et al. |
| 7,007,526 | B2 | 3/2006 | Frolov et al. |
| 7,193,503 | B2 | 3/2007 | Fisher |
| 7,263,865 | B2 | 9/2007 | Miller et al. |
| 7,757,524 | B2 | 7/2010 | Frolov et al. |
| 7,918,117 | B2 | 4/2011 | Frolov et al. |
| 8,091,392 | B2 | 1/2012 | Miller et al. |
| 2002/0073753 | A1 | 6/2002 | Miller et al. |
| 2002/0167395 | A1 | 11/2002 | Miller et al. |
| 2004/0140890 | A1 | 7/2004 | Hartmann et al. |
| 2007/0204665 | A1 | 9/2007 | Lie-Nielsen et al. |
| 2007/0289347 | A1 | 12/2007 | Miller et al. |

FOREIGN PATENT DOCUMENTS

| | | | |
|---|---|---|---|
| EP | 0021670 | A1 | 1/1981 |
| EP | 0260860 | A1 | 3/1988 |
| EP | 0361881 | A2 | 4/1990 |
| FR | 1543004 | A | 10/1968 |
| GB | 2202577 | A | 9/1988 |
| WO | 80/02710 | A1 | 12/1980 |
| WO | 89/12154 | A1 | 12/1989 |

OTHER PUBLICATIONS

U.S. Patent and Trademark Office, International Search Report and Written Opinion in PCT Serial No. PCT/US2009/056060, Oct. 20, 2009.

U.S. Patent and Trademark Office, International Preliminary Report on Patentability in PCT Application Serial No. PCT/US09/56060, Jun. 20, 2011.

U.S. Patent and Trademark Office, Office Action in U.S. Appl. No. 12/356,324, filed Apr. 1, 2011.

HIGH SECURITY LOCK

CROSS-REFERENCE TO RELATED APPLICATIONS

This application is a continuation-in-part of U.S. application Ser. No. 13/331,222, filed Dec. 20, 2011 (pending) which is a continuation of U.S. application Ser. No. 12/554,372, filed Sep. 4, 2009 (now U.S. Pat. No. 8,091,392) which claims the benefit of U.S. Provisional Application Ser. No. 61/094,730, filed on Sep. 5, 2008 (expired), the disclosures of which are hereby incorporated by reference in their entirety.

FIELD OF THE INVENTION

The present invention relates generally to locks, and more specifically, to high security locks adapted for use in safes and other security structures or areas.

BACKGROUND

Documents of an extremely sensitive nature and items having a high proprietary value often need to be stored within a safe or other structure. The structure typically includes a lock mechanism, and the structure is generally designed to be accessible only by a select few individuals who are entrusted with a predetermined combination code that facilitates the unlocking of the mechanism. Unauthorized persons will use simple lock picking tools as well as sophisticated equipment that can apply high mechanical forces or an electric or magnetic field to the lock mechanism in order to manipulate the components within the lock mechanism.

As the tools utilized in lock picking have become more sophisticated, lock mechanisms have been improved to resist these sophisticated lock picking methods. Mechanical and/or electrical elements have been used in locks to provide complicated barriers to a potential unauthorized person attempting to break into the structure. However, unauthorized persons continue to attack even these improved lock mechanisms, including drilling into the interior of the lock mechanism through lock casing openings. Locations on the lock casing that are subject to frequent attack include the mounting bolts and the spindle mount where a spindle shaft from the combination dial enters the lock casing.

Additionally, unauthorized persons attempting to break into the structure have been known to use devices that apply high acceleration to the combination dial in order to overcome security elements of the lock mechanism. The high accelerations of the gear train can sometimes force the gears controlling a lock bolt to rotate and unlock the lock mechanism without a proper combination entry. These high acceleration devices can include so-called auto-dialers, which rapidly attempt every possible combination until the proper combination has been detected. Even if the unauthorized person is unsuccessful at opening the lock mechanism in this manner, the rapid collisions of gear teeth in a gear train caused by high acceleration can frequently damage the gear train and lead to improper operations of the lock mechanism. The collisions of the gear teeth may also provide audible information that an unauthorized person can detect and use to determine the programmed combination that actuates the unlocking of the mechanism.

Furthermore, improved lock mechanisms must comply with highly stringent government specifications in order to be used on government-controlled structures and containment devices. For example, the stringency of relevant U.S. government specifications is readily appreciated from Federal Specification FF-L-2740, dated Oct. 12, 1989, titled "FEDERAL SPECIFICATION: LOCKS, COMBINATION" for the use of all federal agencies. Section 3.4.7, "Combination Redial," requires that once the lock bolt has been extended to its locked position "it shall not be possible to reopen the lock without completely redialing the locked combination." Section 3.6.1.3, "Emanation Analysis," requires that the lock shall not emit any sounds or other signals which may be used to surreptitiously open the lock within a specified period. Further U.S. government requirements are included in Federal Specification FF-L-2937, dated Jan. 31, 2005, titled "FEDERAL SPECIFICATION: COMBINATION LOCK, MECHANICAL." In that document, Section 4.7.4, "Endurance Test," requires that a sample lock be "cycled through fifty combination changes including three open and close verifications after each change" to ensure proper combination setting functionality. Section 4.7.7, "Resistance to Unauthorized Opening Test," requires that the lock cannot be opened by mechanical manipulation or autodialing of a computer-assisted device for at least a period of 20 hours.

Consequently, it would be desirable to improve on a high security lock to address the frequently-attacked areas of the lock mechanism while remaining in full compliance with typical government specifications.

SUMMARY OF THE INVENTION

In one embodiment, a locking mechanism includes a lock bolt that moves between an extended position and a retracted position. The lock bolt is coupled to a bolt retraction gear which is movable between an engagement position and a disengagement position. In the engagement position, the bolt retraction gear is engaged with a manually-driven gear. The locking mechanism also includes a user input device for receiving user input information and a controller for verifying user input information with stored authentication information. Upon detecting valid user input information, the controller triggers an actuator assembly having a guide element, which is operatively movable between a capturing position and a non-capturing position. In the capturing position, the guide element inhibits the movement of the bolt retraction gear. In the non-capturing position, the guide element releases the movement of the bolt retraction gear. The guide element inhibits the movement of the bolt retraction gear toward the engagement position until the controller verifies that the user input information matches the stored authorization information.

In one aspect, the guide element engages the bolt retraction gear while moving from the non-capturing position to the capturing position for directing the bolt retraction gear to the disengagement position. The actuator assembly further includes a cam movable between a first position and a second position, an actuator, and a clutch mechanism. The actuator engages the cam via the clutch mechanism. The cam is positioned adjacent to the guide element in the first position and engaged with the guide element in the second position. As such, the cam engages the guide element for moving the guide element between the capturing and non-capturing positions.

According to another embodiment, a locking mechanism includes a lock bolt that moves between an extended position and a retracted position. The lock bolt is coupled to a bolt retraction gear which is movable between an engagement position and a disengagement position. In the engagement position, the bolt retraction gear is engaged with a manually-driven gear. The locking mechanism also includes a lock dial for receiving user input information, and a sensor configured to sense the rotation of the lock dial. A display is configured to visualize the user input information, and a controller is configured for verifying user input information with stored authentication information. The controller is operatively connected to the sensor and the display for converting the rotation of the lock dial into the user input information visualized on the display via an algorithm. Upon verifying that the user input information matches the stored authorization information, the bolt retraction gear moves from the disengagement position to the engagement position with the manually-driven gear.

In one aspect, the user input information visualized on the display is generally random from the rotational position of the lock dial. Furthermore, the algorithm converts the rate of rotation of the lock dial into the user input information selected by a user.

A further embodiment of a locking mechanism includes a lock casing having interior components of a lock therein. The lock casing is at least partially formed of a substantially translucent material. In this respect, the interior components of the lock are visible from exterior of the casing for showing evidence of lock tampering. Additionally, the lock casing further includes a first portion, which is opaque, and a second portion, which is substantially translucent. The first and second portions of the lock casing are permanently sealed together such that separating the first and second portions will damage at least a portion of the lock casing.

In use, a method of operating a lock includes capturing the bolt retraction gear with the guide element in the capturing position to inhibit the movement of the bolt retraction gear toward engagement with the manually-driven gear. The method also includes recording user input information from the user input device, and verifying that the user input information matches authorization information stored in the controller. Furthermore, the method includes rotating the cam of the actuator assembly to engage the guide element and move the guide element to the non-capturing position. In addition, the method includes disengaging the guide element from the bolt retraction gear to permit engagement of the bolt retraction gear with the manually-driven gear after the user input information has been verified. The method also includes driving the lock bolt to the retracted position by manually driving the gear with the bolt retraction gear.

In one aspect of using the lock, the method includes operating the actuator for a predetermined period of time in order to rotate the clutch mechanism for the predetermined period of time and engaging the clutch mechanism with the cam. The method also includes seizing the movement of the cam while the actuator continues to operatively rotate the clutch mechanism.

Various additional objectives, advantages, and features of the invention will be appreciated from a review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF ILLUSTRATIVE EMBODIMENTS

Figure 1:
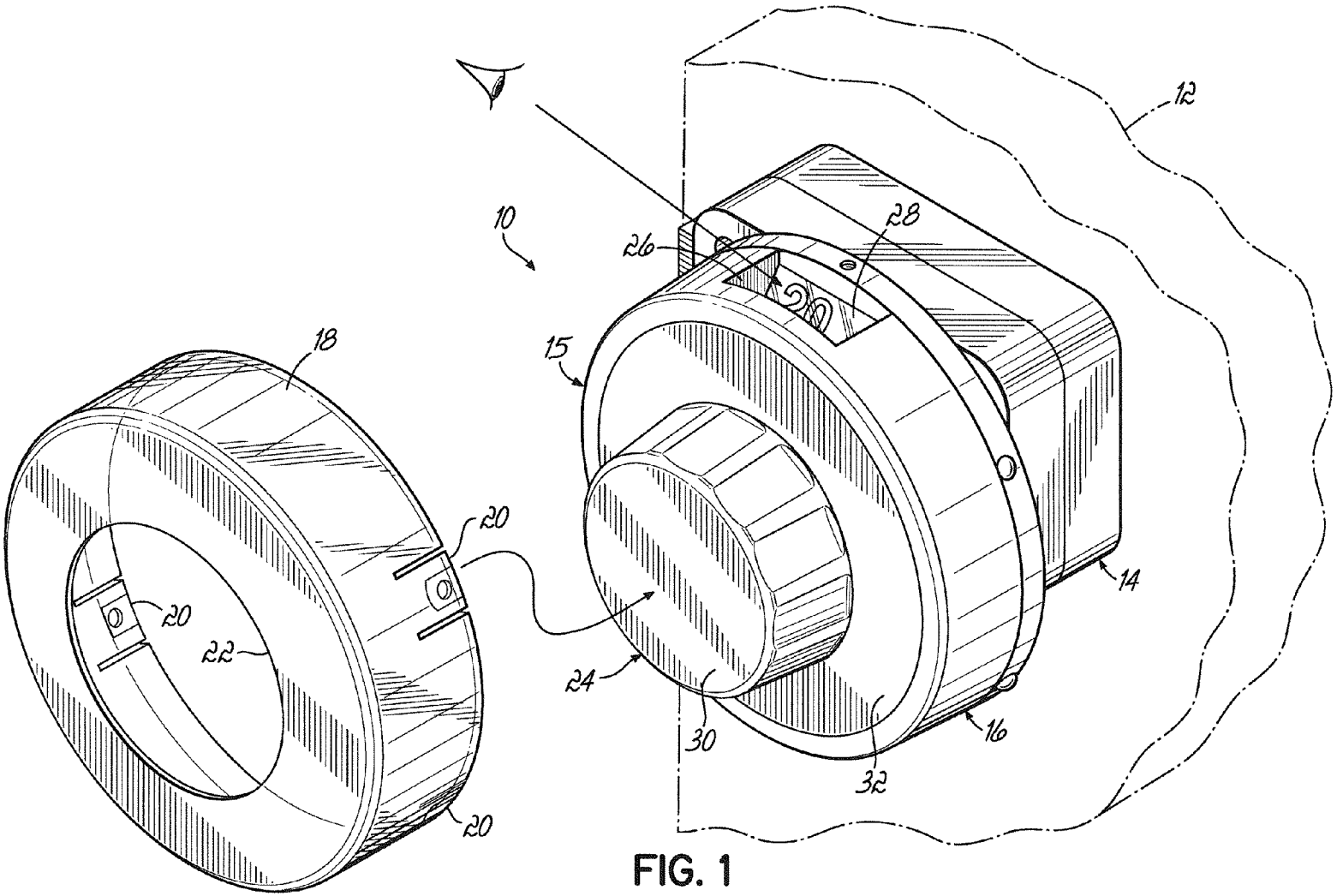
FIG. 1 is a perspective view of a high-security lock constructed in accordance with one embodiment of the invention.

FIG. 1 illustrates one embodiment of a high security lock 10 coupled, for example, to a structure door 12, and including a lock casing 14 and a user input device 15. The user input device 15 of this embodiment of the lock 10 is a mechanical lock dial 24 disposed within a dial housing 16. A dust cover 18 may be coupled to the dial housing 16 in a removable manner using suitable snap-fit connectors 20, for example, and includes an aperture 22 through which the lock dial 24 extends. The dial 24 may be rotated to input a numerical combination and, as will be explained below, the numbers of the combination are viewable through a window 26 in the dial housing 16 via a reflection in a mirror 28.

Figure 2:
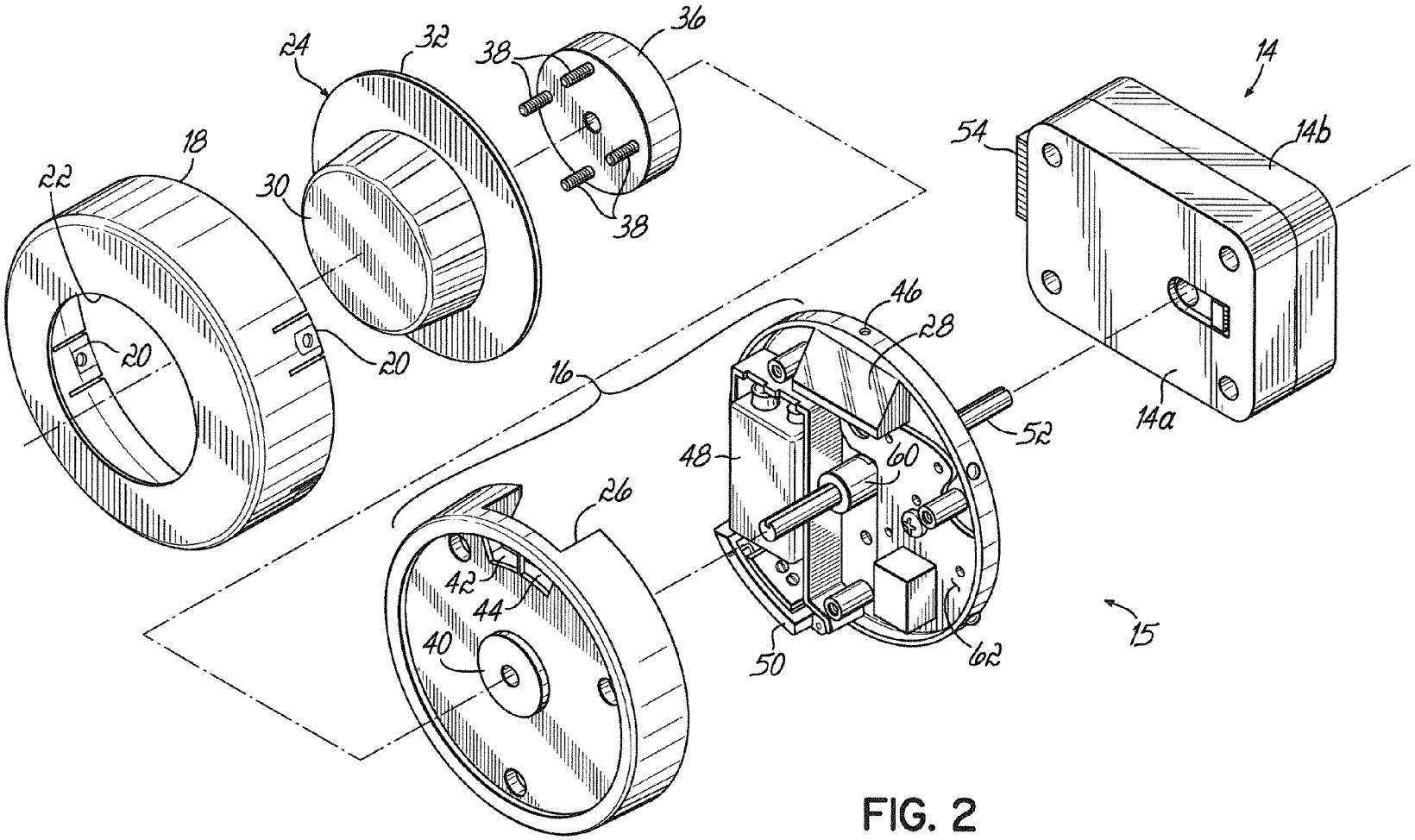
FIG. 2 is an exploded perspective view of the lock illustrated in FIG. 1.

FIG. 2 illustrates an exploded view of the user input device 15 and its contents. The dial 24 includes a protruding portion 30 which may be manually gripped by a user, and a plate portion 32 that includes the numerical combination numbers 34 on the backside thereof (see FIG. 3). A brass insert 36 is rigidly secured to the dial 24 using screw fasteners 38. The brass insert 36 can provide weight for the dial 24 and serve a bearing member for rotation against a portion 40 of the dial housing 16. The dial housing 16 includes windows 42, 44 for allowing the numbers on the back side of the dial plate portion 40 to be viewed via a reflection in the mirror 28. An LED indicator light 46 is provided and may be used in various manners to provide indication of combination input. A battery 48, such as a standard 9-volt battery, is removably placed in the dial housing 16 through a battery door 50, and provides power for the electronic circuit and servo motor to be discussed below. A rotatable spindle shaft 52 is provided for transferring rotation of the dial 24 to the bolt retraction hardware upon input of a correct combination code.

Figure 3:
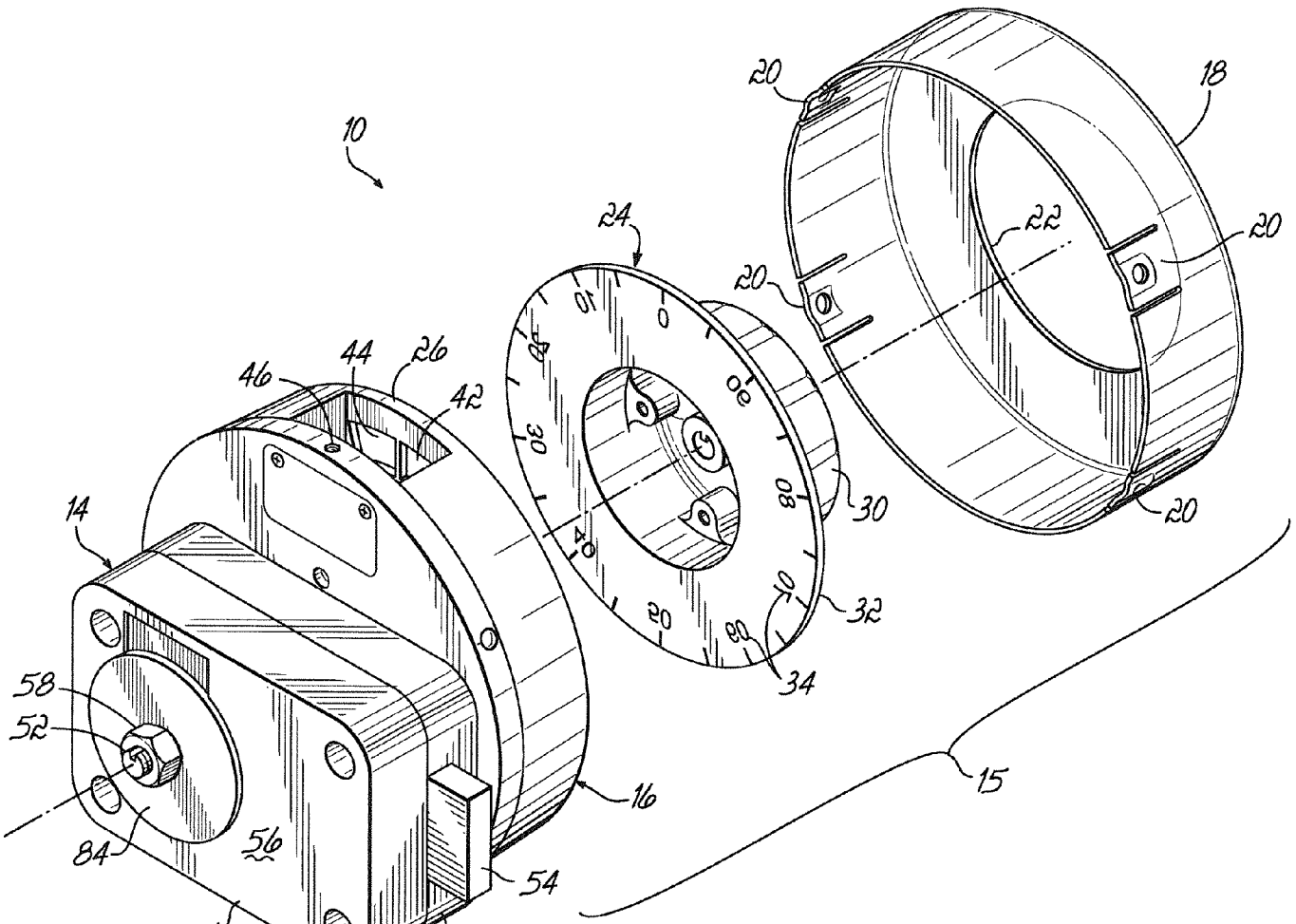
FIG. 3 is an exploded rear perspective view of the lock.

FIG. 3 illustrates a rear perspective view of the lock 10 and illustrates a lock bolt 54 extending from the lock casing 14. The shaft 52 extends through a back side 56 of the lock casing 14 and is secured with a nut 58 in such a manner as to allow rotation of the shaft 52 when the dial 24 is rotated. As further shown in FIG. 3, the back side of the dial plate portion 32 includes combination numbers, which, when reflected in the mirror 28 (FIG. 2) will be viewable by the user.

Figure 4:
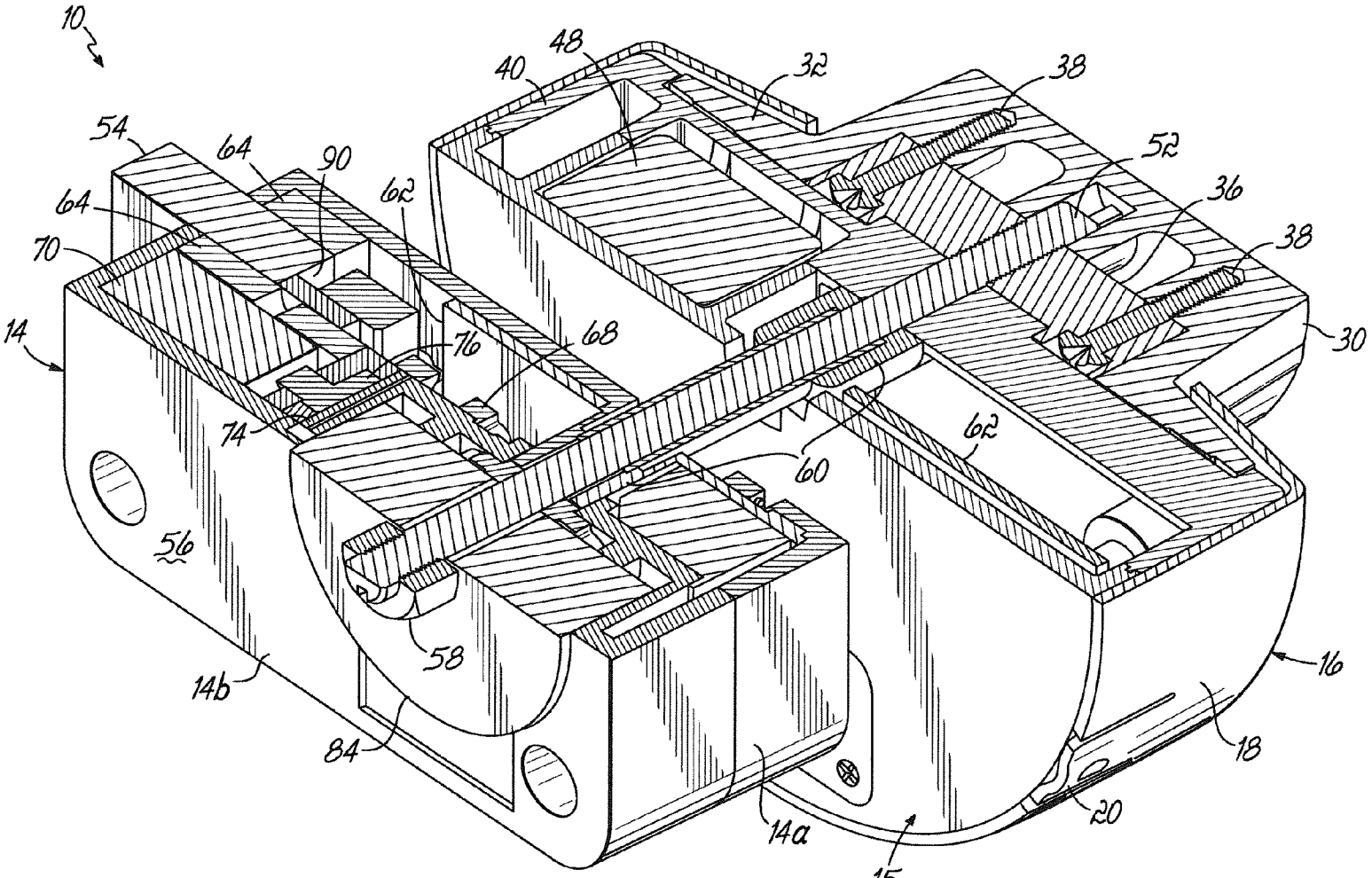
FIG. 4 is a perspective cross-sectional view of the lock taken along the longitudinal central axis thereof.

FIG. 4 illustrates a longitudinal cross-sectional view, in perspective, of the lock 10, including the various components described above. In particular, the spindle shaft 52 is shown extending completely through the dial housing 16 and the lock casing 14. One or more spindle sleeves 60 receive the spindle shaft 52 along its length. Such sleeves 60 will help prevent undesired entry into the lock casing 14 and access of the various bolt retraction hardware if the shaft 52 were to be removed.

Figure 5:
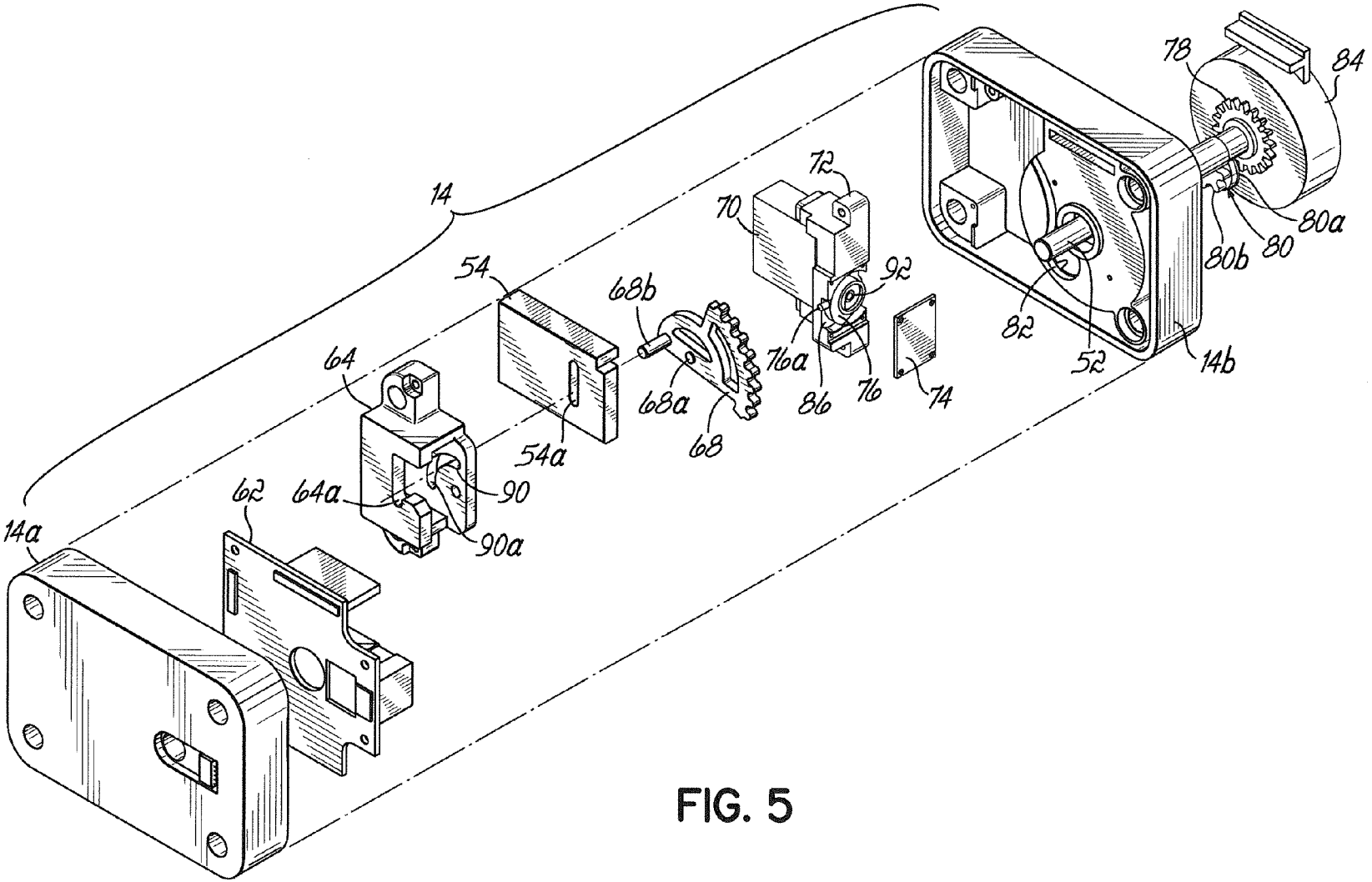
FIG. 5 is an exploded perspective view of the lock casing and bolt retraction hardware.
Figure 6:
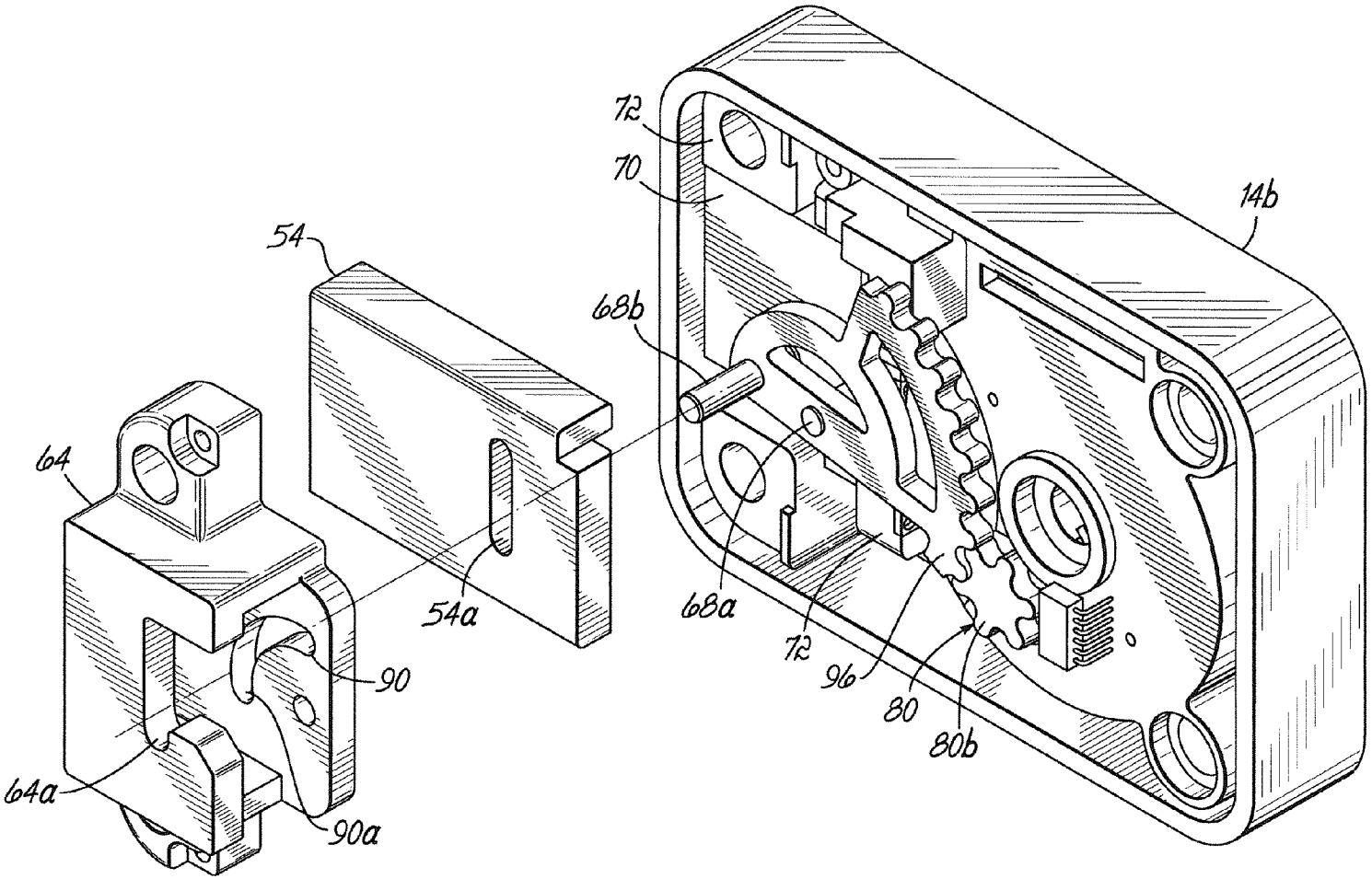
FIG. 6 is a perspective view, partially exploded to illustrate various bolt retraction hardware.
Figure 7:
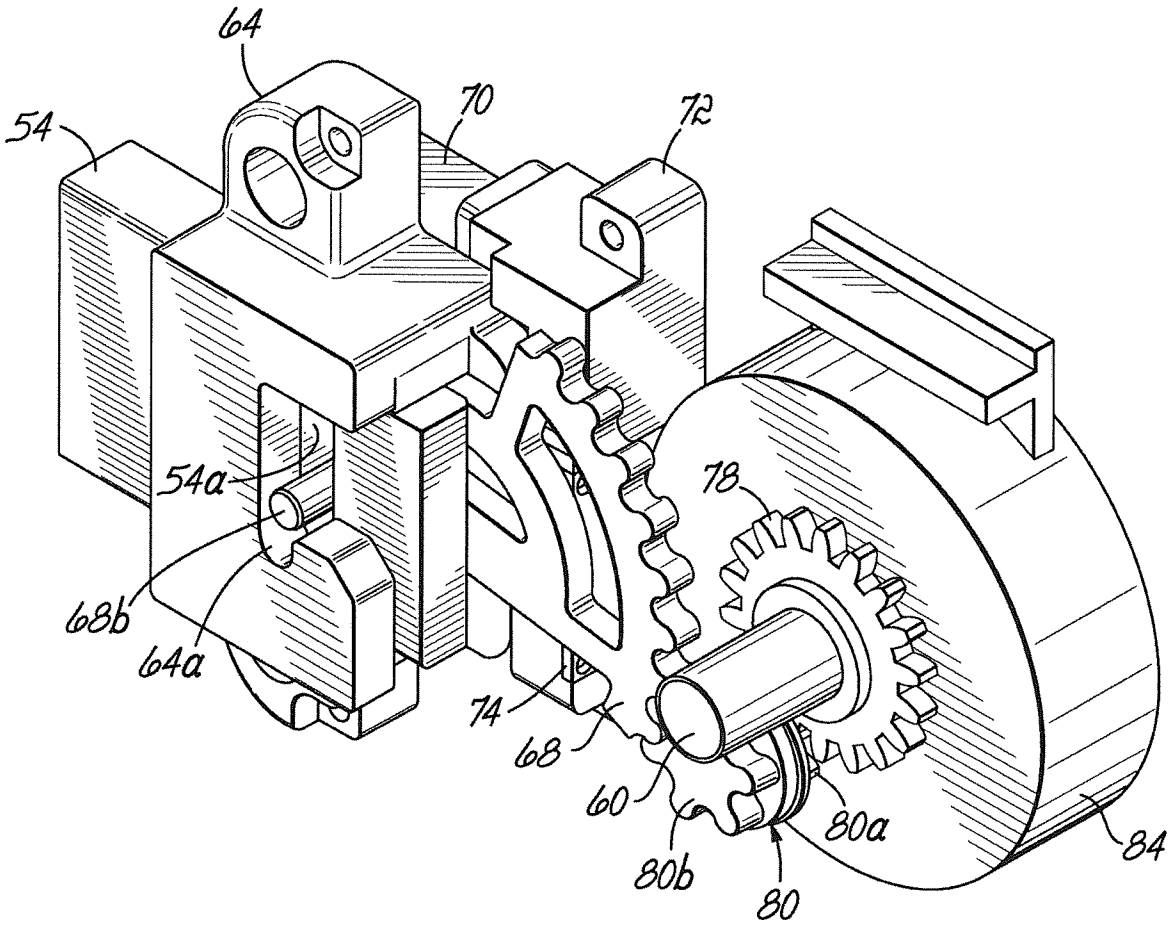
FIG. 7 is a perspective view of the bolt retraction assembly.

Turning to FIG. 5, the lock casing 14 is shown in exploded form to illustrate the circuit board 62 and various lock bolt retraction hardware, including a bolt guide member 64, the bolt 54, a bolt retraction gear 68, an actuator 70, a pivot block 72, and a cover 74 for fastening to the pivot block 72 and covering a rotating output element 76 of the actuator 70. The lock casing 14 includes a front casing half 14*a* and a rear casing half 14*b*. The circuit board 62 is placed on a front inner side of the front casing half 14*a*. Therefore, if a drill is used to drill into the lock casing 14 from outside of the door 12, the drill bit will first contact the circuit board 62 and likely disable the lock 10, thereby making entry more difficult. A spindle gear 78 is coupled for rotation with the spindle shaft 52 and the connected dial 24 (FIG. 4). The spindle gear 78 meshes with a first gear portion 80*a* of a drive gear element 80. An opposite or second gear portion 80*b* of the drive gear element 80 extends through an aperture 82 in the rear casing half 14*b*, such that it may mesh with the bolt retraction gear 68 upon input of a correct combination code as shown in FIGS. 6 and 7. An encoder 84 is used to detect input of combination codes via rotation of the shaft 52 and is used in conjunction with suitable controller circuitry on the circuit board 62.

Figure 8A:
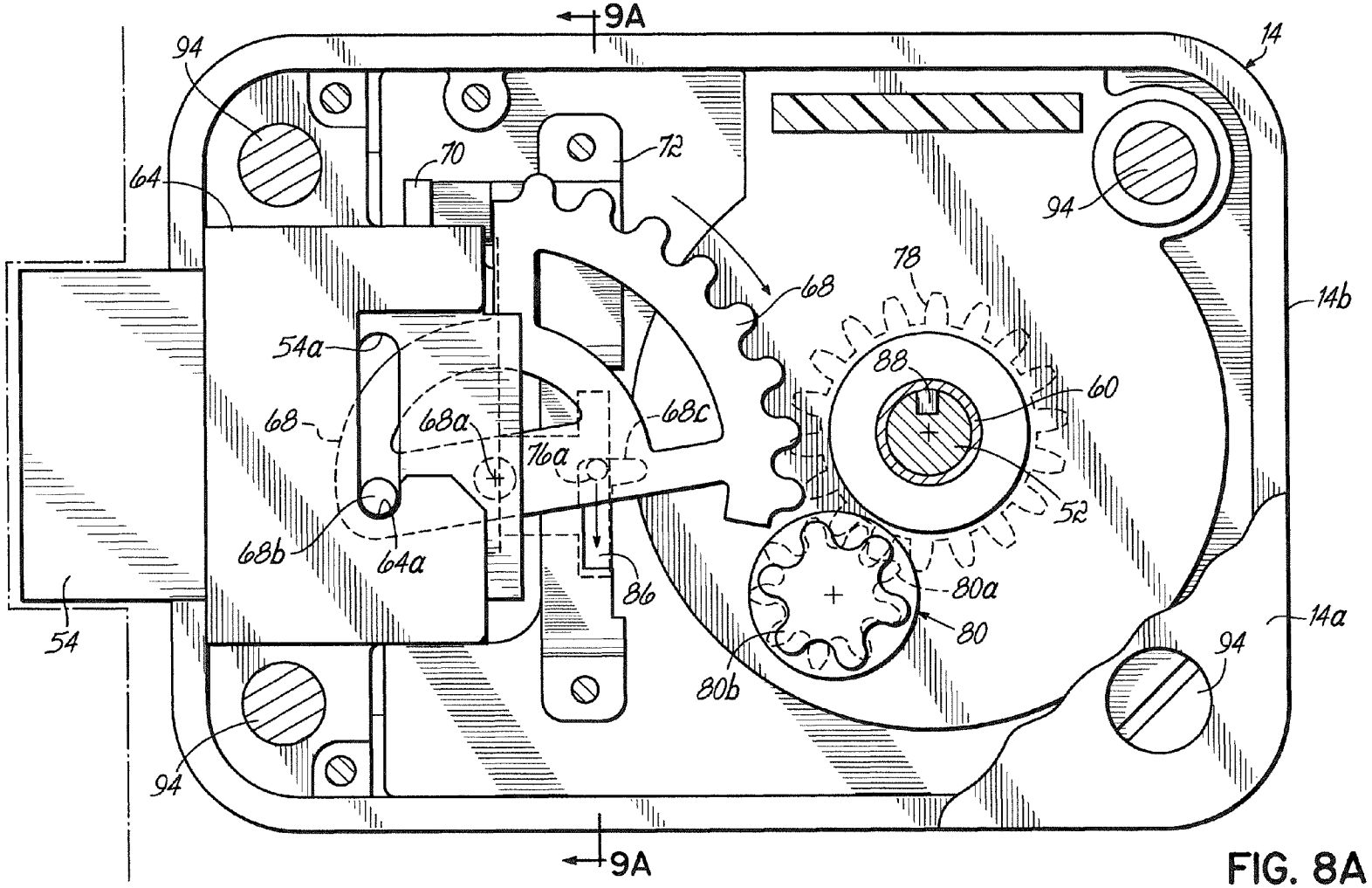
FIG. 8A is an elevational view partially broken away illustrating the bolt retraction hardware with the bolt in an extended or locked position.
Figure 8B:
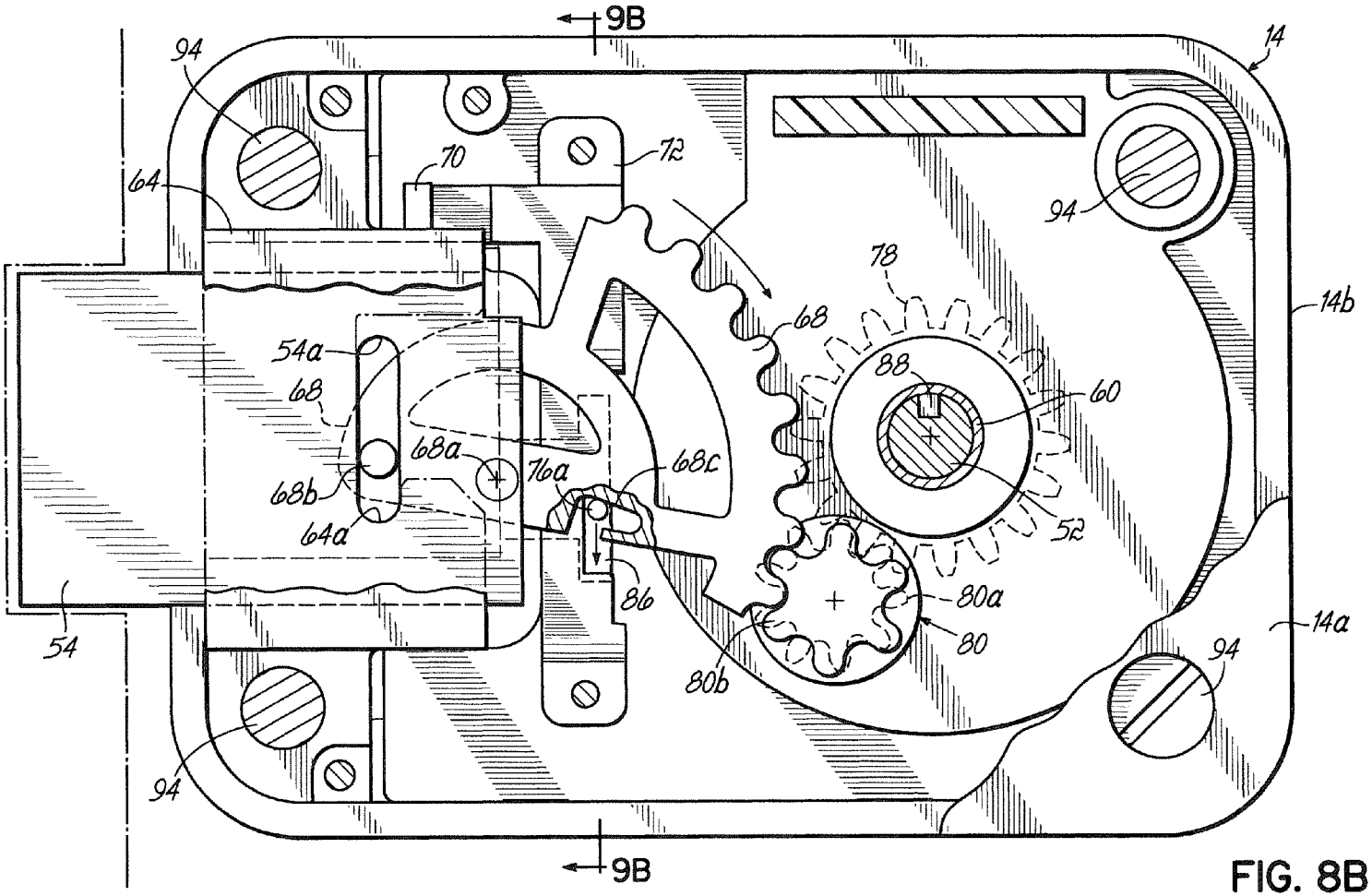
FIG. 8B is an elevational view similar to FIG. 8A, illustrating an initial portion of the bolt retraction sequence.
Figure 8C:
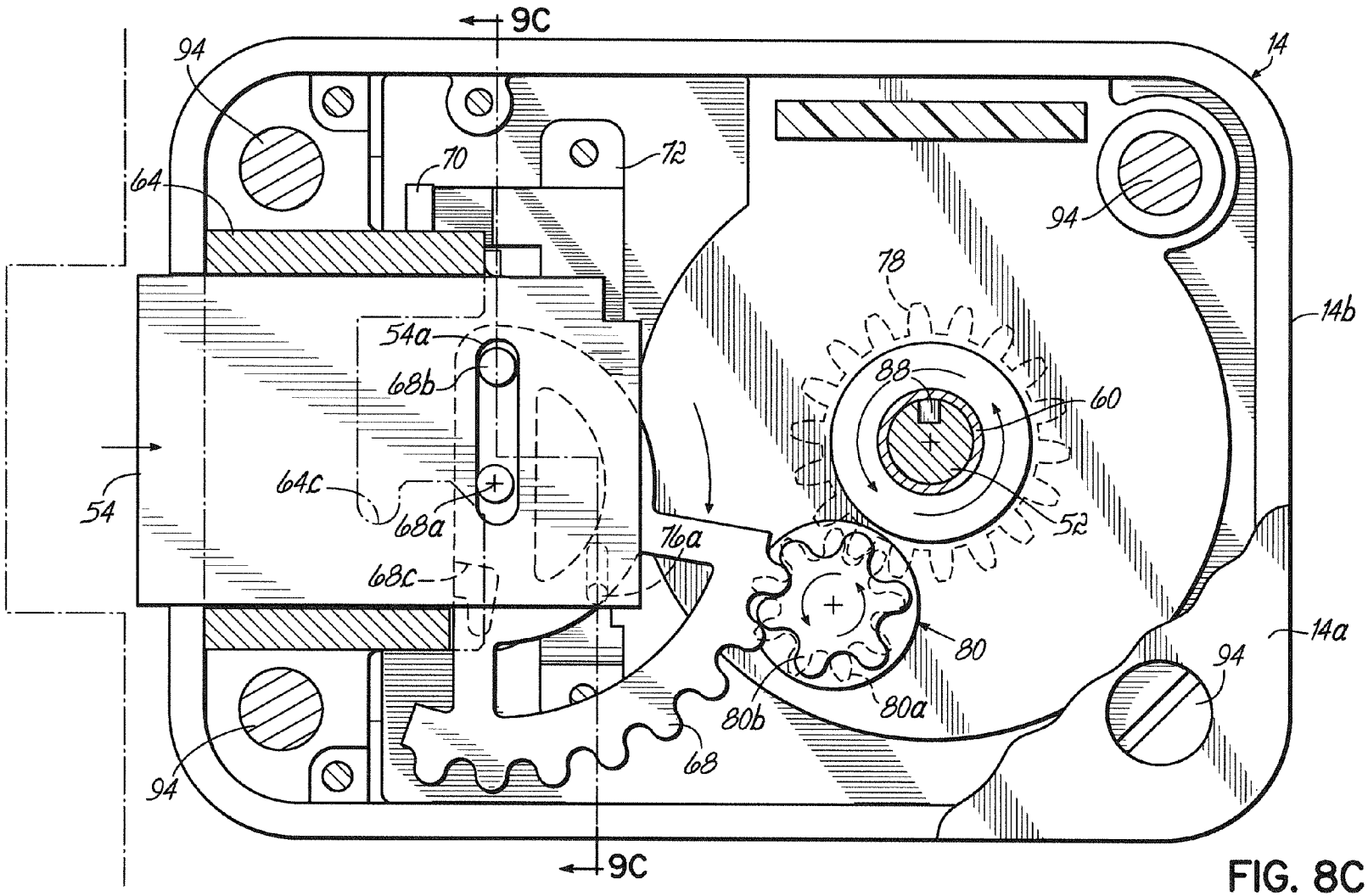
FIG. 8C is an elevational view similar to FIG. 8B, illustrating the fully retracted position of the bolt and associated bolt retraction hardware.
Figure 9A:
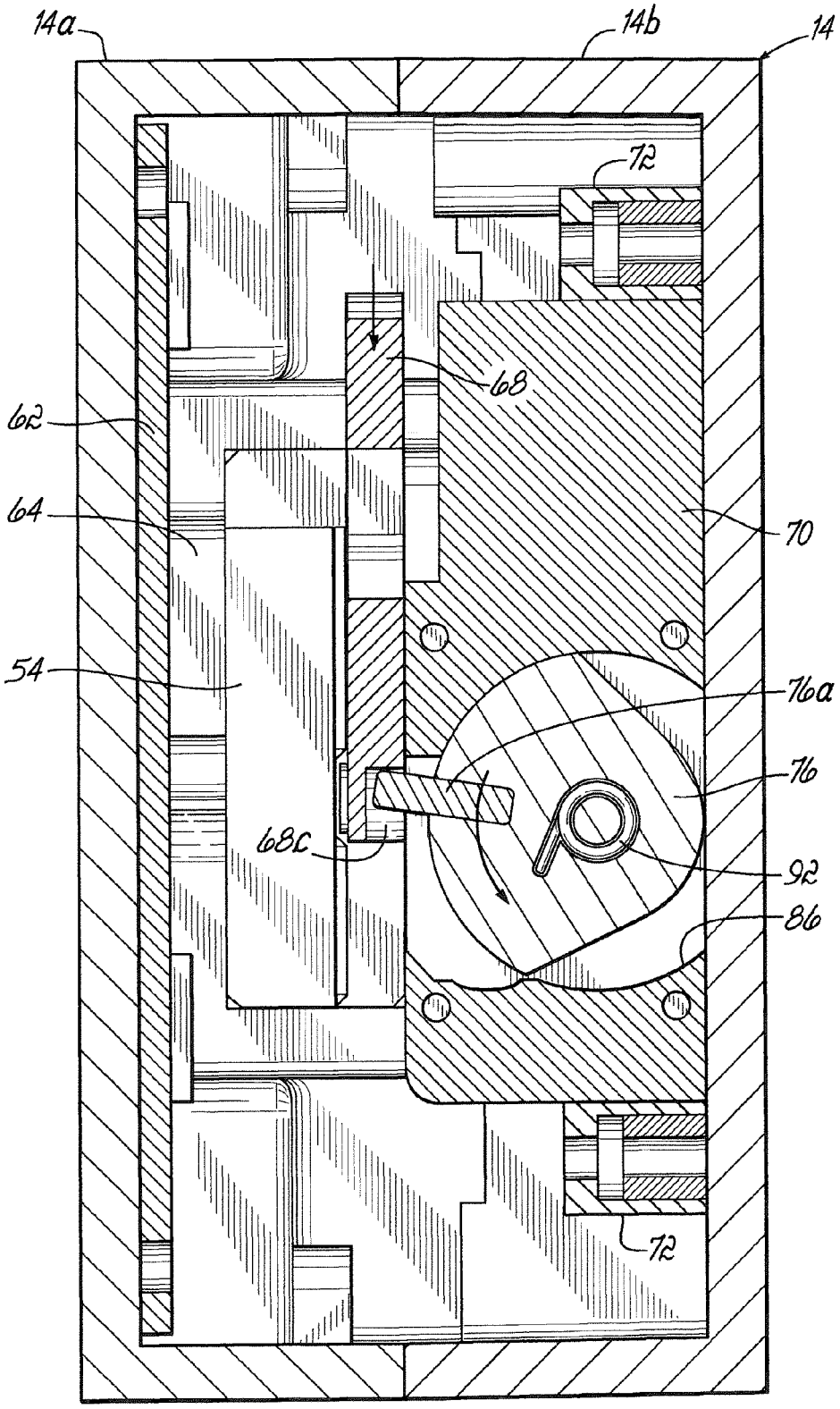
FIG. 9A is a cross-sectional view taken along the line 9A-9A of FIG. 8A.
Figure 9B:
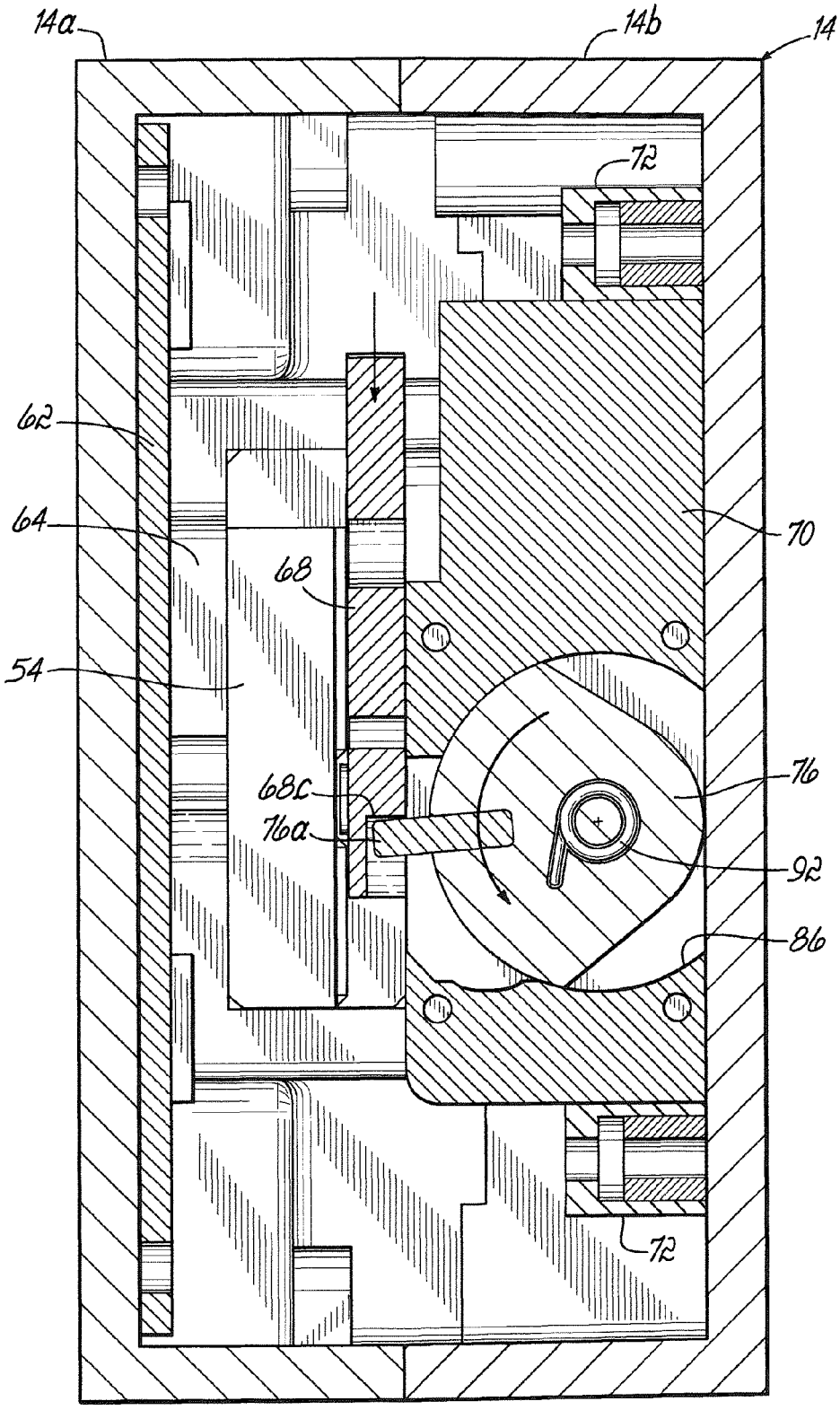
FIG. 9B is a cross-sectional view taken along line 9B-9B of FIG. 8B.
Figure 9C:
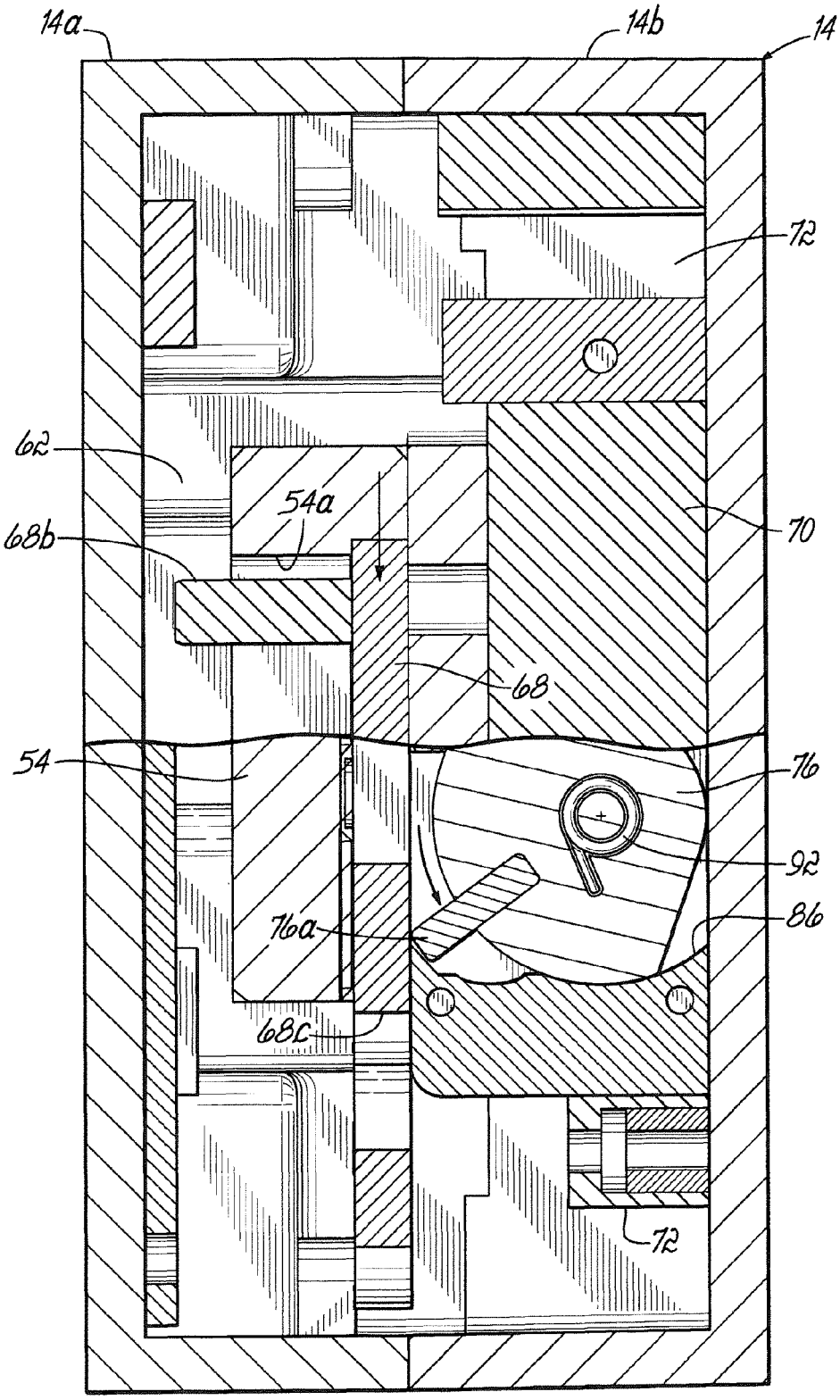
FIG. 9C is a cross-sectional view taken along line 9C-9C of FIG. 8C.

Turning to FIGS. 6 and 7, taken in conjunction with FIGS. 8A-8C and 9A-9C, the bolt retraction sequence will now be discussed. Upon entry of the correct combination code as recognized by the encoder and controller circuitry, the actuator 70 will be activated such that its output element 76 rotates. The output element 76 includes a pin 76*a* that will rotate through a slot 86 in the pivot block 72 (FIG. 5) and also move through a slot 68*c* in the bolt retraction gear 68. Normally this pin 76*a* would prevent rotation of the bolt retraction gear 68, as shown in FIG. 8A, for example. However, when the output element 76 of the actuator 70 rotates and moves the pin 76*a* in a downward direction, as viewed in FIGS. 8A-8C, this allows the bolt retraction gear 68 to move or rotate clockwise as viewed in FIGS. 8A-8C, such that it may engage with the second portion 80*b* of the drive gear element 80. Although not shown in the drawings, the bolt retraction gear 68 is slightly spring-loaded, with, for example, a torsion spring of low spring force, such that the bolt retraction gear 68 is biased in the clockwise direction to the position shown in FIG. 8B upon activation of the actuator 70. Once the gears 68, 80*b* are engaged as shown in FIG. 8B, the dial 24 may be manually rotated such that the drive gear element 80 is rotated through engagement of the first drive gear portion 80*a* with the spindle gear 78. As shown in FIGS. 8A-8C, the spindle gear 78 is coupled to the shaft 52 by a key 88. When the bolt retraction gear 68 is engaged with the drive gear portion 80*b* as shown in FIG. 8B, the bolt retraction gear 68 will rotate about its pivot axis 68*a*, and a pin 68*b* secured to the bolt retraction gear 68 will rise out of a position seated in a recess 64*a* of the bolt guide member 64 and the end 90*a* of a curved slot or pin guide 90 of the bolt guide member 64 (FIG. 5). The pin 68*b* also extends through a slot 54*a* in the bolt 54, and as the bolt retraction gear 68 rotates, the pin 68*b* rides upwardly in the slot 54*a* as viewed in FIGS. 8B and 8C and simultaneously moves the bolt 54 into the lock casing 14 and through the bolt guide member 64. Rotating the dial 24, shaft 52, and gears 78, 80, 68 in the opposite direction will extend the bolt 54 back to its fully-extended position and the bolt retraction gear 68 will be returned to the initial position shown in FIG. 8A by the pin 76*a*. In this regard, the output element 76 is spring-loaded by use of a spring 92 such that when the actuator 70 is deactivated, the spring 92 will return the pin 76*a* to the initial position shown in FIG. 9A, and the spring force of the output element 76 is sufficiently strong to force the bolt retraction gear 68 to the initial position shown in FIG. 8A.

The use of a dial plate portion 32 and mirror 28 allows for placement of the battery 48 in the dial housing 16 in a space efficient manner. The lock casing portions 14*a*, 14*b* are mechanically fixed together, such that if they are pried apart, the mechanical elements (not shown) fixing the lock casing 14 together will break. It will be appreciated that the bolts 94 extending through the lock casing 14 do not fasten the lock casing portions 14*a*, 14*b* together, but merely serve to secure the lock casing 14 to, for example, a door 12. Another manner of surreptitious entry into locks may involve using a hammer from the outside to force the spindle shaft 52 through the lock 10. In the present lock, however, this does not move the casing 14, and, therefore, there would be no need for a "relock" feature as used in other high-security locks. The actuator 70 is a servo motor 70 in the illustrated embodiment. The use of the servo motor 70, such as a micro-servo as opposed, for example, to a stepper motor, has advantages. For example, the servo motor 70 includes a relatively complex gear train that involves several revolutions in order to rotate the output element 76 through just a partial rotation as discussed above. Thus, the servo motor 70 would be difficult to activate in some surreptitious manner. The pin 68*b* used on the bolt retraction gear 68 rests in a recess in its home position with the lock bolt 54 extended as shown in FIG. 8A. Thus, if the lock bolt 54 is forced inwardly in a surreptitious attempt to compromise the lock 10, the force will not be exerted against the gear train, but rather against the bolt guide member 64, which may be designed and configured to withstand high forces.

Figure 10:
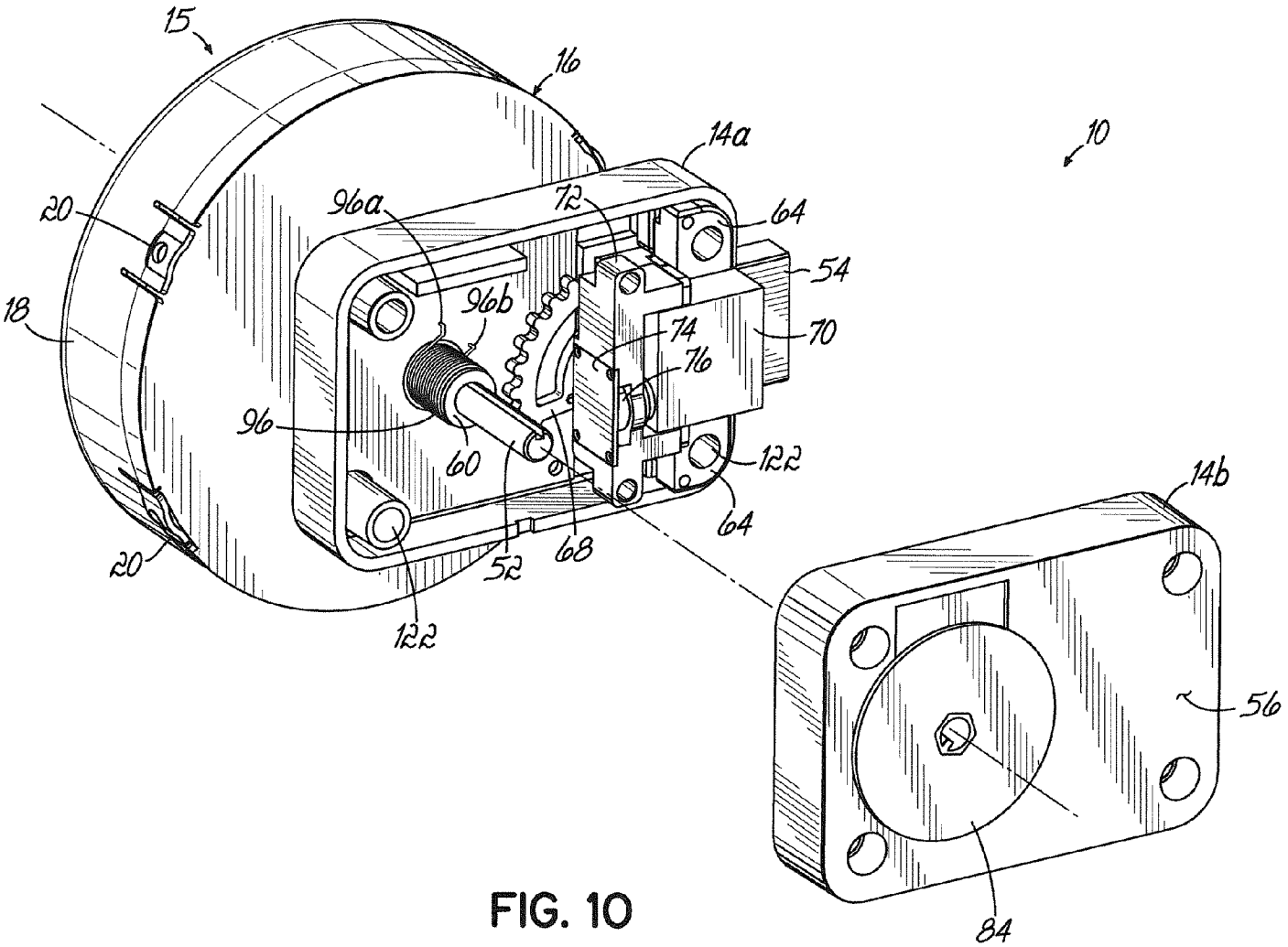
FIG. 10 is a rear perspective view of the lock of FIG. 1 with the lock casing partially exploded to illustrate a circuit breaker boil.

With reference to FIG. 10, the lock 10 further includes a circuit breaker device 96. The circuit breaker device 96 of the illustrated embodiment consists of a continuous conductive wire having a first end 96*a* and a second end 96*b*, each end 96*a*, 96*b* electrically connected to the circuit board 62. The circuit breaker device 96 is connected integrally into the primary controller circuits for the lock 10 such that if the circuit breaker device 96 is broken, the lock 10 will become inoperable. As seen in FIG. 10, the circuit breaker device 96 is disposed adjacent to the spindle sleeve 60 that carries the spindle shaft 52 as the shaft 52 enters the lock casing 14. An unauthorized person trying to circumvent the lock 10 may remove the user input device 15 and then attempt to drill into the spindle sleeve 60 at the front opening of the lock casing 14. However, any attempt to surreptitiously enter the lock casing 14 through the spindle sleeve 60 will cause the circuit break device 96 to break, thereby thwarting this method of attack on the lock 10. The circuit breaker device 96 is illustrated as a coil in FIG. 10, the coil being wrapped around the spindle sleeve 60. One skilled in the art will recognize that the circuit breaker device 96 may also comprise a plurality of wires.

Figure 11:
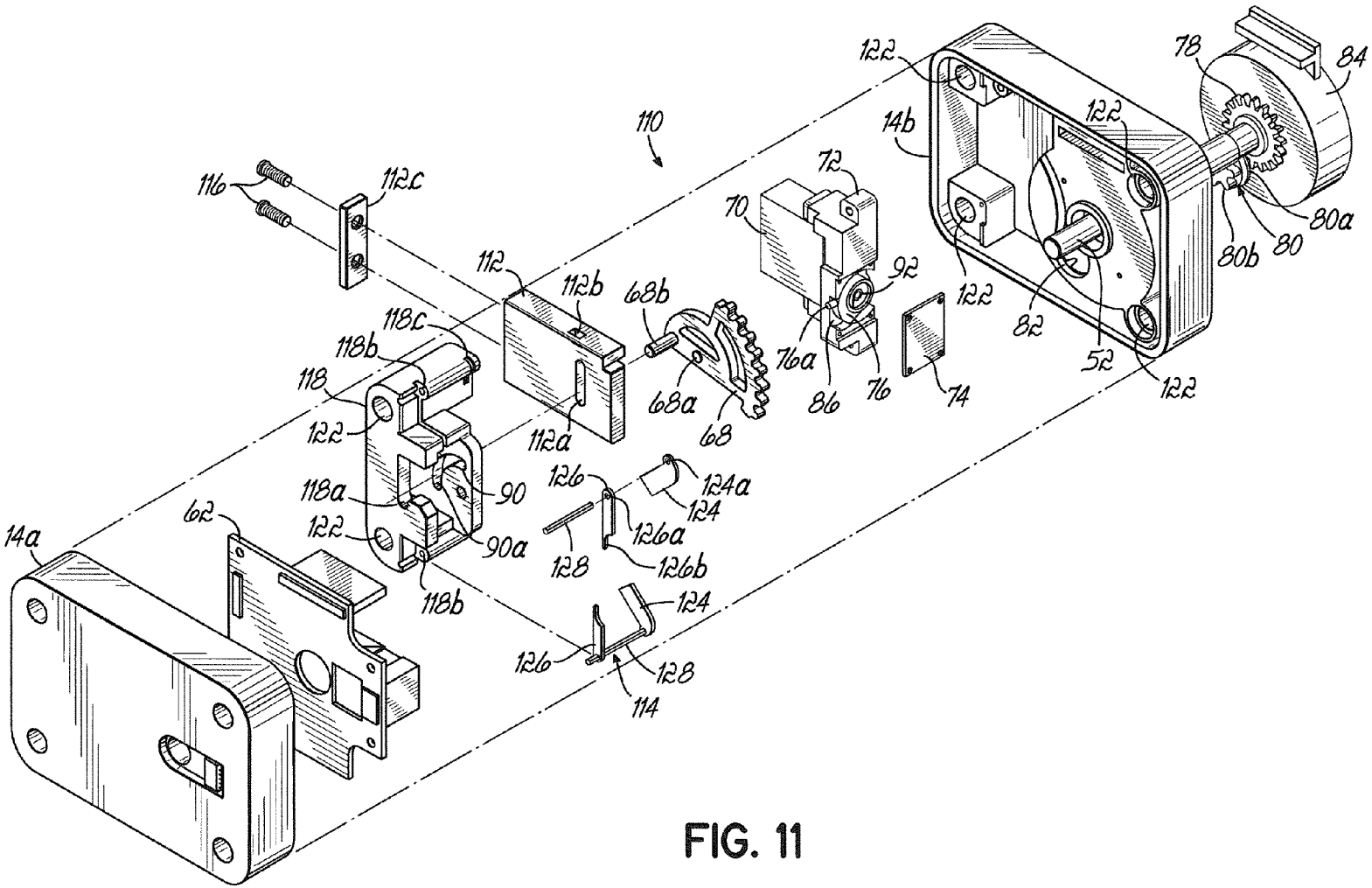
FIG. 11 is an exploded perspective view of an alternative embodiment of the lock casing and bolt retraction hardware.

With reference to FIGS. 11-14C, another embodiment of a lock 110 is illustrated. As most clearly shown in the exploded view of the lock casing 14 and inner lock hardware of FIG. 11, the lock 110 includes many of the same elements as the first embodiment of the lock 10, such as the circuit board 62, bolt retraction gear 68, and actuator 70. In this application, reference numerals remain the same for similar elements in the various embodiments described. This embodiment of the lock 110 follows the same bolt retraction sequence illustrated in FIGS. 6-9C and described above, and the lock 110 includes a different lock bolt 112 and a retracting bolt shield 114. The lock bolt 112 includes a slot 112*a* adapted to receive the pin 68*b* of the bolt retraction gear 68. The lock bolt 112 further includes a pair of opposing recesses 112*b* used in the retracting bolt shield 114 as described in detail below, and also a bolt extension 112*c*. The bolt extension 112*c* is coupled to the lock bolt 112 with threaded fasteners 116 that are disposed flush with the bolt extension 112*c* outer surface when the bolt extension 112*c* is placed on the lock bolt 112. In the embodiment of FIG. 11, the bolt extension 112*c* has a thickness of about one-tenth (0.100) to three-sixteenths (0.1875) of an inch. Various government contractors have manufactured locks for the United States government, and one of the primary lock manufacturers designed lock bolts that were flush with the lock casing when retracted, while another primary lock manufacturer designed lock bolts that extended about three-sixteenths (0.1875) of an inch beyond the lock casing when retracted. The bolt extension 112*c* can be added to the lock bolt 112 if necessary for the door 12 selected. Thus, the lock bolt 112 can be configured for use with any type of door.

Figure 12:
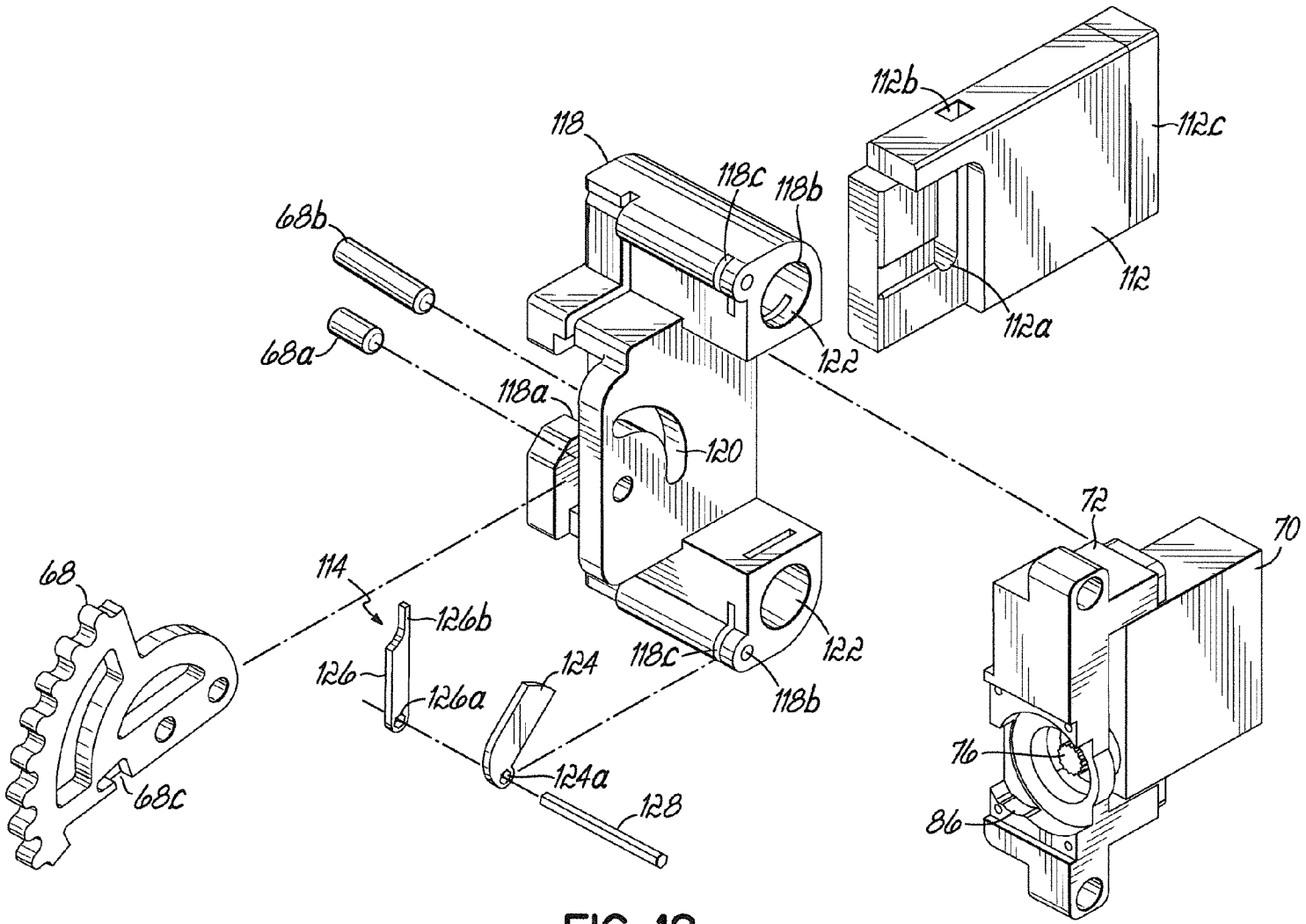
FIG. 12 is an exploded view of the bolt retraction hardware and retracting mounting screw shield of FIG. 11.
Figure 13:
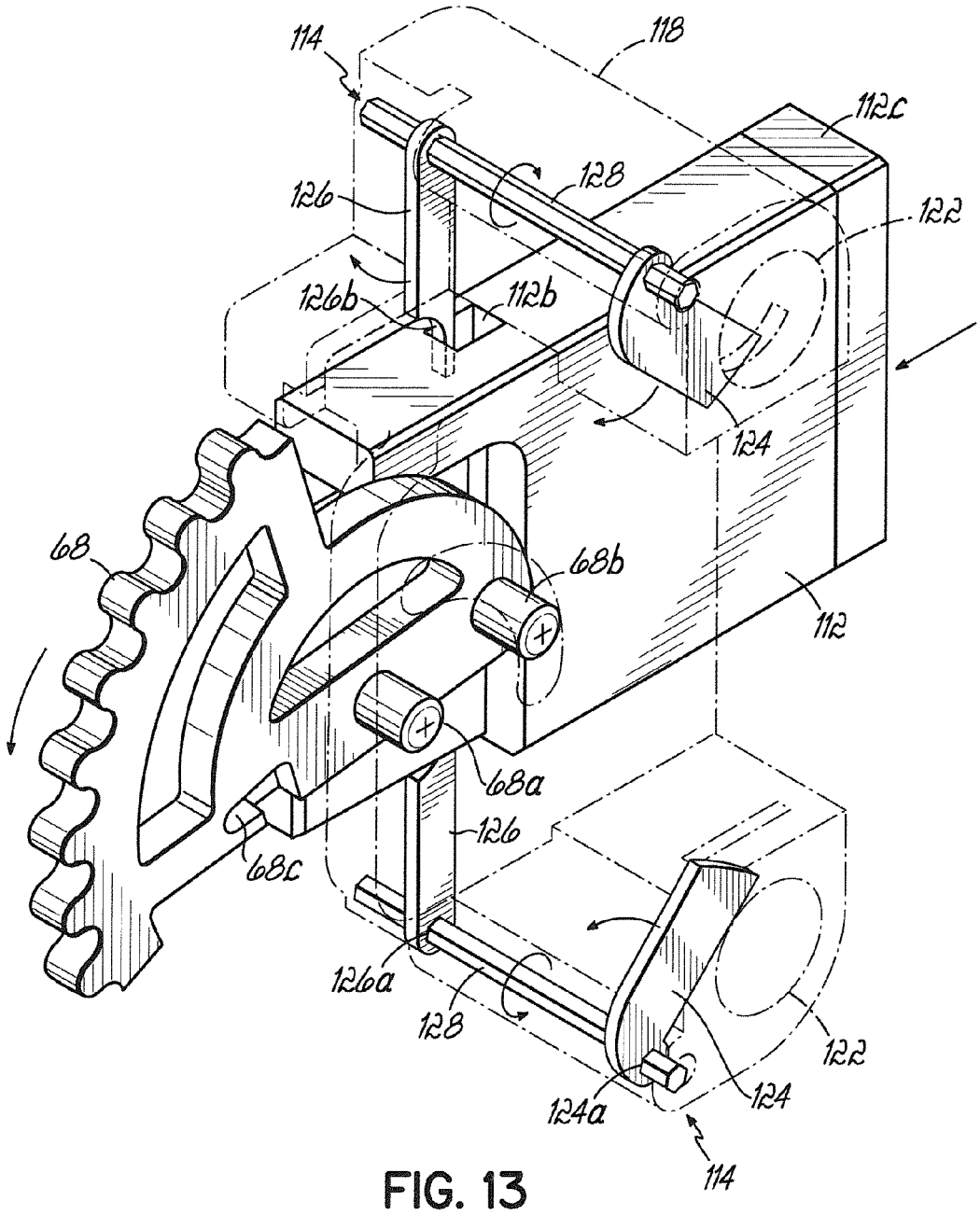
FIG. 13 is a perspective view of the bolt retraction hardware and retracting mounting screw shield of FIG. 11.

As shown in the previous embodiment, the mounting bolts 94 of the lock casing 14 are accessible from the back side 56 of the lock casing 14. An unauthorized person having access to this rear side 56 could remove the mounting screws 94 and replace the lock casing 14 with a lock body of a different mechanism, thereby compromising the lock 110. To address this problem, the lock 110 of the current embodiment includes the retracting bolt shield 114. As shown in FIGS. 11 and 12, the lock 110 includes a modified bolt guide member 118. The bolt guide member 118 continues to include a recess 118*a* and a curved slot 120 for engaging the pin 68*b* of the bolt retraction gear 68. The bolt guide member 118 also has a pair of longitudinally-directed apertures 118*b* formed on opposing sides of the bolt guide member 118. These longitudinally-directed apertures 118*b* are in communication with laterally-directed slots 118*c*, the slots 188*c* extending from an edge of the bolt guide member 118 to longitudinal receptacles 122 holding the mounting bolts 94. The retracting bolt shield 114 includes a blocking member 124 with a non-circular aperture 124*a*, a first member 126 with a non-circular aperture 126*a*, and a non-circular drive rod 128 operatively coupling the blocking member 124 to the first member 126 at the non-circular apertures 124*a*, 126*a*. The drive rod 128 is positioned within one of the longitudinally-directed apertures 118*b* of the bolt guide member 118 while the blocking member 124 is at least partially disposed in one of the lateral slots 118*c*, as most clearly shown in FIG. 13. The drive rod 128 and associated apertures 124*a*, 126*a* are hexagonal in the illustrated embodiment, but one skilled in the art will appreciate that any alternative non-circular shape may be chosen for these elements. The first member 126 has a first end 126*b* configured to engage the lock bolt 112 and more specifically, one of the recesses 112*b* in the lock bolt.

Figure 14A:
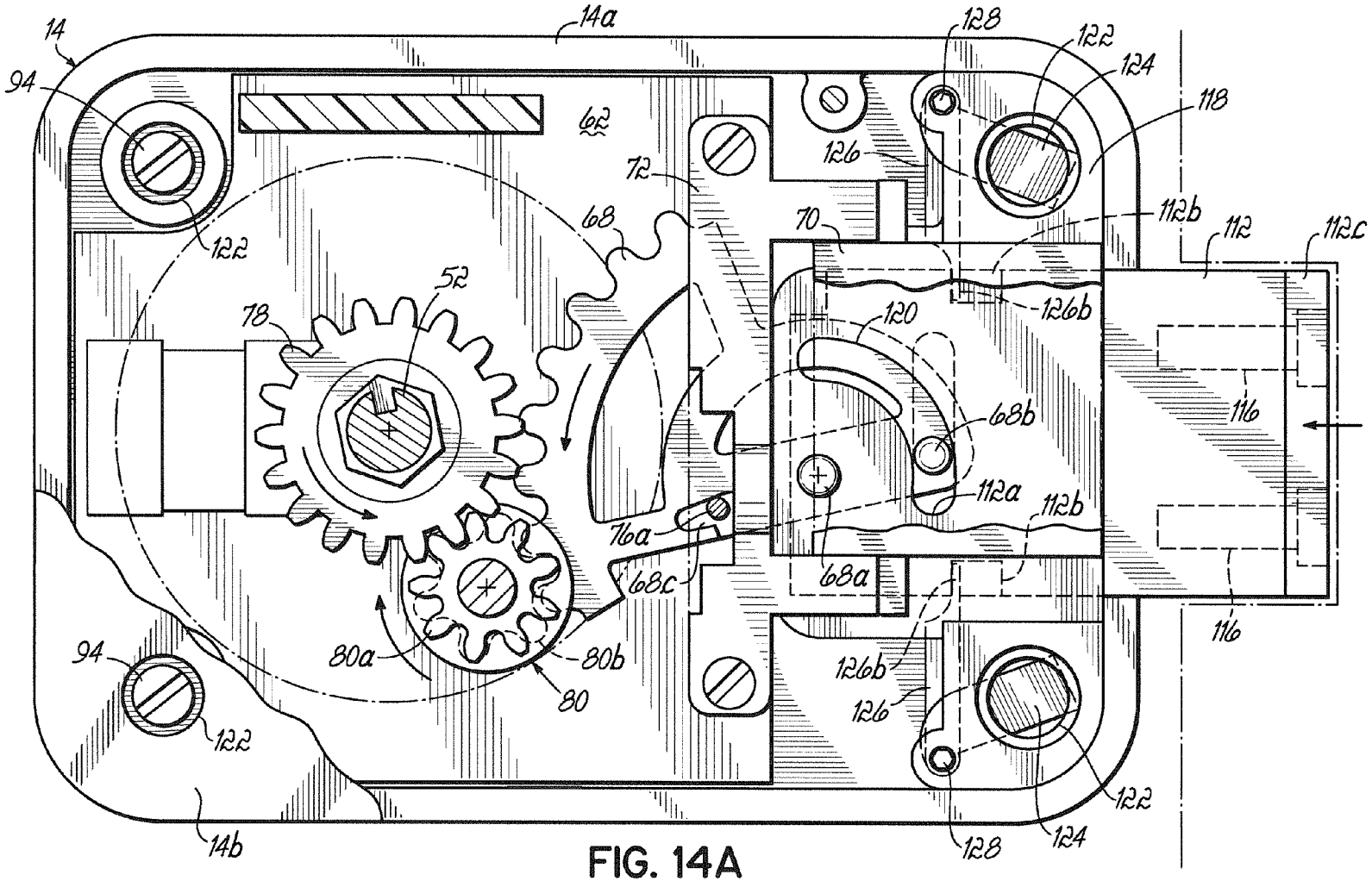
FIG. 14A is an elevational view illustrating the retracting mounting screw shield of FIG. 11 in a locked position of the bolt retraction hardware.
Figure 14B:
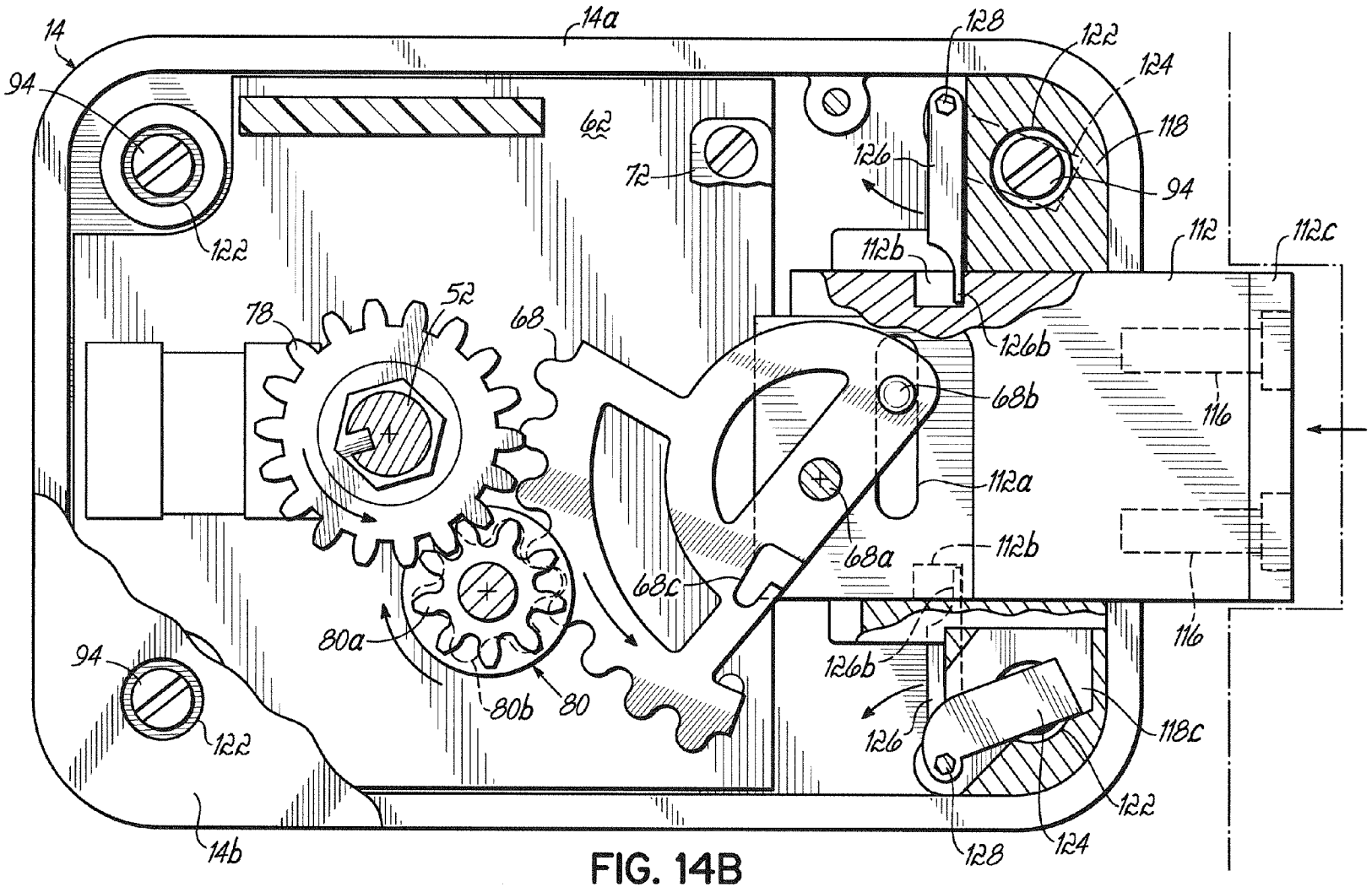
FIG. 14B is an elevational view similar to FIG. 14A, illustrating an initial portion of the bolt retraction sequence.
Figure 14C:
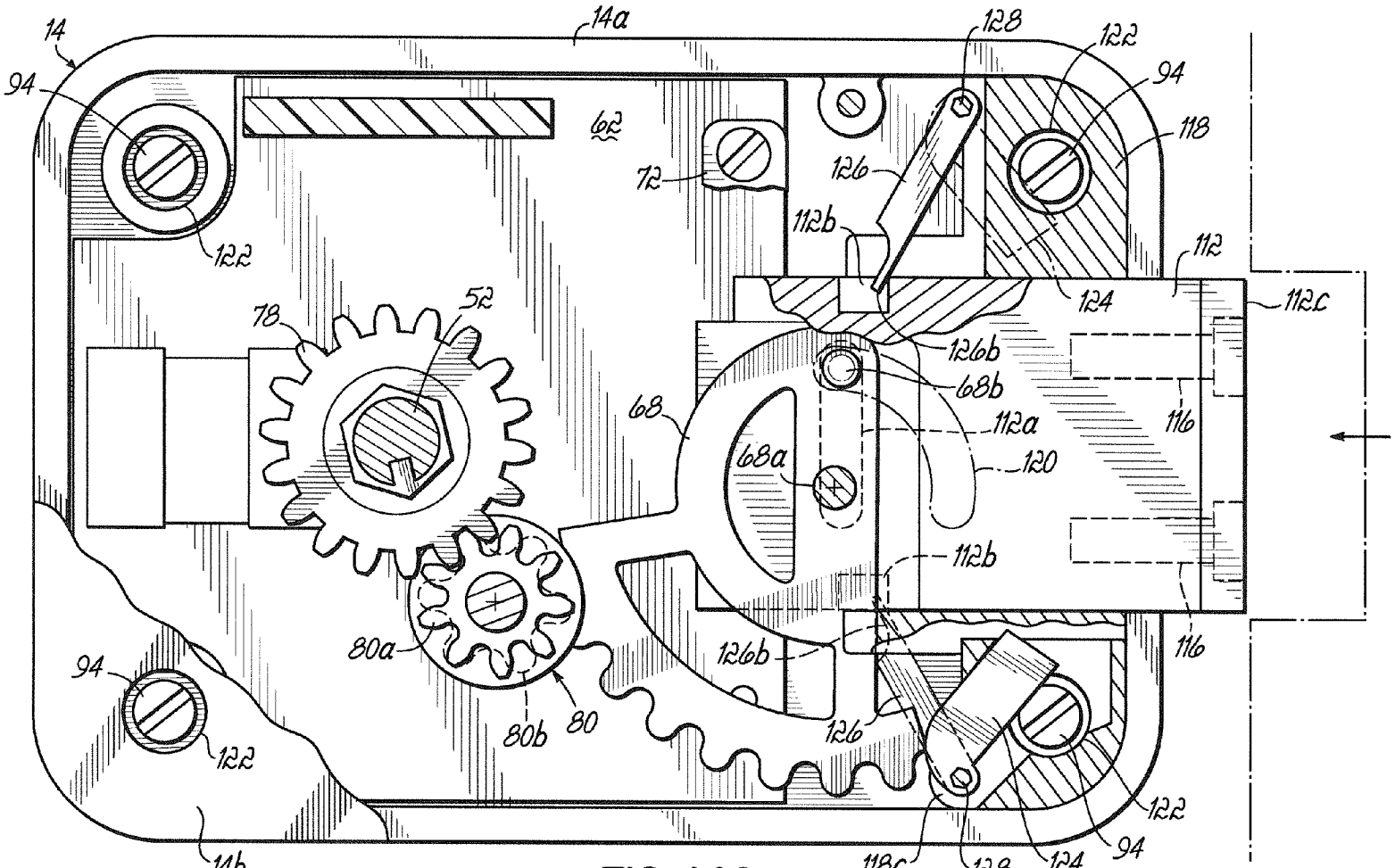
FIG. 14C is an elevational view similar to FIG. 14A, illustrating the fully retracted position of the bolt and associated rotation of the retracting mounting screw shield.

The operation of the retracting bolt shield 114 is illustrated in a sequence of illustrations at FIGS. 14A-14C. In FIG. 14A the bolt retraction gear 68 has just been engaged with the gear train 78, 80 to begin the process of retracting the lock bolt 112. When the lock bolt 112 is in the extended position, the blocking members 124 completely conceal the mounting bolts 94 on the bolt-side of the lock 110. In FIG. 14B, the bolt retraction gear 68 has moved to partially retract the lock bolt 112. In this operational state, the blocking members 124 continue to conceal the mounting bolts 94 because the first member first end 126*b* has moved within the lock bolt recess 112*b* but has not been rotated. As the bolt retraction gear 68 continues to retract the lock bolt 112, the recesses 112*b* force the first members 126 to rotate to the position shown in FIG. 14C. Once the lock bolt 112 has been fully retracted in that position, the drive rods 128 have transferred the motion of the first members 126 to the blocking members 124 to reveal the mounting bolts 94. As the spindle gear 78 drives the bolt retraction gear 68 and lock bolt 112 back to an extended or locked position, the first members 126 again engage the lock bolt recesses 112*b* and rotate back to the position in FIG. 14A. Thus, the retracting bolt shield 114 prevents an unauthorized person attempting to tamper with the lock 110 by removing the mounting bolts 94.

In a similar non-illustrated embodiment, the retracting bolt shield 114 could include a second pair of blocking members coupled for rotation with the bolt-side blocking members 124 through a simple linkage. In that embodiment, the bolt-side blocking members 124 would conceal the mounting bolts 94 on one side of the lock 110 when the lock bolt 112 is extended and the second pair of blocking members would conceal the mounting bolts 94 on the opposite side of the lock 110 when the lock bolt is retracted. Thus, an unauthorized person would need to be able to operate the lock 110 using the combination in order to have access to all four mounting bolts 94.

Figure 15A:
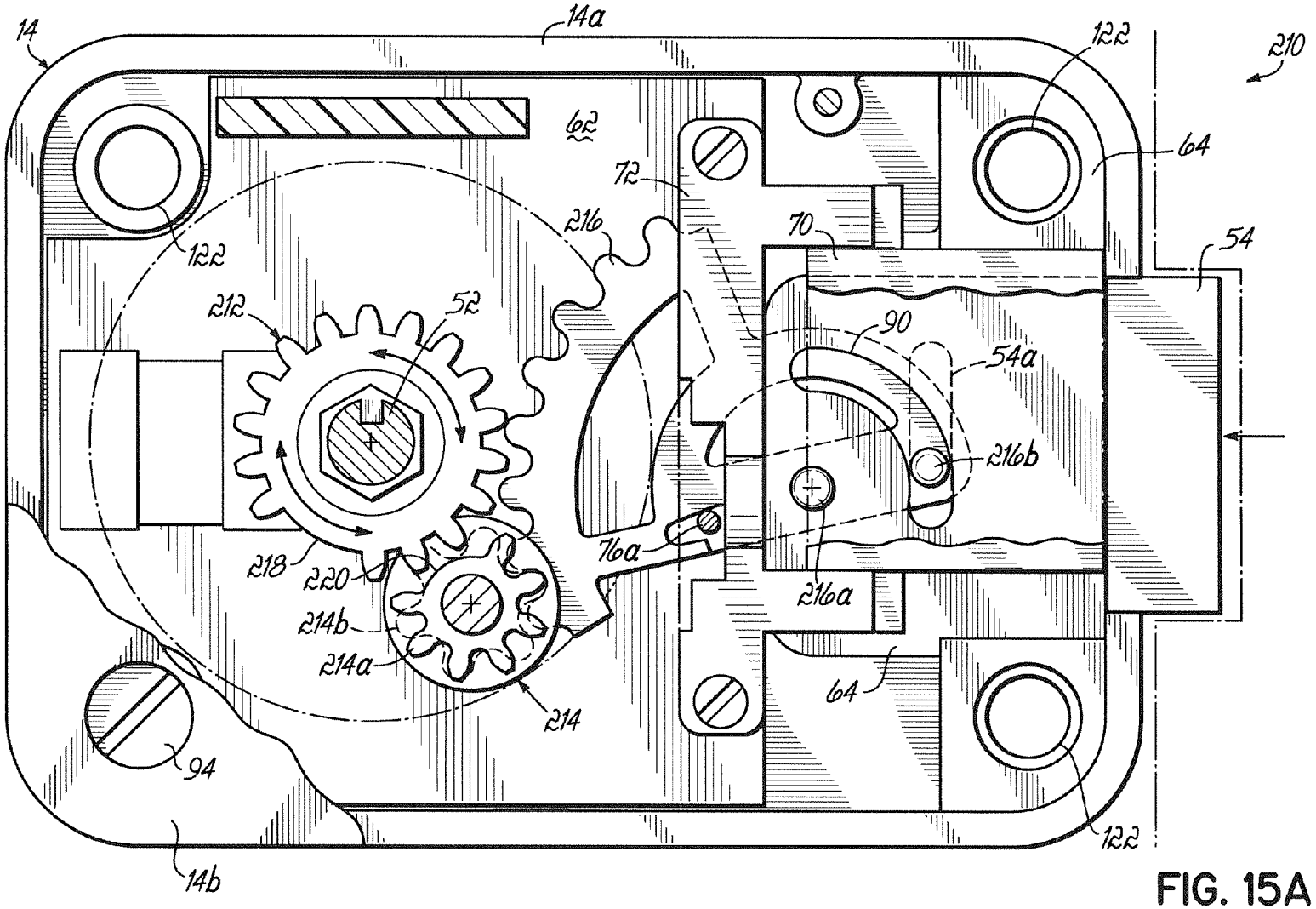
FIG. 15A is an elevational view partially broken away of another alternative embodiment of the lock, illustrating the bolt retraction hardware with the bolt in an extended or locked position.
Figure 15B:
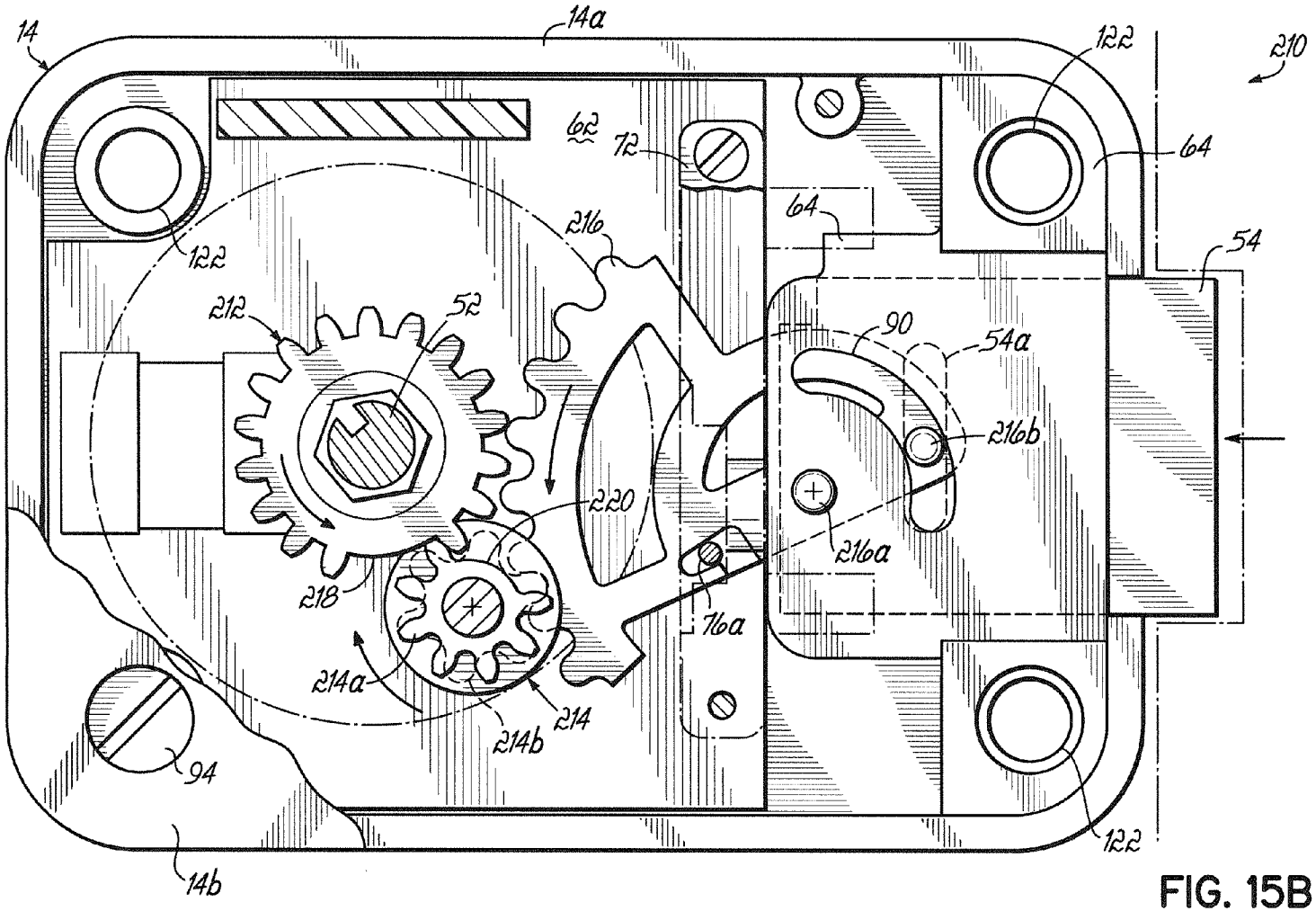
FIG. 15B is an elevational view similar to FIG. 15A, illustrating an initial portion of the bolt retraction sequence.
Figure 15C:
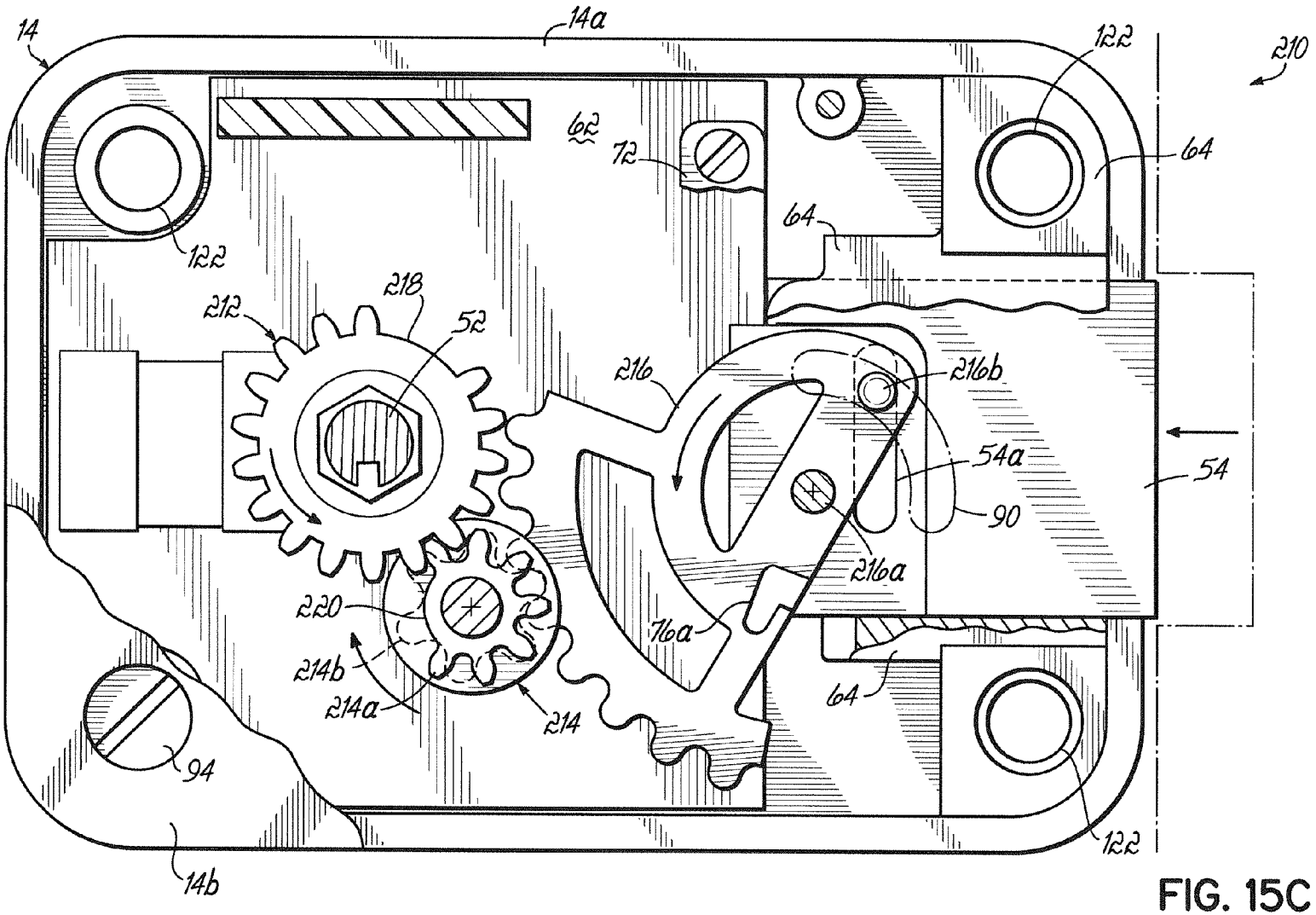
FIG. 15C is an elevational view similar to FIG. 15A, illustrating the fully retracted position of the bolt and associated bolt retraction hardware.

With reference to FIGS. 15A-15C, an additional embodiment of the lock 210 is illustrated. The lock 210 operates a bolt retraction sequence substantially similar to the above described bolt retraction sequence shown in FIGS. 8A-9C, with some modifications. The lock 210 includes a spindle gear 212, a drive gear 214 having a first drive gear portion 214*a* adapted to engage the spindle gear 212 and a second drive gear portion 214*b*, and a bolt retraction gear 216 adapted to engage the second drive gear portion 214*b*. Like the previous embodiments, the bolt retraction gear 216 includes a pivot axis 216*a* and a pin 216*b* which rides in corresponding slots 54*a*, 90 of the lock bolt 54 and the bolt guide member 64. Unlike the previous embodiments, the bolt retraction gear 216 remains engaged with the second drive gear portion 214*b* when the lock bolt 54 is fully extended as shown in FIG. 15A. A two-tooth relief 218 is provided on the spindle gear 212 and a corresponding two-tooth relief 220 is provided on the first drive gear portion 214*a*. The relief 220 in the first drive gear portion 214*a* is oriented as shown in FIG. 15A to prevent engagement of the spindle gear 212 and the drive gear 214 while the spindle gear 212 is rotated during combination entry. Thus, no audible information from gear collisions is provided to an unauthorized person rotating the dial 24.

Once a correct combination has been entered, the actuator 70 does not immediately rotate the output pin 76*a* out of the path of the bolt retraction gear 216. Instead, the controller waits until the spindle gear 212 has been rotated to the position shown in FIG. 15B, wherein the relief 218 on the spindle gear 212 is positioned facing towards the drive gear 214. At this position, the controller sends the signal to the actuator 70 to rotate output element 76 and pin 76*a* out of the path of bolt retraction gear 216 as previously illustrated in FIGS. 9A-9C. The bolt retraction gear 216 then rotates slightly downwards as shown in FIG. 15B, thereby rotating the drive gear 214 and moving the teeth of the first drive gear portion 214*a* into position for meshing with the spindle gear 212. As the spindle gear 212 continues to rotate with the dial 24, the first drive gear portion 214*a* is driven to the location shown in FIG. 15C, which also translates through the second drive gear portion 214*b* into downward rotation of the bolt retraction gear 216. Furthermore, the pin 216*b* forces the lock bolt 54 to retract in the position shown in FIG. 15C, thus completing the bolt retraction sequence of the lock 210.

Figure 16A:
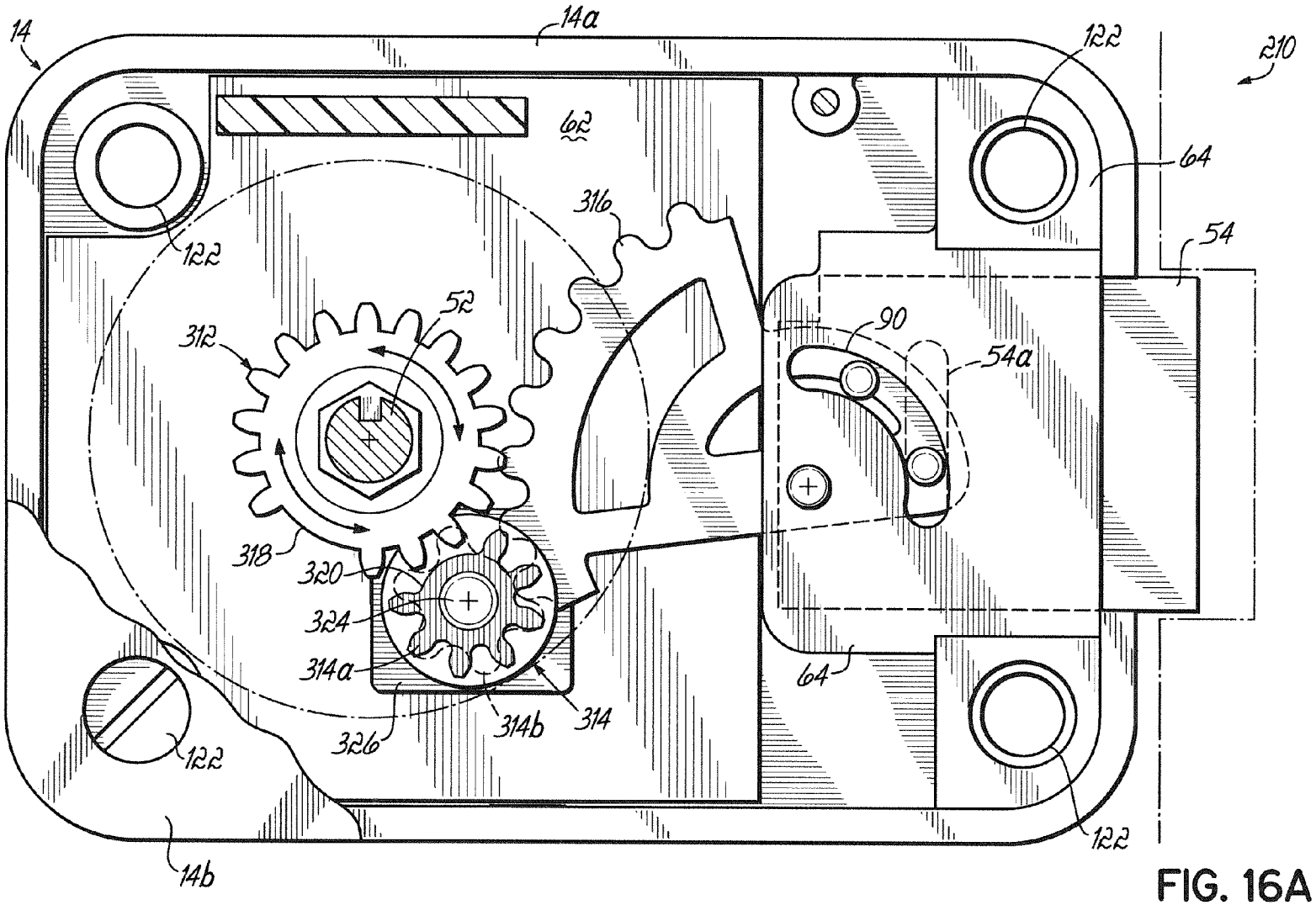
FIG. 16A is an elevational view partially broken away of an alternative embodiment of the lock, illustrating the bolt retraction hardware with the bolt in an extended or locked position.

An additional embodiment of the lock 310 is illustrated in FIGS. 16A-17C. The lock 310 is similar to the lock 210 of the previous embodiment and includes a spindle gear 312, a drive gear 314 having a first drive gear portion 314*a* adapted to engage the spindle gear 312 and a second drive gear portion 314*b*, and a bolt retraction gear 316 adapted to engage the second drive gear portion 314*b*. The spindle gear 312 and first drive gear portion 314*a* are also provided with corresponding two-tooth reliefs 318, 320 in the same manner as explained above with respect to lock 210. In this embodiment of the lock 310, the actuator 70 and associated output element 76 have been removed. The second drive gear portion 314*b* includes a two-tooth relief 322 that is adapted to prevent engagement of the bolt retraction gear 316 and the second drive gear portion 314*a* when the lock bolt 54 is fully extended as shown in FIGS. 16A and 17A. The bolt retraction gear 316 is initially positioned in a similar location as the previous embodiment, with gear teeth facing the second drive gear portion 314*b* for engagement.

Figure 16B:
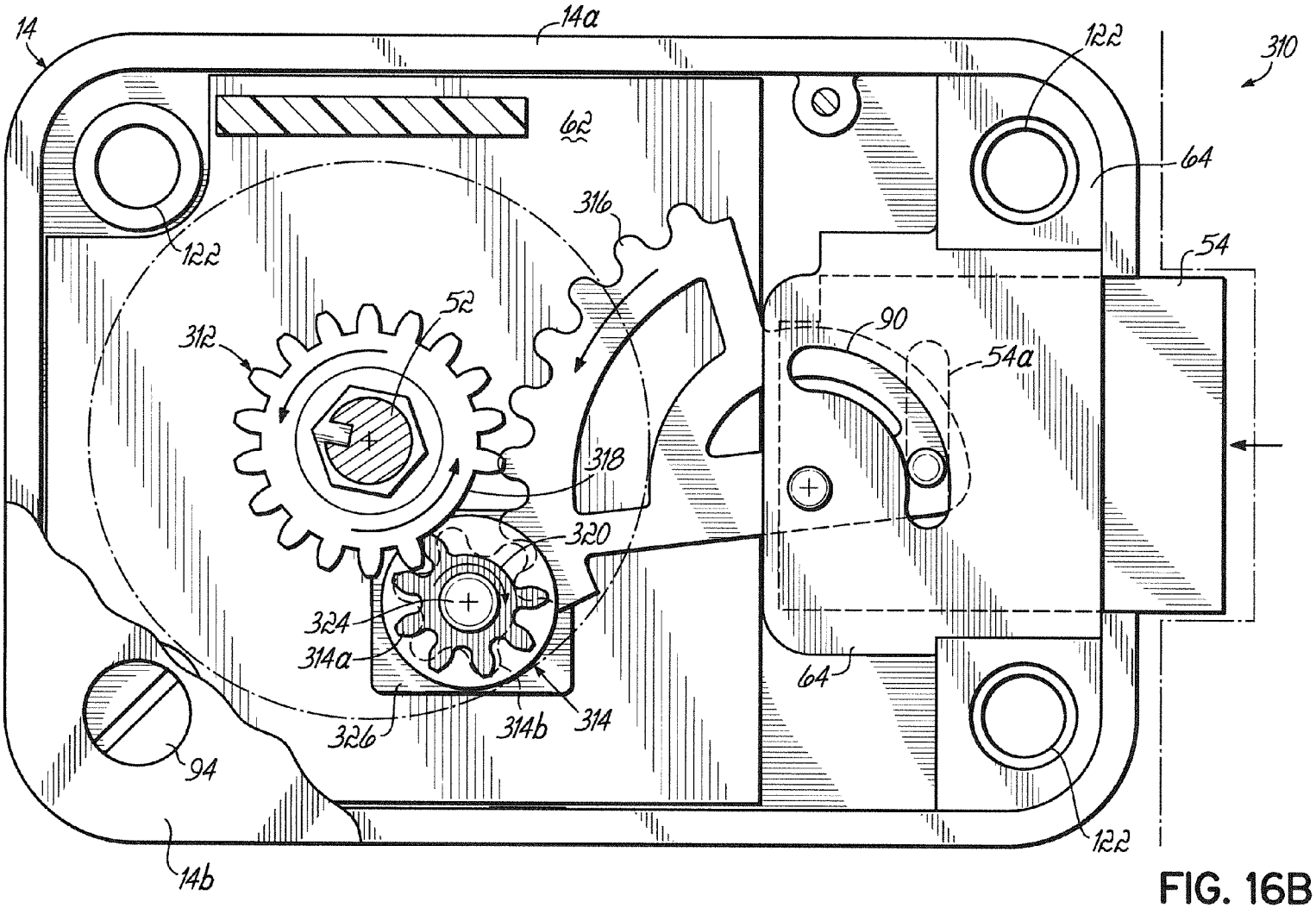
FIG. 16B is an elevational view similar to FIG. 16A, illustrating an initial portion of the bolt retraction sequence.
Figure 16C:
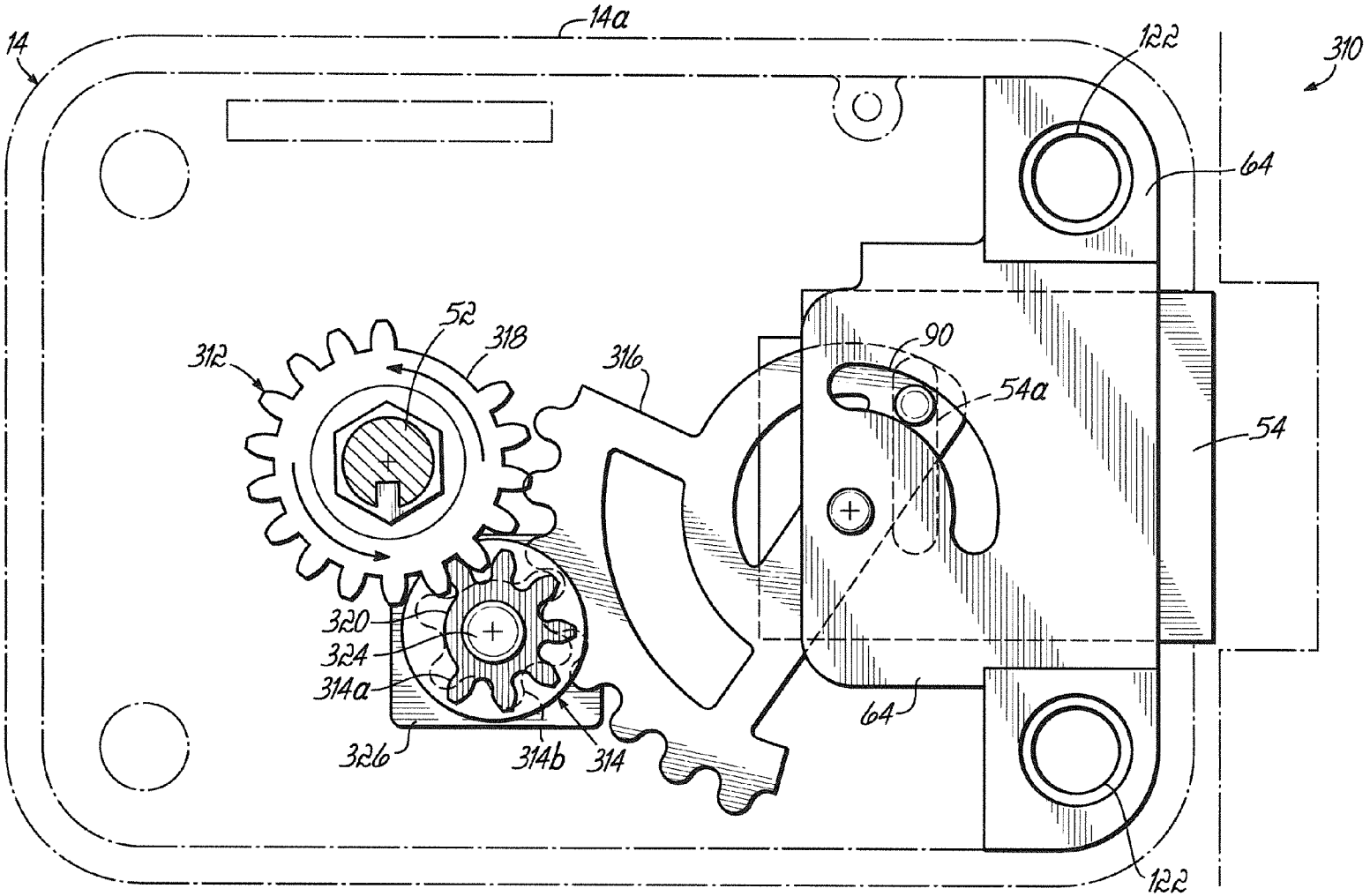
FIG. 16C is an elevational view similar to FIG. 16A, illustrating the fully retracted position of the bolt and associated bolt retraction hardware.
Figure 17A:
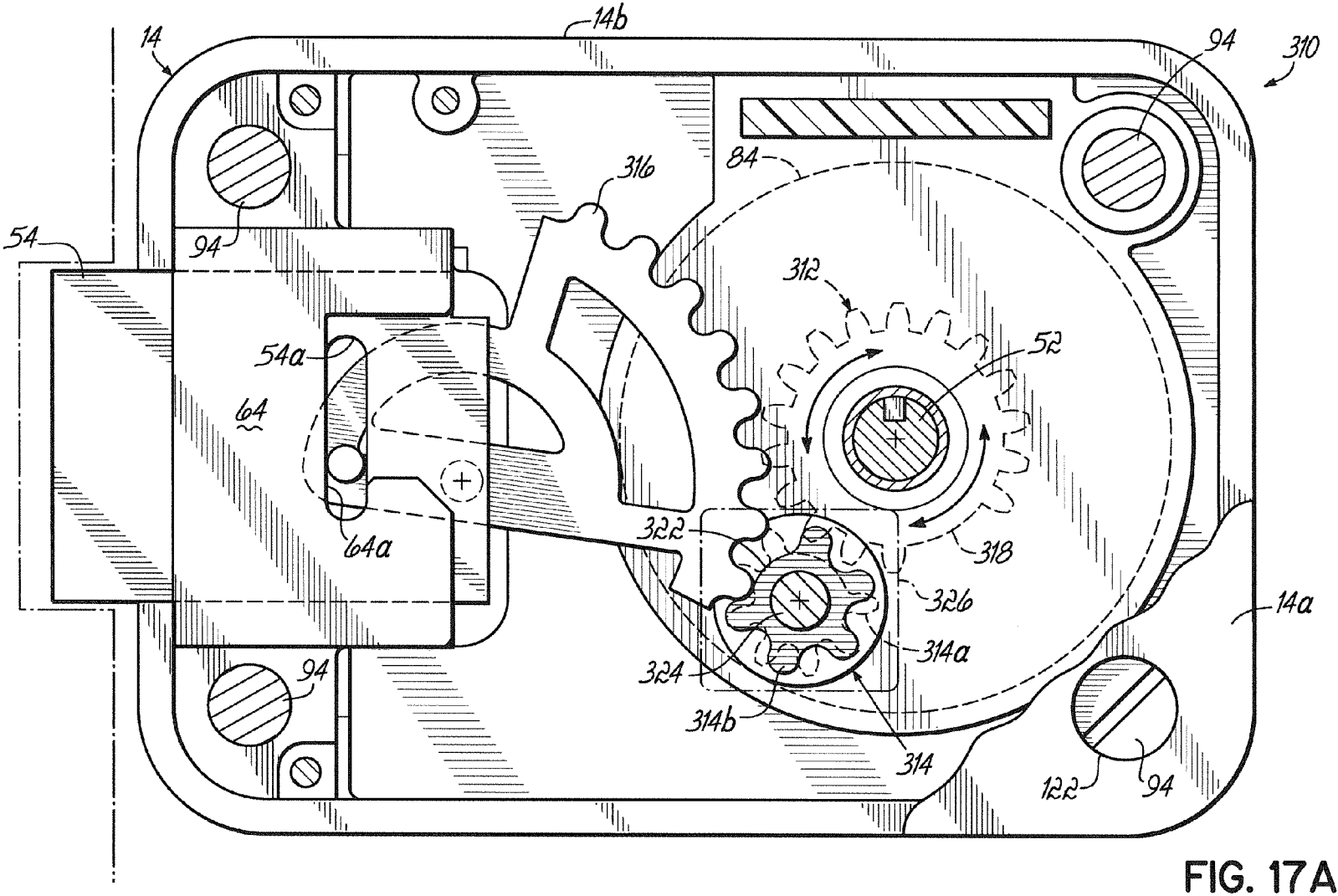
FIG. 17A is a reverse elevational view partially broken away of the lock of FIG. 16A, illustrating the bolt retraction hardware with the bolt in an extended or locked position.
Figure 17B:
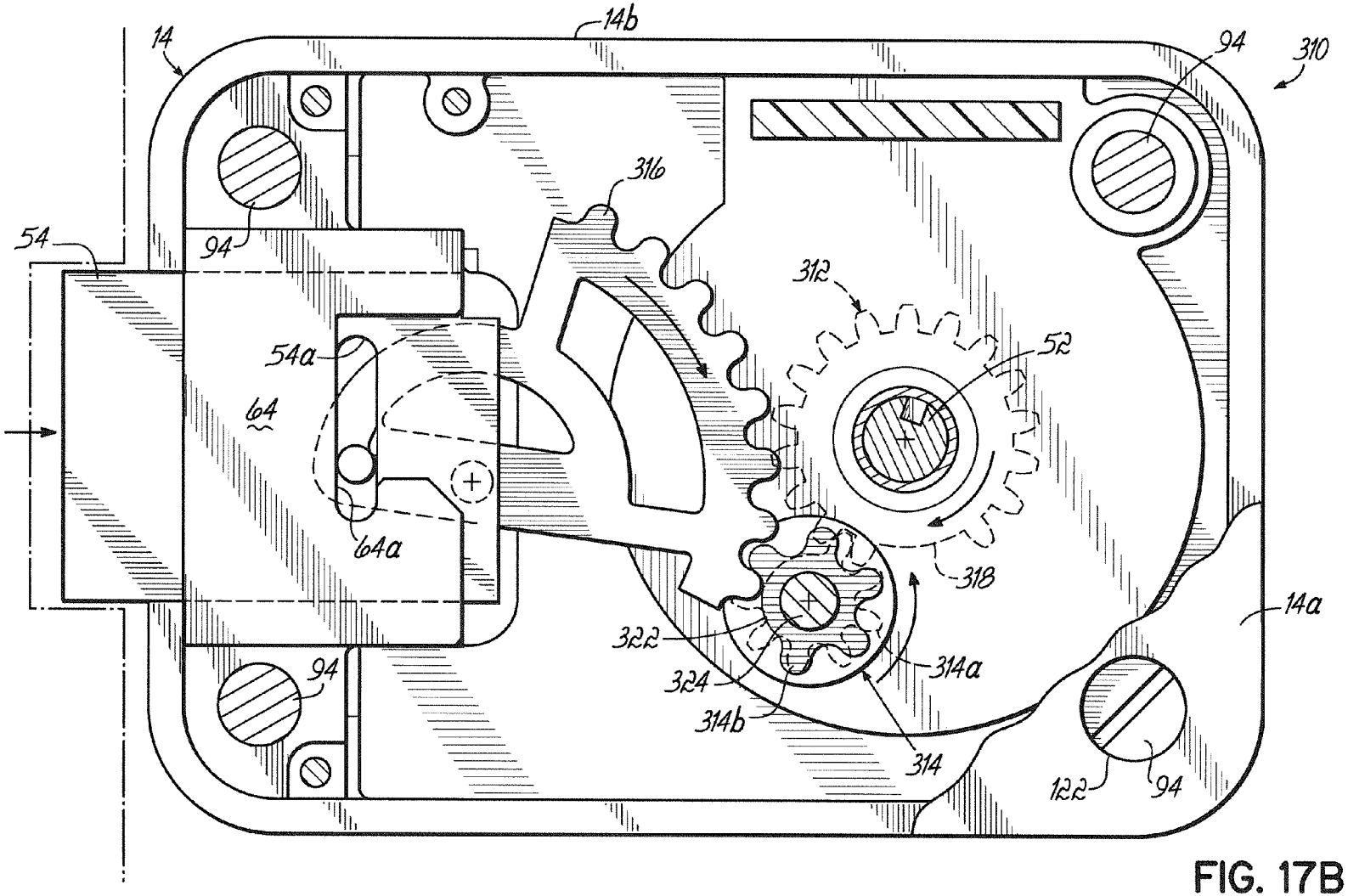
FIG. 17B is a reverse elevational view similar to FIG. 16A, illustrating an initial portion of the bolt retraction sequence.
Figure 17C:
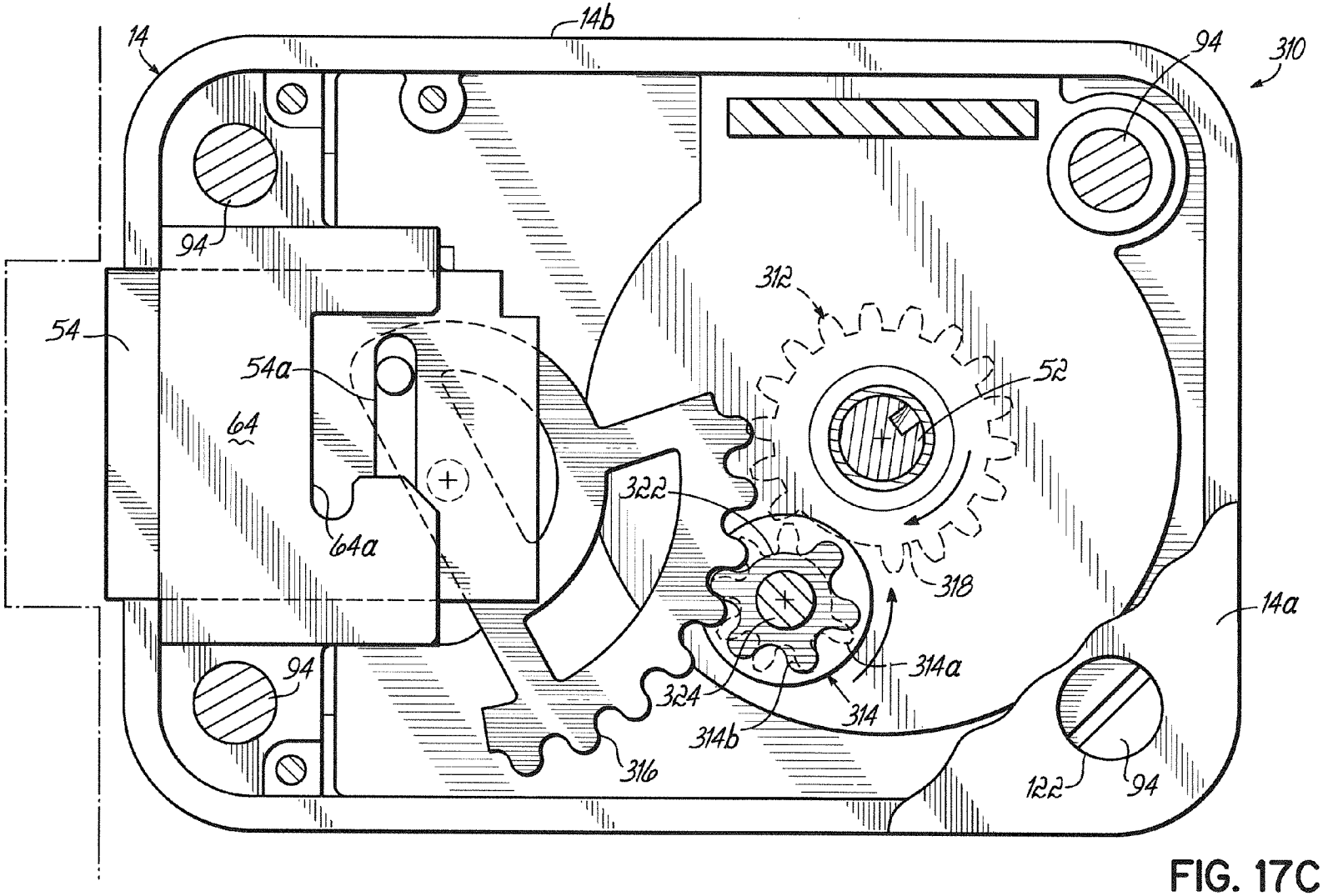
FIG. 17C is a reverse elevational view similar to FIG. 16A, illustrating the fully retracted position of the bolt and associated bolt retraction hardware.

When the lock bolt 54 is fully extended, the orientation of the reliefs 320, 322 on opposing drive gear portions 314*a*, 314*b* is set to disengage the drive gear 314 from both the spindle gear 312 and the bolt retraction gear 316. The drive gear 314 of the current embodiment is mounted on an input shaft 324, and an actuator 326 is operatively coupled to the drive gear 314 at the opposing end of the shaft 324. The actuator 326 is located proximate to the circuit board 62 and is adapted to rotate the shaft 324 and the drive gear 314. The actuator 326 is a low-powered driving device such as a geared servo motor, a non-geared servo motor, or an air core rotary solenoid. When a proper combination has been entered into the lock 310, the circuit board 62 waits until the dial 24 is rotated such that the relief 318 in the spindle gear 312 faces the first drive gear portion 314*a* as shown in FIGS. 16B and 17B. Then the circuit board 62 sends a signal to the actuator 326, causing the shaft 324 and the drive gear 314 to rotate into engagement with both the spindle gear 312 and the bolt retraction gear 316 simultaneously as shown in FIGS. 16B and 17B. As the user continues to rotate the dial 24, the spindle gear 312 drives the drive gear 314 and the bolt retraction gear 316 to the position shown in FIGS. 16C and 17C, wherein the lock bolt 54 has been fully retracted. This embodiment of the lock 310 also removes all audible noise from gear engagement or collisions during combination entry, and the actuator 326 requires as little as 10% of the operating energy as the servo motor 70 of previous embodiments. Therefore, this embodiment of the lock 310 further thwarts unauthorized entry through the door.

Figure 18:
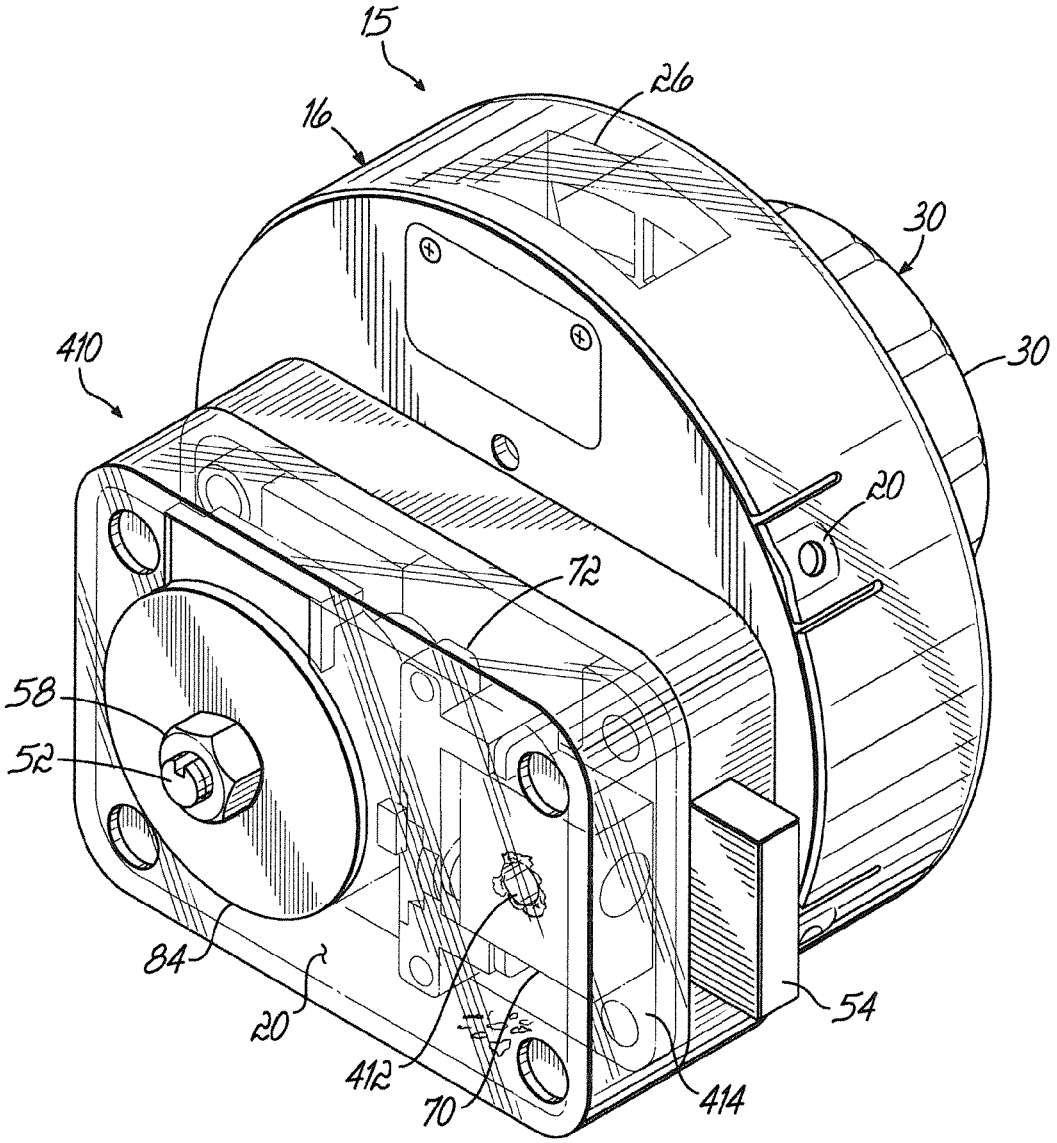
FIG. 18 is a rear perspective view of another alternative embodiment of the lock, illustrating visible damage from unauthorized tampering with the lock case.

Referring to FIG. 18, an alternative embodiment of the lock 410 is illustrated. The lock 410 includes a lock casing 414 formed of substantially translucent material such that the interior components of the lock 410 are visible from the outside of the lock casing 414. In the event of an unauthorized entry into the lock casing 414 or an attempt to break the lock 410, the translucent lock casing 414 will clearly show evidence of the attempted entry as shown in FIG. 18. A drilled hole 412 through the casing 414 is visible proximate to the lock bolt 54. Unlike an opaque lock casing, the drilled hole 412 in the translucent lock casing 414 cannot be patched or filled with material to conceal the attempted entry without detection by a person inspecting the rear side 56 of the lock casing 414. Furthermore, an inspection of the lock 410 through the translucent lock casing 414 will reveal any internal tampering or problems with the components of the lock 410. One having skill in the art will appreciate that the translucent casing 414 of the current embodiment can be used with any of the previous embodiments described to further discourage unauthorized tampering with the lock.

Figure 19A:
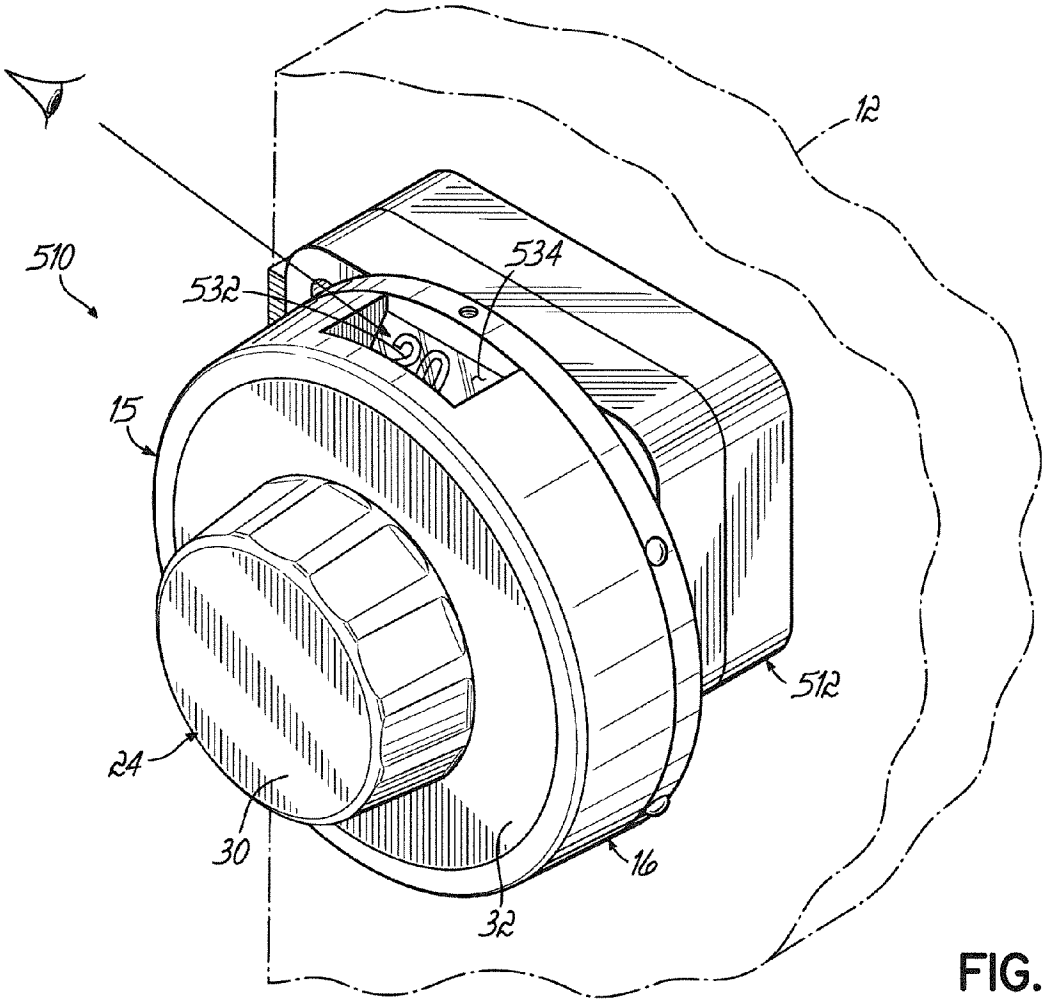
FIG. 19A is a perspective view of a high-security lock constructed in accordance with yet another alternative embodiment of the invention.
Figure 19B:
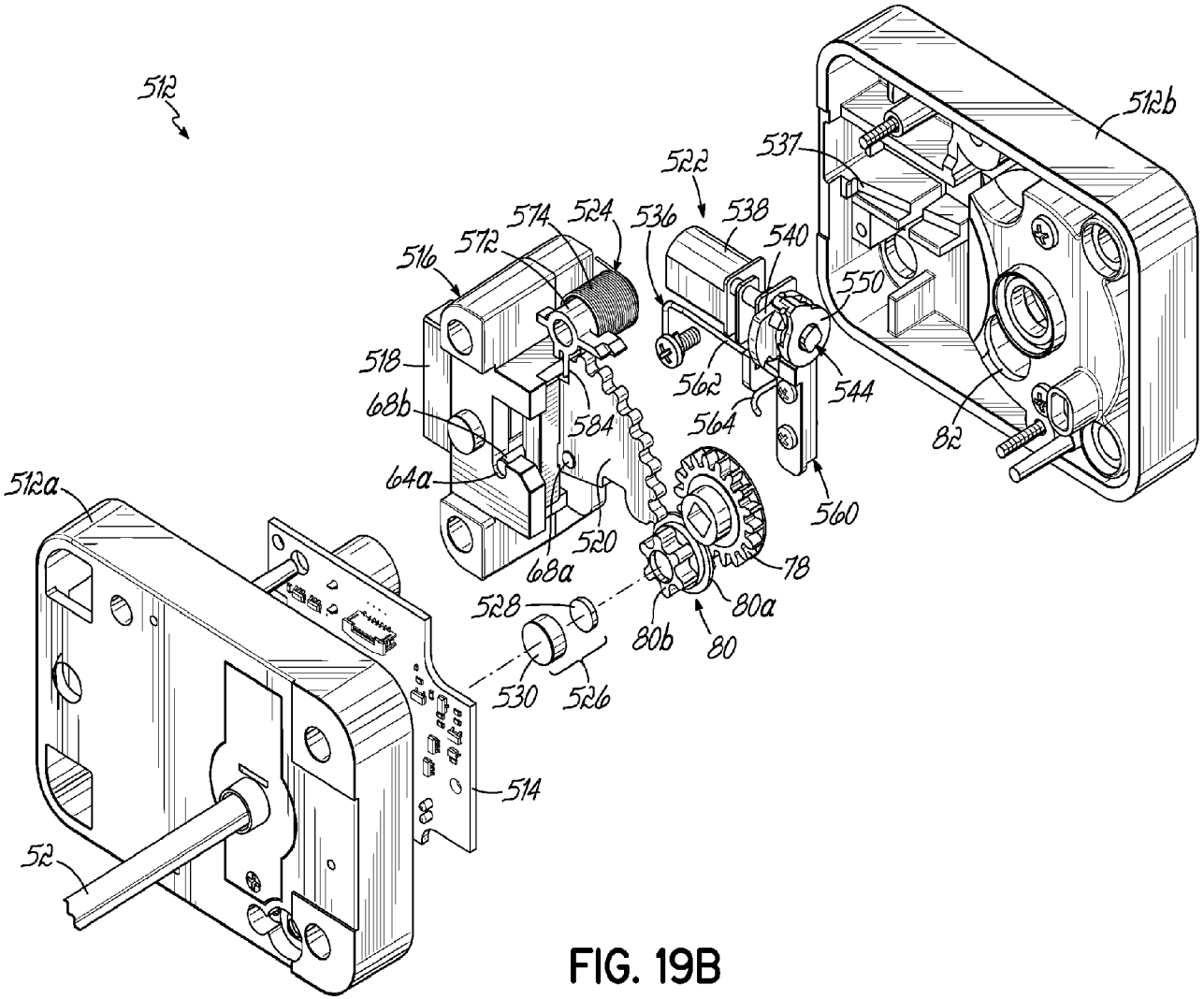
FIG. 19B is a is an exploded perspective view of the lock casing and bolt retraction hardware.

With respect to FIG. 19A and FIG. 19B, a further alternative of a lock 510 shows a lock casing 512 in exploded form to illustrate a circuit board 514 and various lock bolt retraction hardware, including a bolt guide member 516, a lock bolt 518, a bolt retraction gear 520, an actuator assembly 522, and a biasing device 524. The lock casing 512 includes a front casing half 512*a* and a rear casing half 512*b*. The front and rear casing halves 512*a*, 512*b* are mechanically fixed together as described above with mechanical elements (not shown). Additionally, the front and rear casing halves 512*a*, 512*b* are also permanently sealed together with adhesive during manufacturing of the lock 510. As such, any attempt to separate the front and rear casing halves 512*a*, 512*b* will damage at least a portion of the lock casing 512 and indicate unauthorized entry into the lock 510.

The circuit board 514 is placed on a front inner side of the front casing half 512*a*. Therefore, if a drill is used to drill into the lock casing 512, the drill bit will first contact the circuit board 514 and likely disable the lock 510, thereby making entry more difficult. The spindle gear 78 is coupled for rotation with the spindle shaft 52 and the connected lock dial 24. Accordingly, like numbers with respect to the lock 510 indicate like features described above. The spindle gear 78 meshes with a first gear portion 80*a* of a drive gear element 80. An opposite or second gear portion 80*b* of the drive gear element 80 extends through an aperture 82 in the rear casing half 512*b*, such that it may mesh with the bolt retraction gear 520 upon input of a correct combination code as shown in FIGS. 20 and 21.

The lock 510 also includes a sensor 526 configured to sense the rotation of the lock dial 24. More particularly, the sensor 526 includes an encoder 528 and a rotary sensor 530. The encoder 528 is directly mounted to the drive gear element 80, which is manually and mechanically driven by the lock dial 24. The rotary sensor 530 is electrically connected to suitable controller circuitry on the circuit board 514. The rotary sensor 530 is positioned adjacent to the encoder 528, which is a magnet. Because the rotary sensor 530 is close enough to the encoder 528 to sense the magnetic field of the magnet, the rotary sensor 530 detects the rotation of the drive gear element 80. In this respect, the position of the drive gear element 80 may directly or indirectly correlate to the position of the lock dial 24. The exemplary embodiment of the circuit board 514 operates an algorithm based on the rotation of the drive gear element 80 for converting the rotation of the lock dial 24 to user input information. Furthermore, a display 532 visualizes the user input information converted from the rotation of the lock dial 24 via the algorithm. The display 532 is an LED display recessed within the lock 510 to limit the viewing angle of the visualized user input information. The display 532 also includes a filtering device 534 covering at least a portion of the display 532 for further prevention of viewing the user input information from a plurality of viewing angles.

According to an exemplary embodiment, the algorithm converts the rate of rotation of the lock dial 24 into the user input information visualized on the display 532. Accordingly, the user input information is separable and generally random from the rotational position of the lock dial 24 for further inhibiting unauthorized access with the lock 510. While the exemplary embodiment of the algorithm converts the rate of lock dial 24 rotation to the user input information, it will be appreciated that other properties of movement of the lock dial 24 may be used singularly or in combination with each other for use in the algorithm. For example, such properties may include, but are not necessarily limited to position, direction, speed, acceleration, and/or time of rotation of the lock dial 24.

Figure 20:
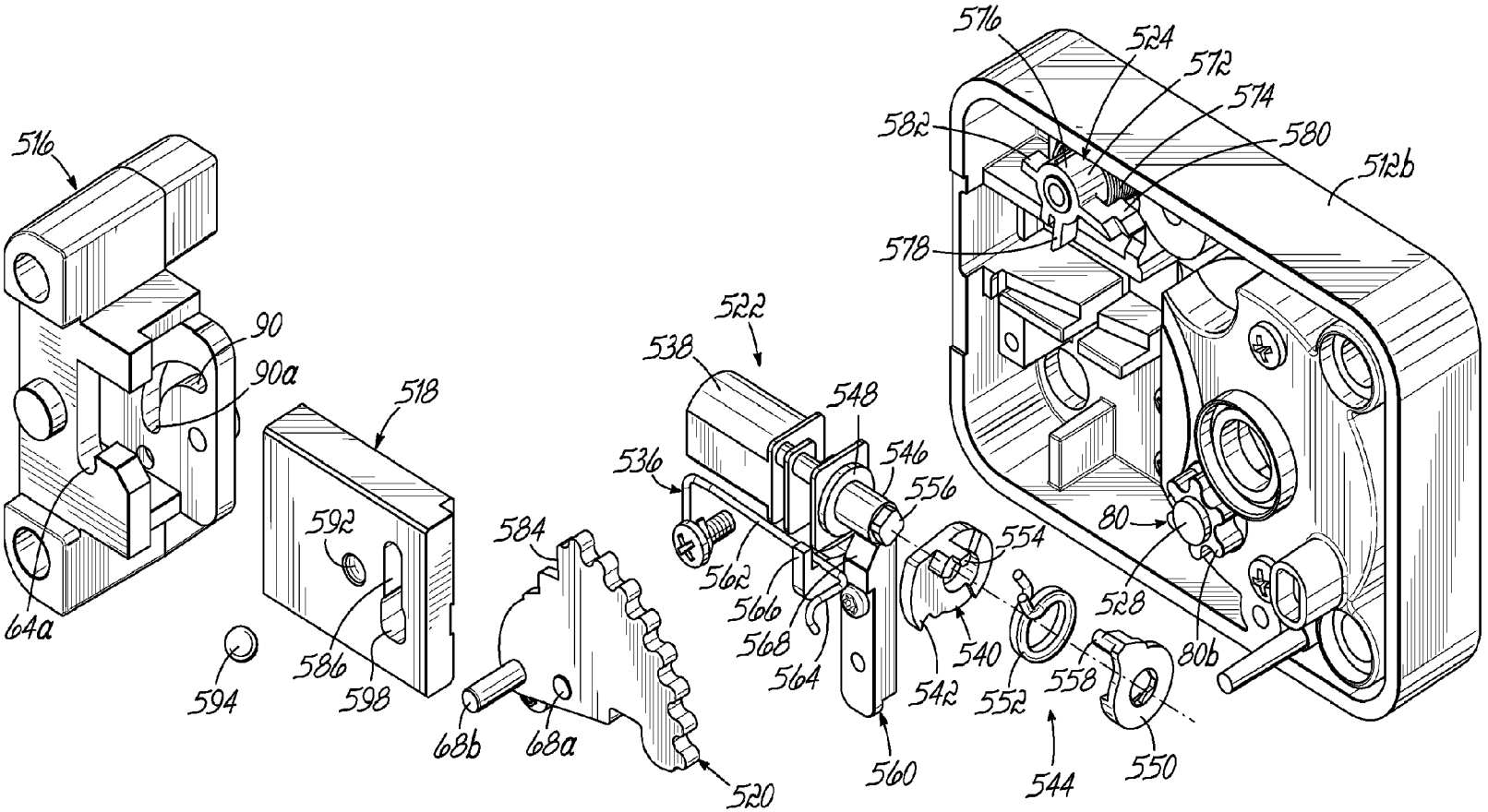
FIG. 20 is a is exploded perspective view of a portion of the lock casing and bolt retraction hardware.
Figure 21:
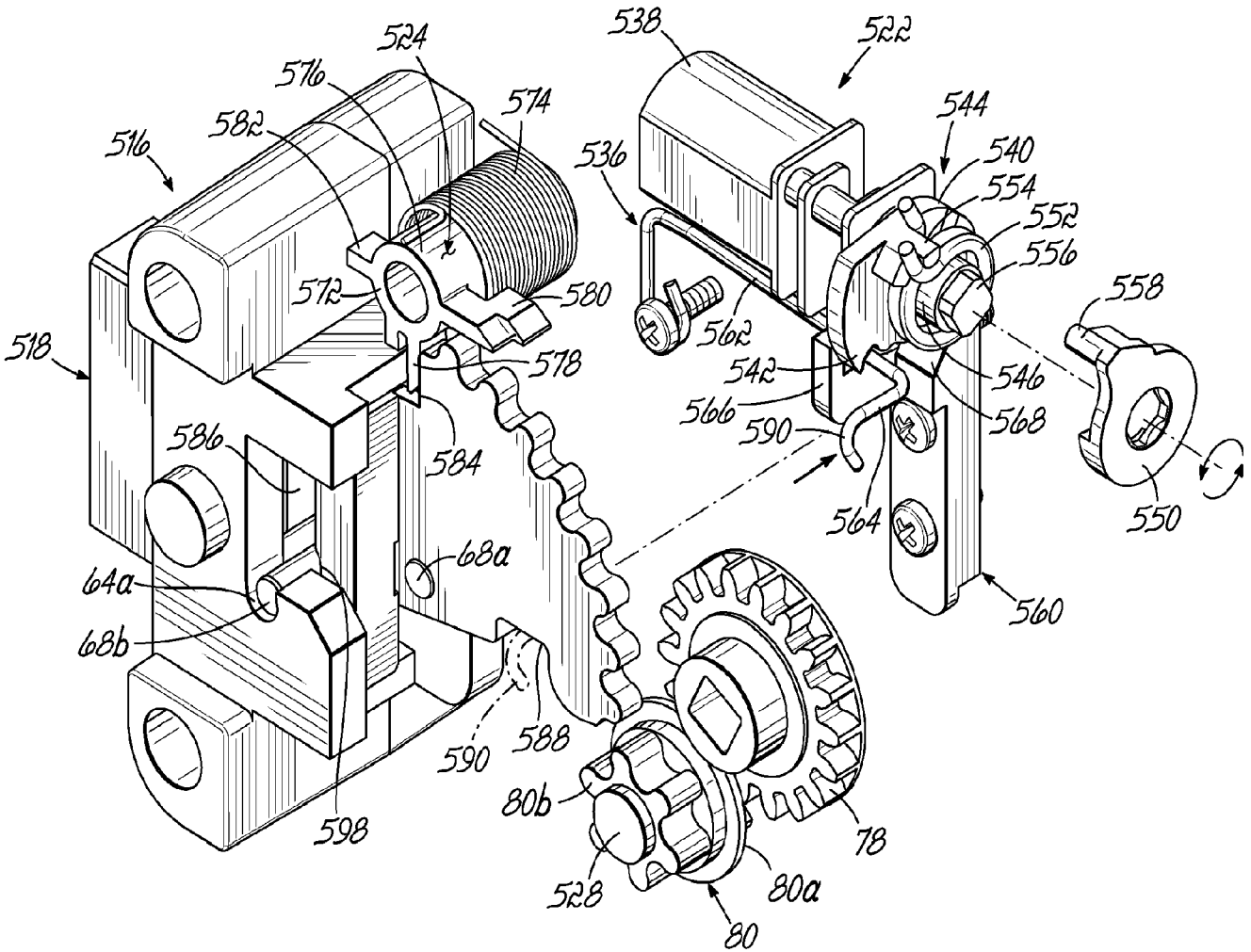
FIG. 21 is a is a perspective view, partially exploded of the bolt retraction assembly.

Turning to FIGS. 20 and 21, taken in conjunction with FIGS. 22A-22C and 23A-24C, the bolt retraction sequence will now be discussed. Upon entry of the correct combination code as recognized by the controller circuitry visualized on the display 532, the actuator assembly 522 will be activated for enabling movement of the bolt retraction gear 520, which is biased toward the drive gear element 80. The actuator assembly 522 includes a guide element 536. The guide element 536 is operatively movable between a capturing position and a non-capturing position. In the capturing position, the guide element 536 inhibits the movement of the bolt retraction gear 520, but, in the non-capturing position, the guide element 536 releases the movement of the bolt retraction gear 520. Furthermore, the rear casing half 512*b* also includes a guide recess 537 adapted to receive the guide element 536 while moving to the non-capturing position.

Figure 22A:
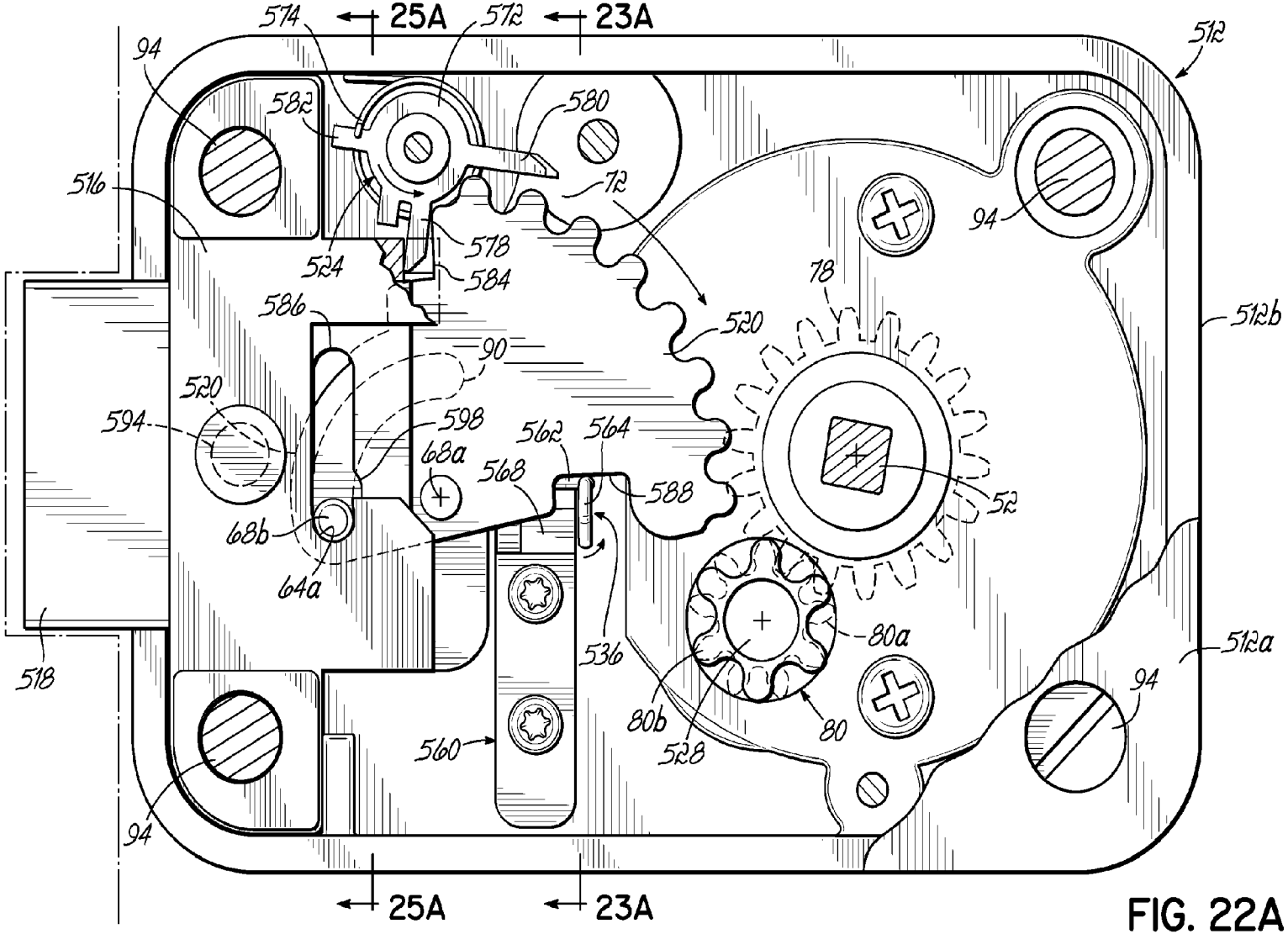
FIG. 22A is an elevational view partially broken away illustrating the bolt retraction hardware with the bolt in an extended or locked position.
Figure 22B:
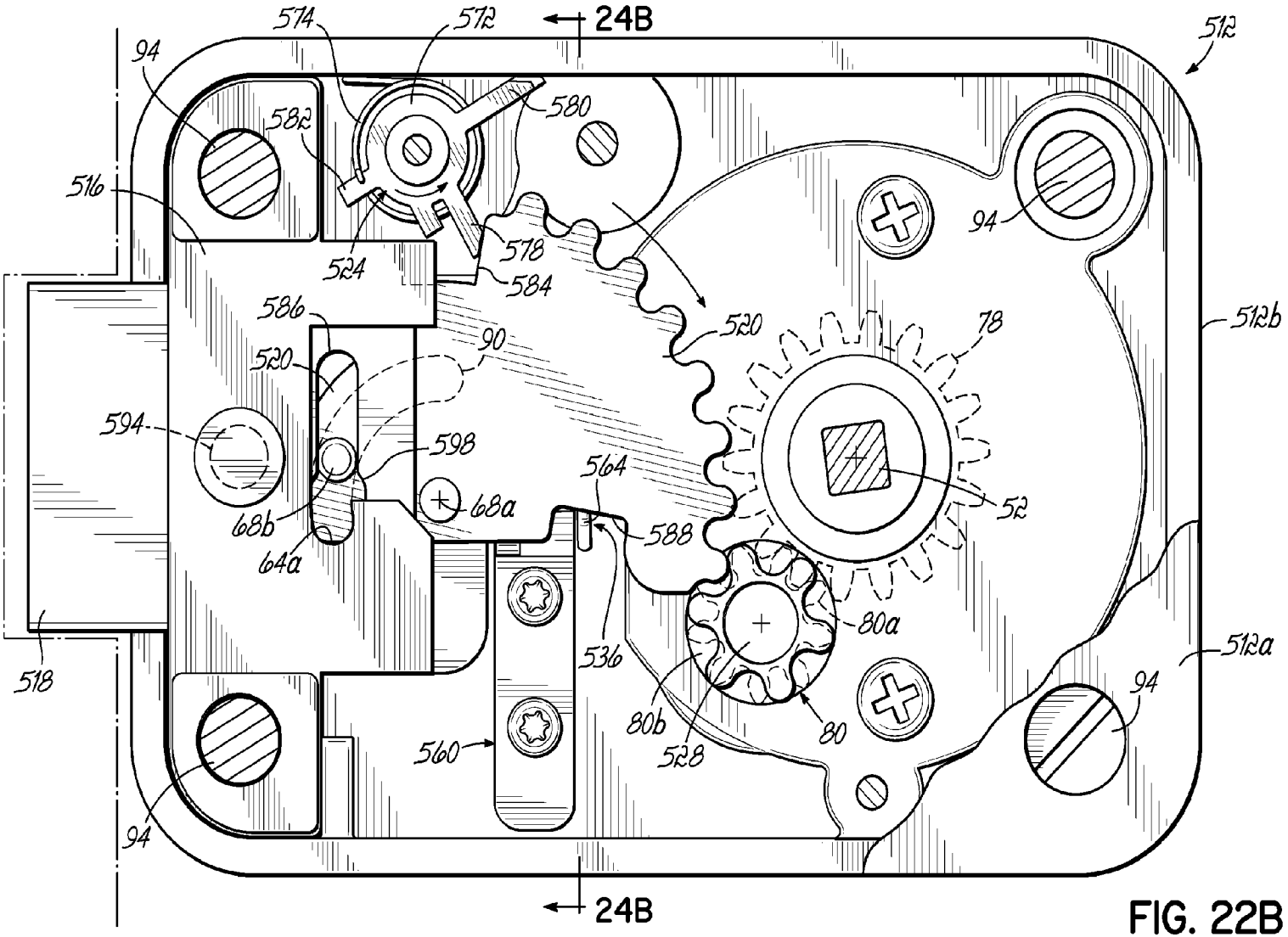
FIG. 22B is an elevational view similar to FIG. 8A, illustrating an initial portion of the bolt retraction sequence.
Figure 22C:
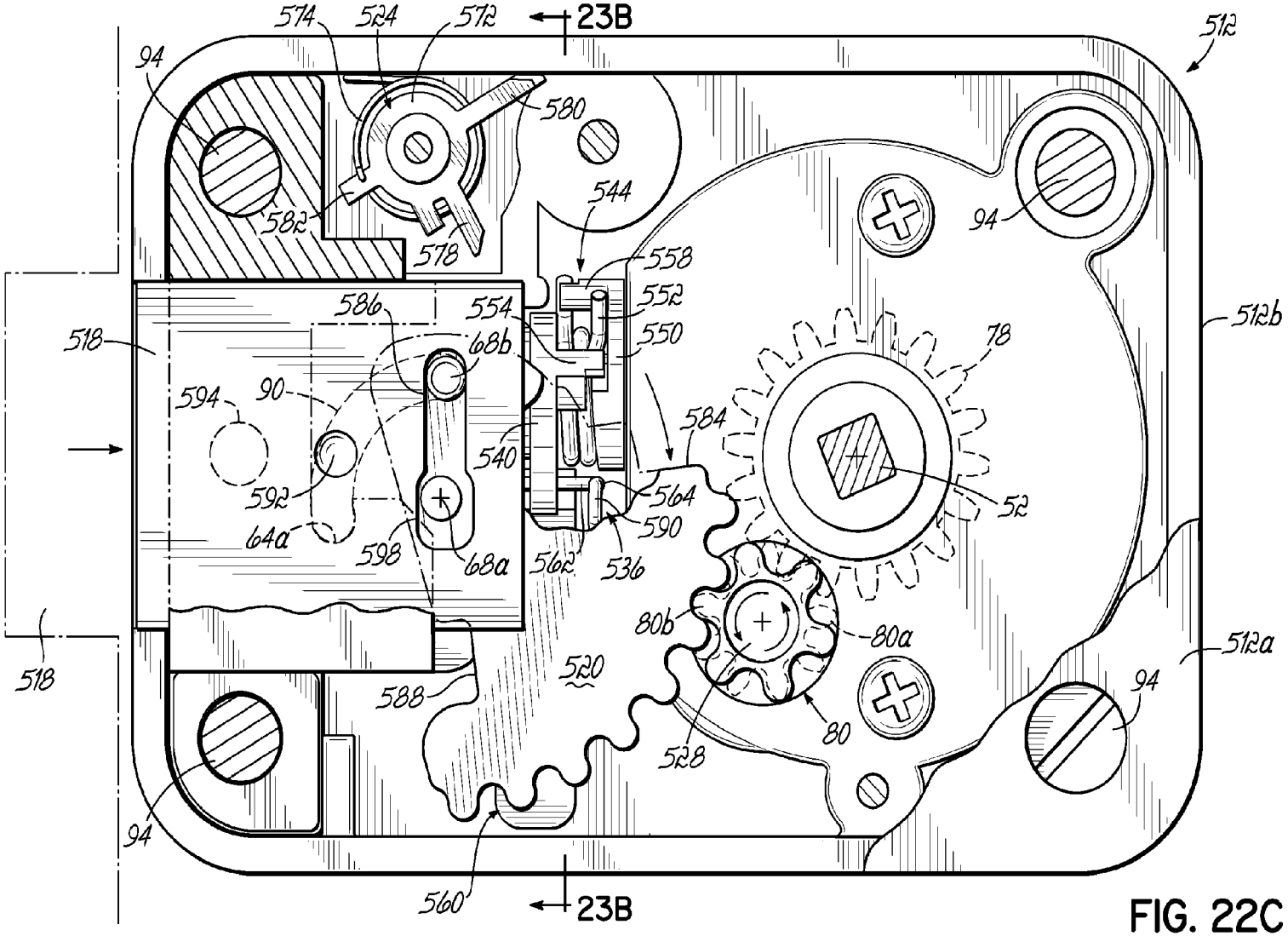
FIG. 22C is an elevational view similar to FIG. 8B, illustrating the fully retracted position of the bolt and associated bolt retraction hardware.

The bolt retraction gear 520 is slightly spring-loaded with the biasing device 524 such that the bolt retraction gear 520 is biased in the clockwise direction to the position shown in FIG. 22B upon activation of the actuator assembly 522. Once the gears 520, 80*b* are engaged as shown in FIG. 22B, the lock dial 24 may be manually rotated such that the drive gear element 80 is rotated through engagement of the first drive gear portion 80*a* with the spindle gear 78 (see FIG. 19).

The actuator assembly 522 also includes an actuator 538 operatively connected to a rotatable cam 540 for moving the guide element 536 as shown in FIGS. 20 and 21. The cam 540 includes a projection 542 that, in a first position, is adjacent to the guide element 536. However, as the cam 540 rotates to a second position, the projection 542 engages the guide element 536 and moves the guide element 536 from the capturing position to the non-capturing position. Normally the guide element 536 would prevent rotation of the bolt retraction gear 520, as shown in FIG. 22A, for example. However, when the projection 542 of the cam 540 rotates and moves the guide element 536 toward the rear casing half 512*b* and slightly downward, as viewed in FIGS. 23A-23B, this allows the bolt retraction gear 520 to move or rotate clockwise as viewed in FIGS. 22A-22C, such that it may engage with the second portion 80*b* of the drive gear element 80.

The actuator assembly 522 also includes a clutch mechanism 544 for rotatably and resiliently coupling the cam 540 operatively to the actuator 538, as seen in FIG. 20 and FIG. 21. The clutch mechanism 544 includes a hub 546 having a proximal wall 548 coupled to the actuator 538. According to the exemplary embodiment, the actuator 538 is an electric motor. The clutch mechanism 544 also includes a pivot stop 550 and a clutch torsion spring 552 for transferring the rotation of the hub 546 to the cam 540. Specifically, the cam 540 is positioned on the hub 546 against the proximal wall 548. Similarly, the clutch torsion spring 552 is also positioned on the hub 546 and engages a cam arm 554 of the cam 540. In this respect, the cam 540 and the clutch torsion spring 552 would rotate freely together on the hub 546, except that the clutch torsion spring 552 also engages a pivot arm 558 of the pivot stop 550. The pivot stop 550 is rigidly affixed at a distal end 556 of the hub 546 such that the pivot arm 558 engages the clutch torsion spring 552 as the hub 546 is rotatably driven by the actuator 538. In turn, the clutch torsion spring 552 rotatably engages the cam arm 554 to resiliently rotate the cam 540.

Furthermore, the guide element 536 is resiliently mounted to the rear casing half 512*b* in the capturing position adjacent to the cam 540 and adjacent to a platform 560. The guide element 536 includes a lateral portion 562 extending to a transverse portion 564 that forms generally a right angle along the guide element 536. More particularly, the guide element 536 is a wire guide bent at the generally right angle to form the lateral and transverse portion 562, 564.

Figure 23A:
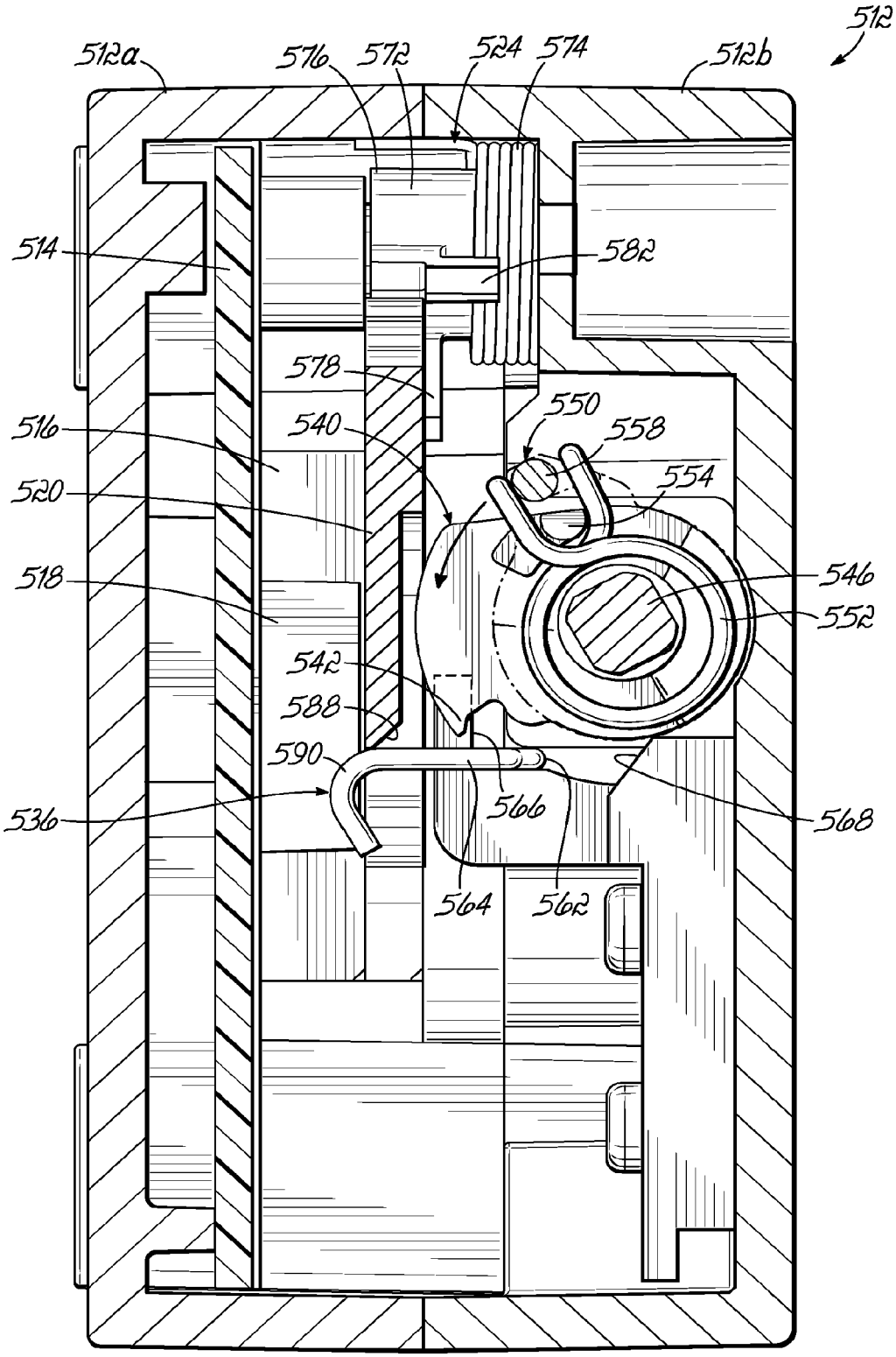
FIG. 23A is a cross-sectional view taken along the line 23A-23A of FIG. 22A.
Figure 23B:
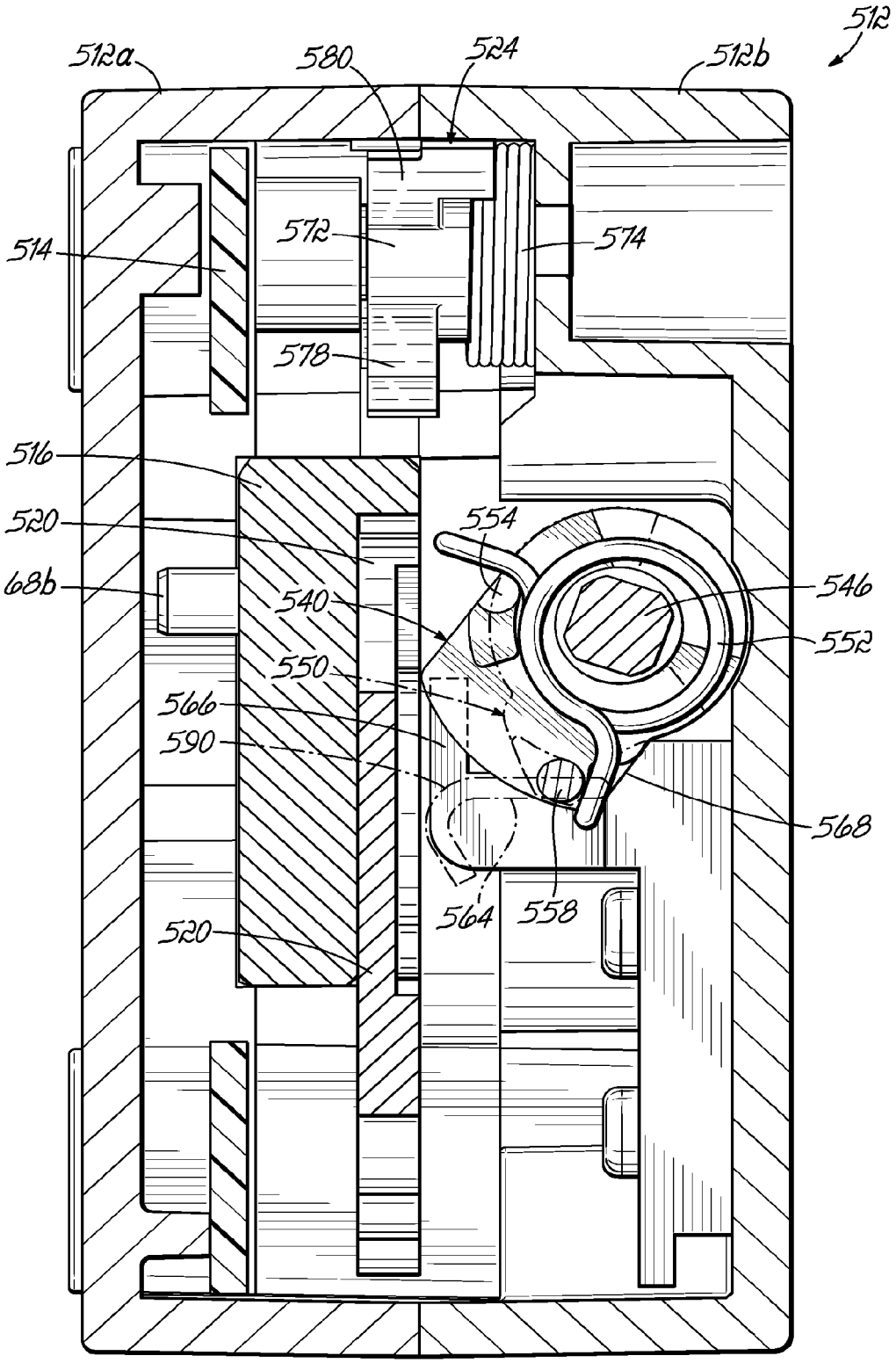
FIG. 23B is a cross-sectional view taken along the line 23B-23B of FIG. 22C.

The lateral portion 562 is generally resilient for moving the transverse portion 564 between the capturing and non-capturing positions. The lateral portion 562 rests generally between a catch member 566 and a guide stop 568 of the platform 560. With respect to the capturing position, FIG. 20 and FIG. 23A show the lateral portion 562 adjacent to the catch member 566 so that the transverse portion 564 extends to and against the bolt retraction gear 520 in order to inhibit the movement thereof. In contrast, FIG. 23 shows the guide element 536 in the non-capturing position. The projection 542 of the cam 540 moves the lateral portion 562 toward the rear casing half 512*b* and away from the bolt retraction gear 520 until the lateral portion 562 contacts the guide stop 568. Notably, the cam 540 and the guide element 536 seize against the guide stop 568, while the pivot stop 550 may continue rotating and winding the clutch torsion spring 552. According to an exemplary embodiment, the actuator 538 is configured to operatively rotate the hub 546 and pivot stop 550 a predetermined period of time. More particularly, the actuator 538 rotates the hub 546 and pivot stop 550 for more time than necessary to move the guide element 536 to seizure against the guide stop 568. Thus, the pivot stop 550 continues to rotate the clutch torsion spring 552 against the stationary cam 540, causing the clutch torsion spring 552 to wind tighter therebetween.

As described briefly above and shown in FIGS. 19A-21, the bolt retraction gear 520 is biased toward the drive gear element 80 by the biasing device 524. The biasing device 524 generally includes a hollowed drum body 572 rotatably mounted to the rear casing half 512*b* and a kicker torsion spring 574 positioned about the drum body 572. In addition, a front portion 576 of the drum body 572 includes a gear advance lever 578, a stop lever 580, and a kicker arm 582. The kicker torsion spring 574 winds against the stop lever 580 and the rear casing half 512*b* for rotatably biasing the drum body 572. The gear advance lever 578 extends to and engages a notch portion 584 of the bolt retraction gear 520. As such, when the bolt retraction gear 520 is in the disengagement position, the bolt retraction gear 520 forces against the gear advance lever 578 and winds the kicker torsion spring 574 tighter as shown in FIG. 22A. In contrast, FIG. 22B shows that as the guide element 536 moves toward the non-capturing position, the gear advance lever 578 directs the bolt retraction gear 520 into the engagement position with the drive gear element 80. Finally, the stop lever 580 engages the rear casing half 512*b* for halting the rotation of the drum body 572 at a position for re-engaging the bolt retraction gear 520 while moving from the engagement position to the disengagement position.

When the bolt retraction gear 520 is engaged with the drive gear portion 80*b* as shown in FIG. 22B, the bolt retraction gear 520 will rotate about its pivot axis 68*a*, and a pin 68*b* secured to the bolt retraction gear 520 will rise out of a position seated in a recess 64*a* of the bolt guide member 516 and the end 90*a* of a curved slot or pin guide 90 of the bolt guide member 516 (FIG. 19). The pin 68*b* also extends through a slot 586 in the lock bolt 518, and as the bolt retraction gear 520 rotates, the pin 68*b* rides upwardly in the slot 586 as viewed in FIGS. 22B and 22C and simultaneously moves the lock bolt 518 into the lock casing 512 and through the bolt guide member 516. Rotating the dial 24, shaft 52, and gears 78, 80, 520 in the opposite direction will extend the lock bolt 518 back to its fully-extended position and the bolt retraction gear 520 will be returned to the initial position shown in FIG. 22A by the transverse portion 564 of the guide element 536.

Figure 24A:
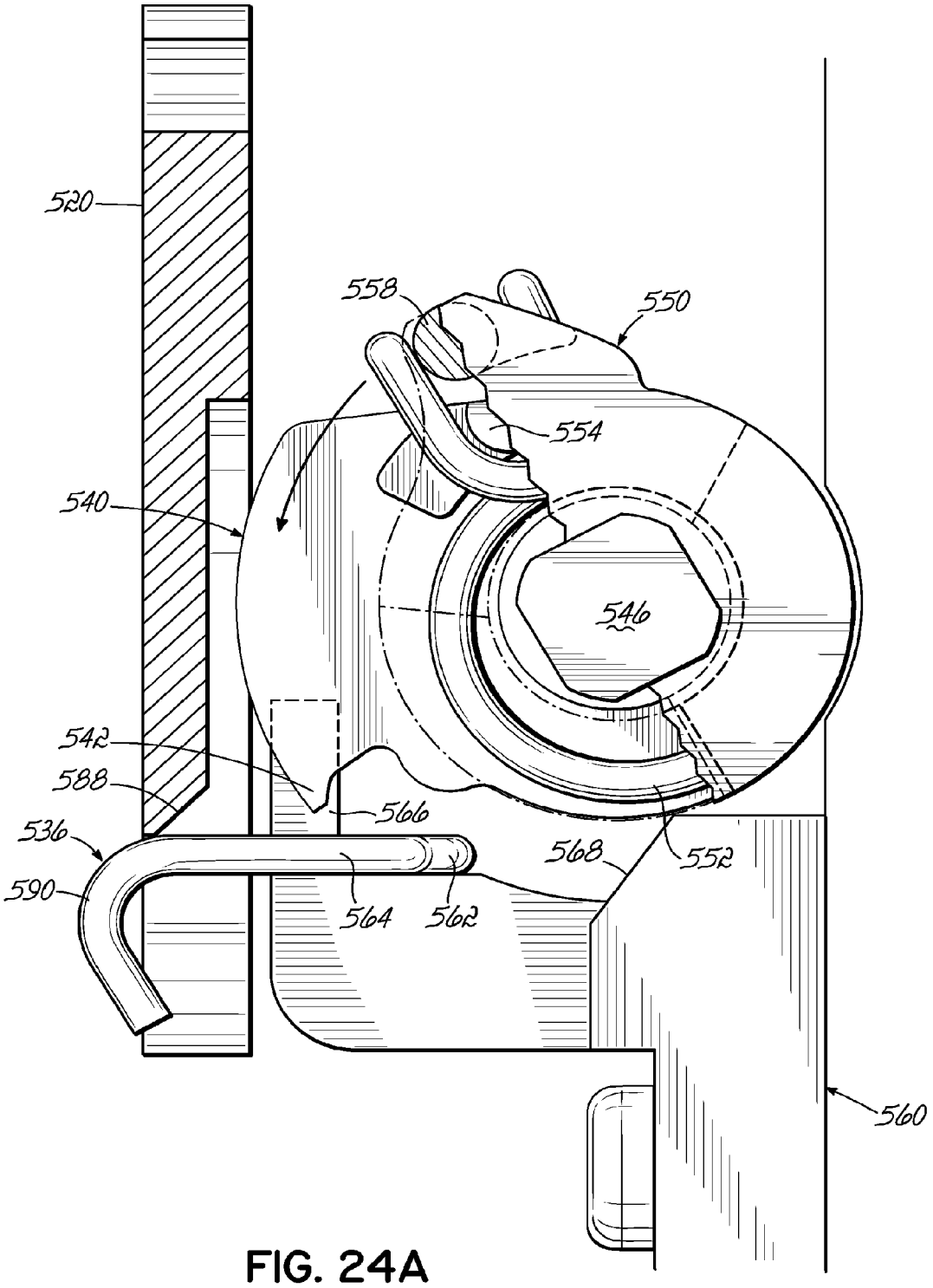
FIG. 24A is an enlarged view showing a portion of FIG. 23A.
Figure 24B:
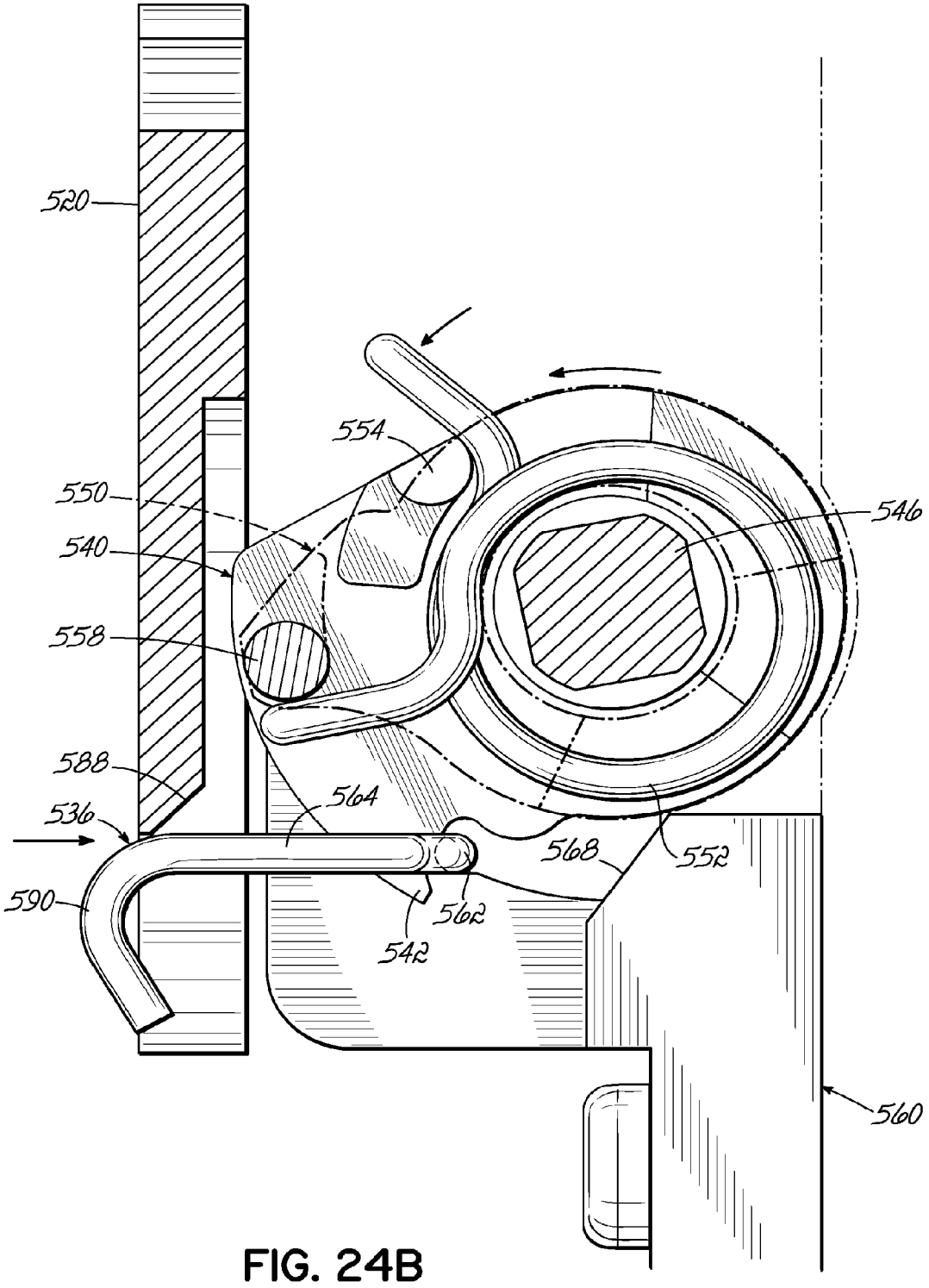
FIG. 24B is an enlarged cross-sectional view taken generally along the line 24B-24B of FIG. 22B.
Figure 24C:
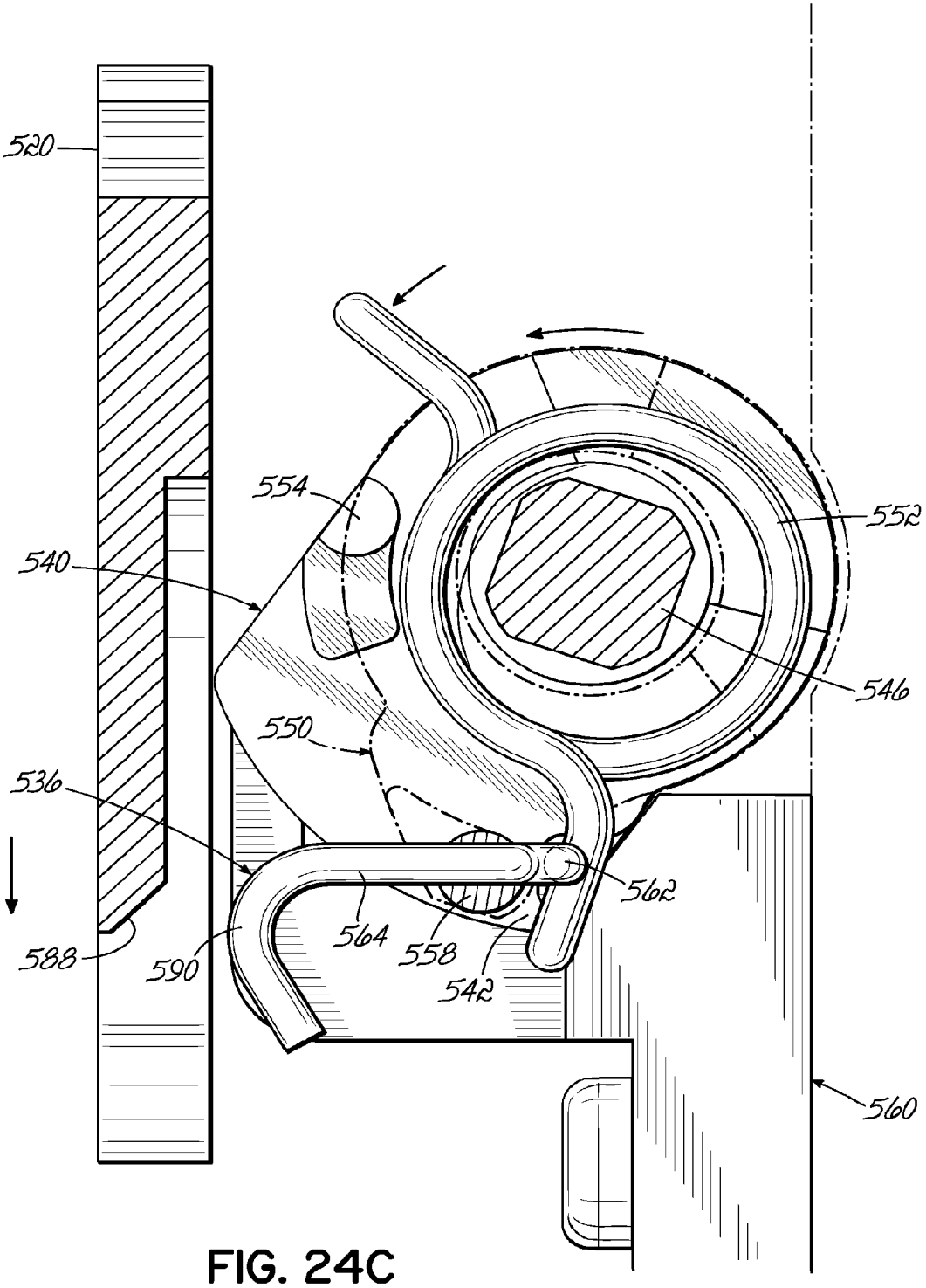
FIG. 24C is an enlarged view showing a portion of FIG. 23B.

FIGS. 24A-24C show the bolt retraction gear 520 moving respectively from the disengaged position to the engaged position as described above. In this regard, the pivot arm 558 clears the cam arm 554 to rotate the clutch torsion spring 552 and, in turn, rotate the projection 542 of the cam 540 into the guide element 536. The bolt retraction gear 520 also includes a beveled edge 588 that cooperates with a curved end portion 590 of the transverse portion 564. While the curved end portion 590 moves from the capturing position to the non-capturing position, the transverse portion 564 effectively releases the biased movement of the bolt retraction gear 520 as the beveled edge 588 falls off of the curved end portion 590. However, to return the guide element 536 from the non-capturing position to the capturing position, the curved end portion 590 moves to the beveled edge 588. Once reaching the beveled edge 588, the curved end portion 590 engages the beveled edge 588 to direct the bolt retraction gear 520 to the disengagement position. Thus, the guide element 536 will overcome the biasing force of the biasing device 524 on the bolt retraction gear 520 to return the bolt retraction gear 520 to the initial position shown in FIG. 22A.

Figure 25A:
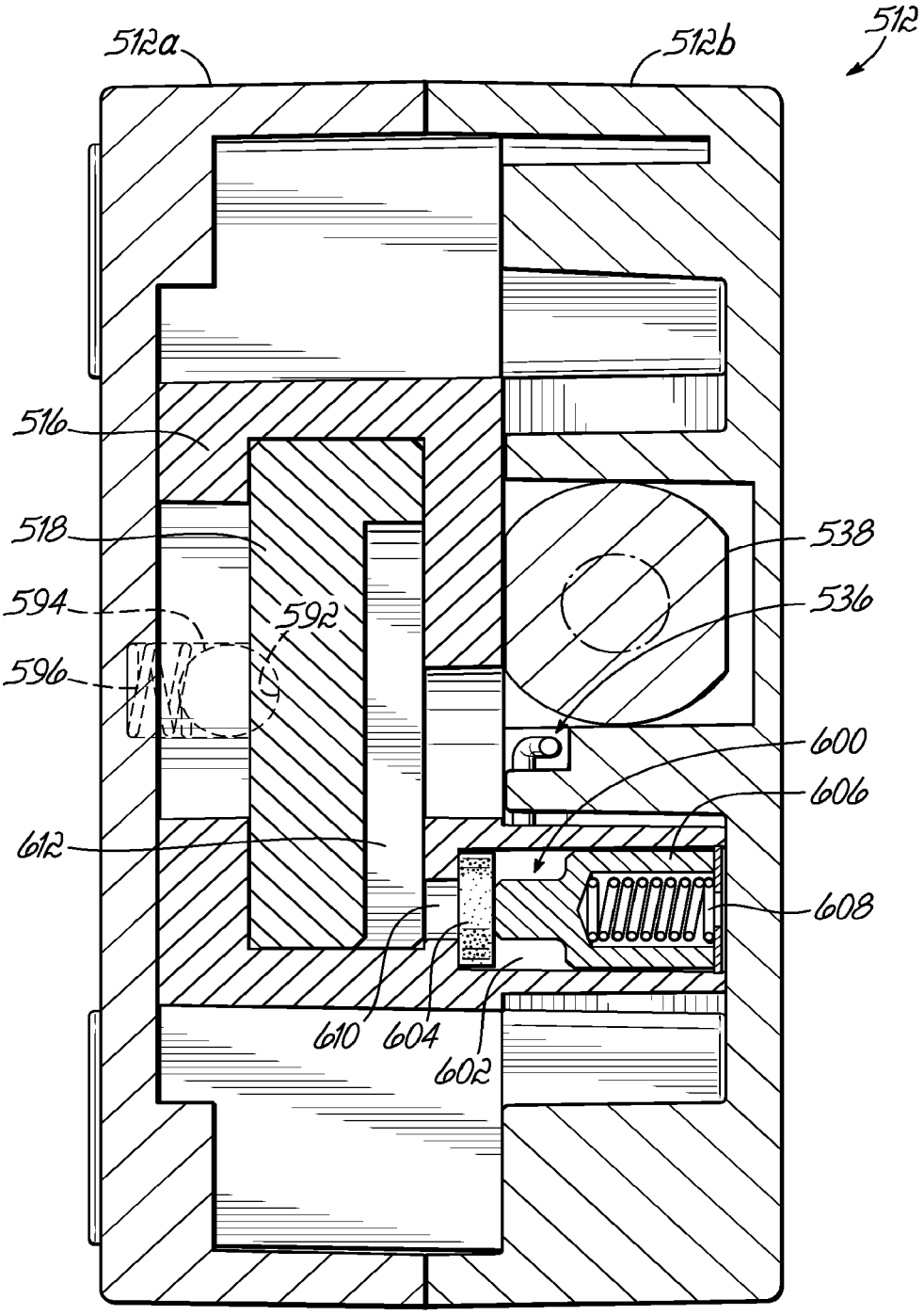
FIG. 25A is a cross-sectional view taken along the line 25A-25A of FIG. 22A illustrating a thermal relocker in an operational position.
Figure 25B:
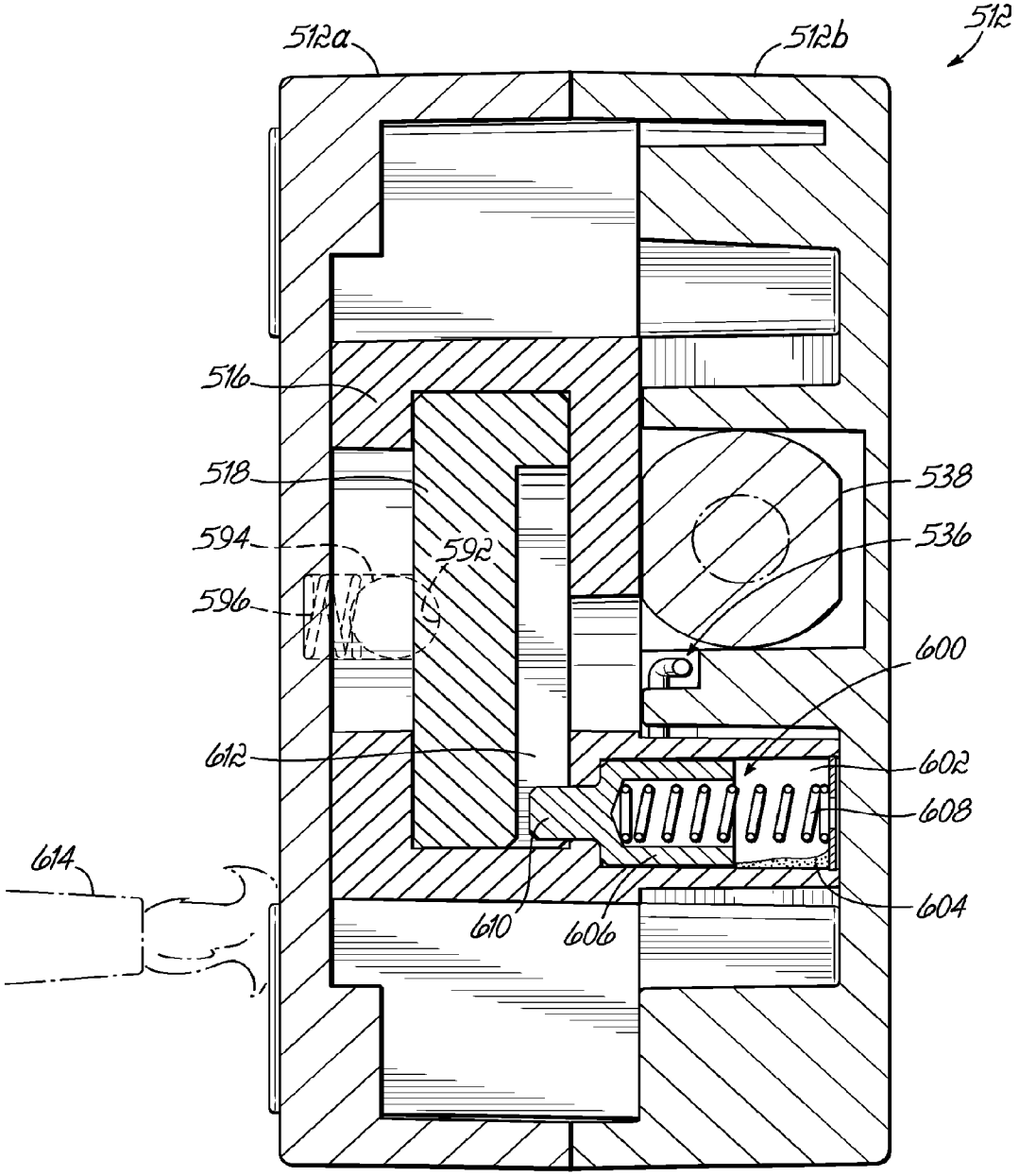
FIG. 25B is a cross-sectional view similar to FIG. 25A illustrating the thermal relocker in a tampered position.

The lock bolt 518 includes an indentation 592 that cooperates with a detent ball 594 for positively registering the lock bolt 518 in the extended position as shown in FIG. 20 and FIGS. 25A-25B. Specifically, a ball spring 596 resiliently supports the detent ball 594 within the bolt guide member 516 and against the lock bolt 518. The indentation 592 is positioned on the lock bolt 518 so that when the lock bolt 518 is in the extended position, the biased detent ball 594 lightly engages the indentation 592. Finally, the slot 586 in the lock bolt 518 has a wider portion 598 so that the detent ball 594 effectively centers in the indentation 592 and encourages final advancement of the lock bolt 518 to the extended position. In this respect, the ball spring 596, the detent ball 594, and the indentation 592 are each selected to have a nominal holding force on the lock bolt 518 in the extended position.

FIGS. 25A-25B show a thermal relocker 600 positioned within a cavity 602 of the bolt guide member 516 for preventing movement of the lock bolt 518 to the retraction position. The thermal relocker 600 includes a thermal disc 604, a relocker pin 606, and a pin spring 608. Generally, the pin spring 608 biases the relocker pin 606 against the thermal disc 604 within the cavity 602 adjacent to the lock bolt 518. The thermal disc 604 covers an opening 610 for preventing the pin spring 608 from forcing the relocker pin 606 at least partially through the opening 610. Under normal operating conditions, the thermal disc 604 is sufficiently strong for holding the relocker pin 606 in an operational position. However, under the influence of time and a threshold temperature, the thermal disc 604 will weaken enough that the pin spring 608 will force the relocker pin 606 through the opening 610 to engage the lock bolt 518 within a lock channel 612 into a tampered position. For example, FIG. 25B shows the lock 510 being tampered with by applying a torch 614 to the lock casing 512. Once the torch 614 raises the temperature of the thermal disc 604 to the threshold temperature for a sufficient amount of time, the relocker pin 606 engages the lock bolt 518 while in the extended position. As such, the lock bolt 518 is held in the extended position to prevent the lock 510 from opening.

Figure 26A:
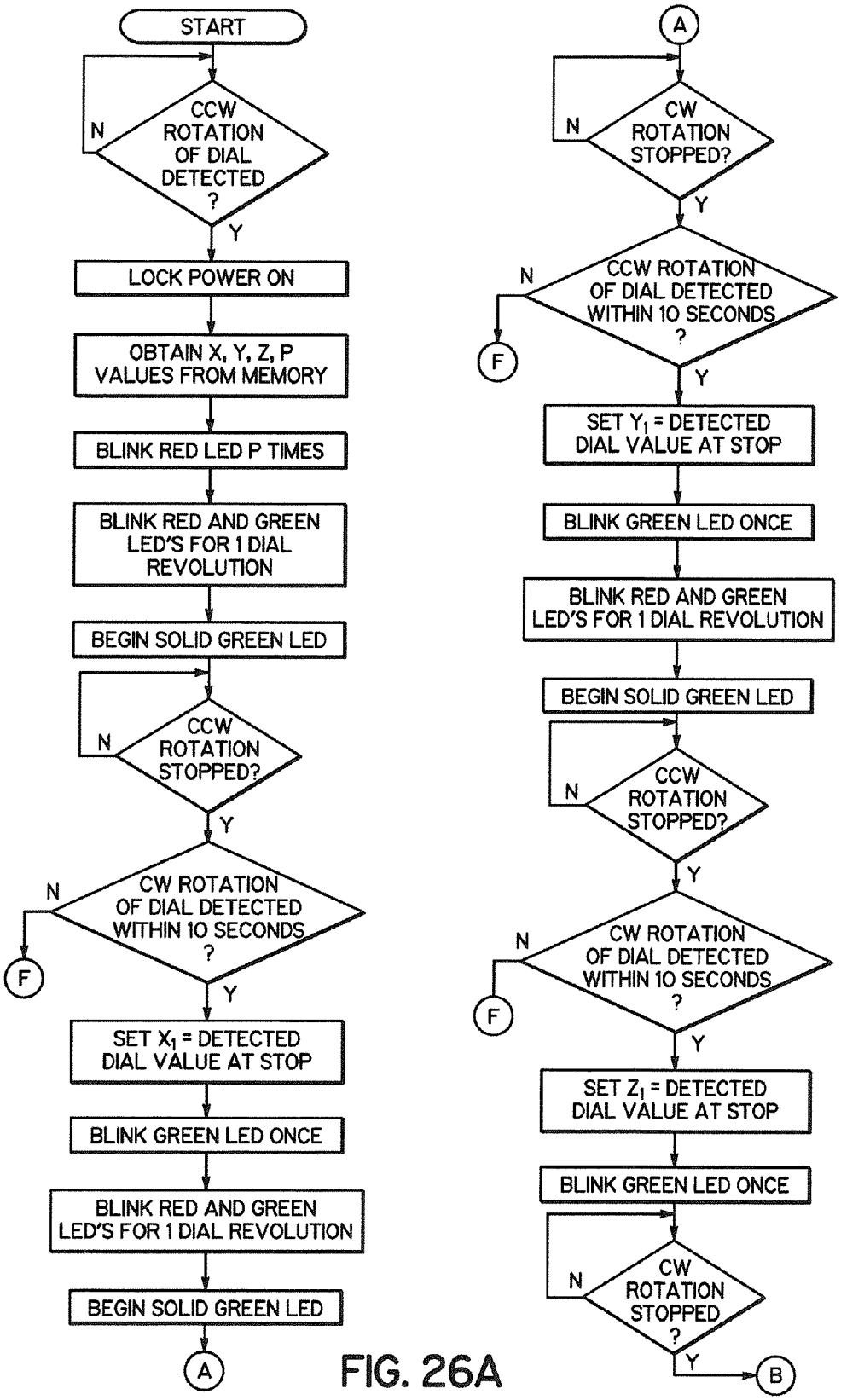
FIGS. 26A and 26B are a flowchart illustrating the control logic of the operational mode for one embodiment of the lock.
Figure 26B:
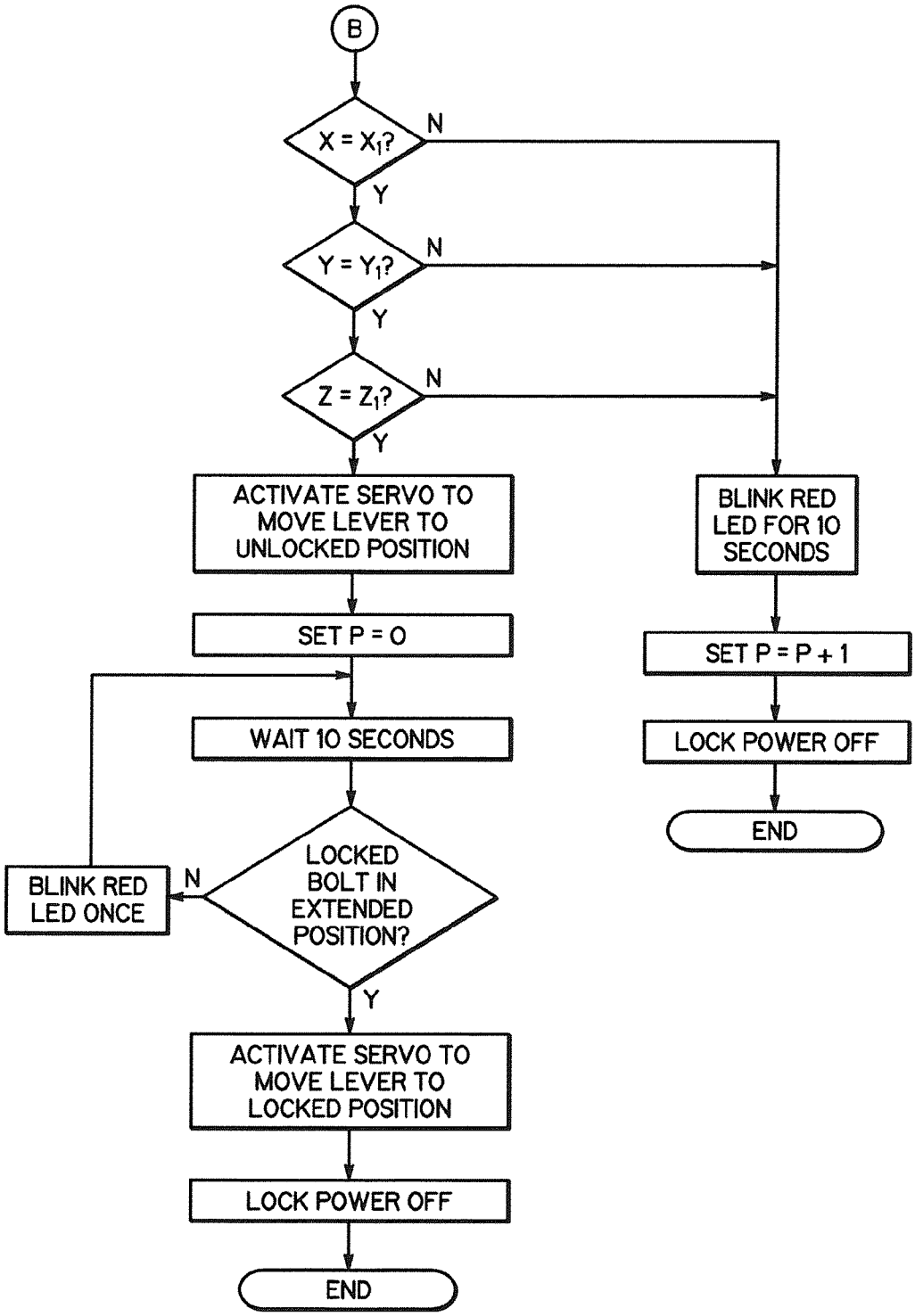
Figure 27:
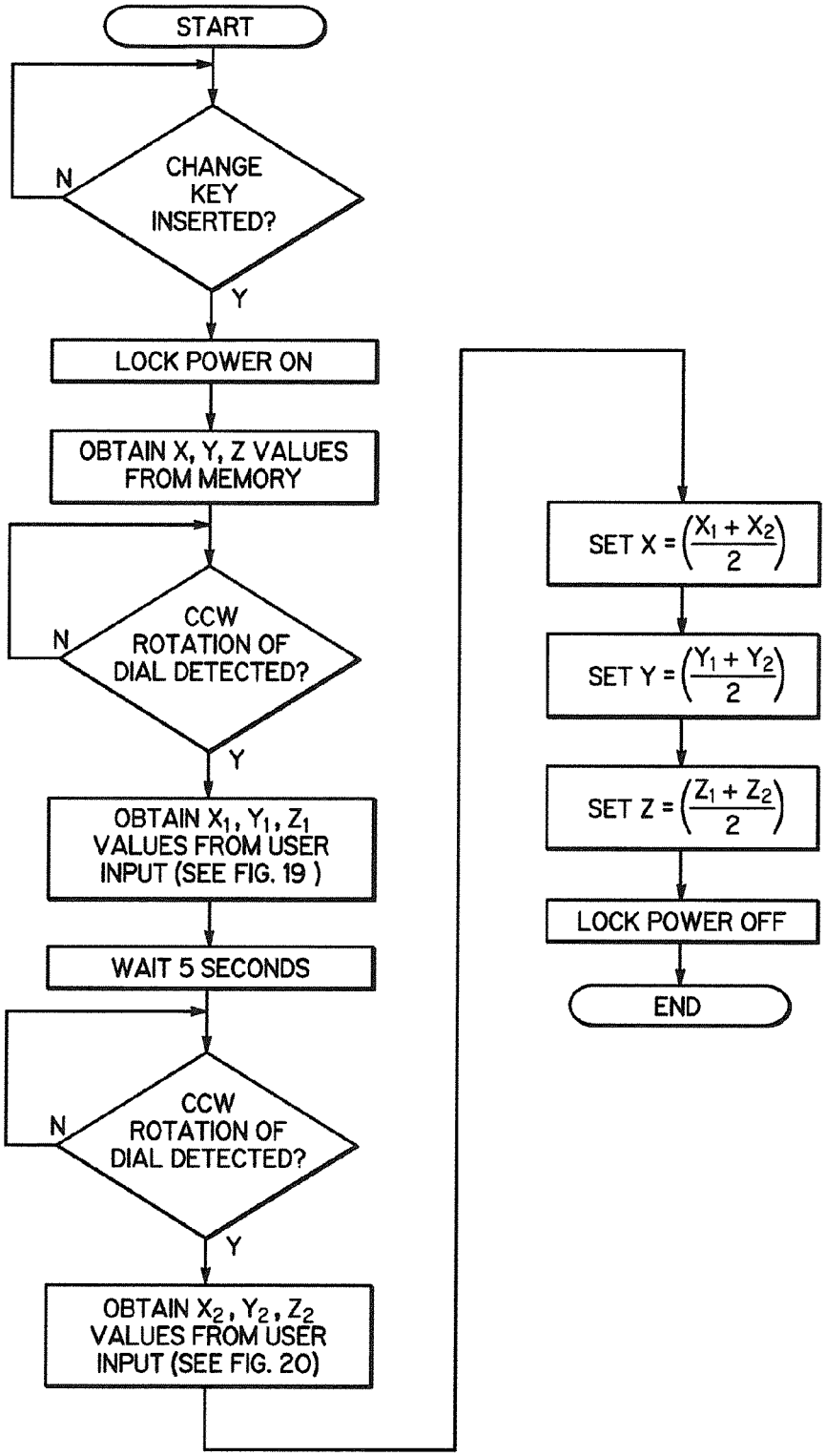
FIG. 27 is a flowchart illustrating the control logic of the configuration mode for one embodiment of the lock.

For each of the embodiments of the lock 10, 110, 210, 310, 410, 510 having a lock dial 24 for the user input device 15 as described above, the circuit board 62 and encoder 84 are programmed to control the lock 10 by a specific set of operating instructions diagrammed in FIGS. 26A-27. In the operational mode of FIGS. 26A and 26B, once a counterclockwise rotation of the lock dial 24 is detected, the lock power activates and obtains authentication information or the proper combination values X, Y, Z from memory along with a value P that represents the number of incorrect combination entries attempted since the last unlocking of the lock. The LED 46 will blink red P times to allow the authorized users of the lock to know when other persons have unsuccessfully attempted to break through the door 12. After these penalty blinks, the LED 46 will blink red and green for one dial revolution and then turn solid green. Once the controller detects that counterclockwise rotation has stopped and clockwise rotation has begun, then the controller stores the entered dial value at the stop as $X_1$ and repeats the process to obtain $Y_1$ and $Z_1$ values. Then the controller verifies if the entered dial values $X_1$, $Y_1$, $Z_1$ match the proper combination values X, Y, Z. If the values do not match, the LED 46 blinks red for 10 seconds and the P value is increased by 1 before the lock 10 power deactivates. If the values do match, then the servo motor 70 or actuator 326 is engaged to allow the bolt 54 to be retracted, and the P value is set to zero. As long as the lock bolt 54 remains in the opened or retracted position, the LED 46 will blink red once every ten seconds to indicate that the lock 10 is in the open position. Once the lock bolt 54 is moved back to the extended position, the lock power is deactivated.

Referring to FIG. 27, a configuration mode is activated when a change key is inserted into the lock 10. The lock power activates and obtains the proper combination values X, Y, Z from memory. Once a counterclockwise rotation of the dial is detected, the lock follows the procedure described above in FIGS. 26A and 26B to obtain user input values $X_1$, $Y_1$, $Z_1$. After a five second pause, the process of obtaining user input repeats and values $X_2$, $Y_2$, $Z_2$ are stored. Then the controller sets the proper combination values X, Y, Z equal to the average of the two sets of user input values. Consequently, the configuration mode verifies that the desired new combination is set correctly.

A person having skill in the art will recognize that the various embodiments of the lock 10, 110, 210, 310, 410, 510 can be operated with alternative user input devices 15 instead of the mechanical lock dial 24. For example, an electronic keypad could be positioned on the outside of the door 12 for electronic entry of combination values. Alternatively, the user input device 15 could include a fingerprint or retinal scan verification device. The internal components of the lock 10 positioned within the lock casing 14 operate as described above regardless of the chosen user input device 15.

While the present invention has been illustrated by a description of several embodiments, and while such embodiments have been described in considerable detail, there is no intention to restrict, or in any way limit, the scope of the appended claims to such detail. Additional advantages and modifications will readily appear to those skilled in the art. For example, the configuration mode detailed in FIG. 27 may be modified to require three sets of user input values to average together in order to set a new combination. Therefore, the invention in its broadest aspects is not limited to the specific details shown and described. The various features disclosed herein may be used in any combination necessary or desired for a particular application. Consequently, departures may be made from the details described herein without departing from the spirit and scope of the claims which follow.

What is claimed is:

1. A locking mechanism, comprising;

a lock bolt movable between extended and retracted positions;

a bolt retraction gear operatively coupled to the lock bolt and movable between engagement and disengagement positions, the bolt retraction gear being biased toward the engagement position;

a manually-driven gear adapted to engage the bolt retraction gear in the engagement position and drive the lock bolt between the extended and retracted positions;

a user input device adapted to receive user input information;

a controller adapted to store authorization information and verify user input information; and an actuator assembly having a guide element, the guide element operatively movable between a capturing position and a non-capturing position, the guide element in the capturing position inhibiting the movement of the bolt retraction gear, and the guide element in the non-capturing position releasing the movement of the bolt retraction gear, wherein the guide element inhibits the movement of the bolt retraction gear toward the engagement position until the controller verifies that the user input information matches the stored authorization information.

2. The locking mechanism of claim 1 wherein the guide element engages the bolt retraction gear while moving from the non-capturing position to the capturing position for directing the bolt retraction gear to the disengagement position.

3. The locking mechanism of claim 1 wherein the actuator assembly further comprises a cam movable between a first and second position, the cam adjacent to the guide element in the first position and engaged with the guide element in the second position, wherein the cam engages the guide element for moving the guide element between the capturing and non-capturing positions.

4. The locking mechanism of claim 3 wherein the actuator assembly further comprises an actuator that operatively engages the cam for rotating the cam between the first and second position.

5. The locking mechanism of claim 4 wherein the actuator engages the cam via a clutch mechanism.

6. The locking mechanism of claim 1 wherein the guide element is a wire guide resiliently mounted against the bolt retraction gear.

7. The locking mechanism of claim 1 further comprising a biasing device having a gear advance lever, the gear advance lever engaging the bolt retraction gear and biasing the bolt retraction gear toward the engagement position.

8. The locking mechanism of claim 7 wherein the biasing device further comprises a rotatably biased drum body, the gear advance lever projecting from the drum body toward the bolt retraction gear.

9. The locking mechanism of claim 1 wherein the lock bolt includes an indentation, the locking mechanism further comprising a detent ball resiliently mounted adjacent to the lock bolt, the detent ball configured to engage the indentation and encourage advancement of the lock bolt to the extended position.

10. The locking mechanism of claim 1 further comprising a display for visualizing the user input information and a filtering device covering at least a portion of the display, the filtering device adapted to prevent a viewing of the display from a plurality of angles.

11. The locking mechanism of claim 1 further comprising:

a thermal relocker including a relocker pin, the relocker pin movable under the influence of time and temperature for engaging the lock bolt in the extended position such that the relocker pin prevents movement of the lock bolt to the retraction position.

12. The locking mechanism of claim 1 further comprising a lock casing surrounding the actuator assembly, the controller, the manually-driven gear, and the bolt retraction gear, the lock casing having a first portion and a second portion, the first and second portions permanently sealed together such that separating the first and second portion damages at least a portion of the lock casing.

13. The locking mechanism of claim 1 further comprising:

a rotatable lock dial adapted to receive user information;

a display for visualizing user input information; and a sensor configured to sense the rotation of the lock dial, wherein the controller converts the rotation of the lock dial into the user input information visualized on the display via an algorithm.

14. The locking mechanism of claim 1 further comprising a lock casing surrounding the actuator assembly, the controller, the manually-driven gear, and the bolt retraction gear, the lock casing at least partially formed of a substantially translucent material for showing evidence of lock tampering.

15. A locking mechanism, comprising;

a lock bolt movable between extended and retracted positions;

a bolt retraction gear operatively coupled to the lock bolt and movable between engagement and disengagement positions;

a manually-driven gear adapted to engage the bolt retraction gear in the engagement position and drive the lock bolt between the extended and retracted positions;

a rotatable lock dial adapted to receive user input information;

a display for visualizing user input information;

a sensor configured to sense the rotation of the lock dial; and a controller adapted to store authorization information and verify user input information, the controller operatively connected to the sensor and the display for converting the rotation of the lock dial into the user input information visualized on the display via an algorithm, wherein the bolt retraction gear moves from the disengagement position to the engagement position with the manually-driven gear when the controller verifies that the user input information matches the stored authorization information.

16. The locking mechanism of claim 15 wherein the rotatable lock dial is mechanically connected to the manually-driven gear.

17. The locking mechanism of claim 16 wherein the sensor is a rotary sensor, the locking mechanism further comprising an encoder mounted on the manually-driven gear such that the rotary sensor directly senses rotation of the manually-driven gear via the encoder.

18. The locking mechanism of claim 17 wherein the user input information visualized on the display is generally random from the rotational position of the lock dial.

19. The locking mechanism of claim 18 wherein the algorithm converts the rate of rotation of the lock dial into the user input information.

20. The locking mechanism of claim 15 further comprising a filtering device covering at least a portion of the display, the filtering device adapted to prevent a viewing of the display from a plurality of angles.

21. The locking mechanism of claim 15 further comprising:

a thermal relocker including a relocker pin, the relocker pin movable under the influence of time and temperature for engaging the lock bolt in the extended position such that the relocker pin prevents movement of the lock bolt to the retraction position.

22. The locking mechanism of claim 15 further comprising a lock casing surrounding the actuator assembly, the controller, the manually-driven gear, and the bolt retraction gear, the lock casing having a first portion and a second portion, the first and second portions permanently sealed together such that separating the first and second portion damages at least a portion of the lock casing.

23. The locking mechanism of claim 15 further comprising a lock casing surrounding the actuator assembly, the controller, the manually-driven gear, and the bolt retraction gear, the lock casing at least partially formed of a substantially translucent material for showing evidence of lock tampering.

24. A method of operating a lock including a user input device, a manually-driven gear, a bolt retraction gear biased toward engagement with the manually-drive gear, a lock bolt engaged with the bolt retraction gear, an actuator assembly having a guide element, and a controller, the method comprising:

capturing the bolt retraction gear with the guide element in a capturing position to inhibit the movement of the bolt retraction gear toward engagement with the manually-driven gear;

recording user input information from the user input device;

verifying that the user input information matches authorization information stored in the controller;

rotating a cam of the actuator assembly to engage the guide element and move the guide element to a non-capturing position;

disengaging the guide element from the bolt retraction gear to permit engagement of the bolt retraction gear with the manually-driven gear after the user input information has been verified; and driving the lock bolt to a retracted position by manually driving the gear with the bolt retraction gear.

25. The method of claim 24 wherein the actuator assembly includes an actuator and a clutch mechanism, the method further comprising:

operating the actuator for a predetermined period of time in order to rotate the clutch mechanism for the predetermined period of time;

engaging the clutch mechanism with the cam; and seizing the movement of the cam while the actuator continues to operatively rotate the clutch mechanism.

26. The method of claim 24 wherein the user input device is a lock dial and the lock further includes a sensor and a display operatively connected to the controller, the method further comprising:

sensing the rotation of the lock dial;

converting the rotation of the lock dial to user input information via an algorithm; and visualizing the user input information on the display.

27. The method of claim 26 further comprising:

using the rate of rotation of the lock dial in the algorithm in order to convert the rotation of the lock dial to user input information.

28. The method of claim 26 further comprising:

randomizing the position of the lock dial from the visualized user input information.

29. The method of claim 26 further comprising filtering at least a portion of the display to prevent a viewing of the display from a plurality of angles.

30. The method of claim 24 further comprising inspecting a portion of the lock through a translucent lock casing in order to reveal any internal tampering or problems with the lock.

31. The method of claim 24 further comprising permanently sealing a first portion of a lock casing to a second portion of a lock casing such that separating the first and second portions damages at least a portion of the lock casing.

* * * * *

UNITED STATES PATENT AND TRADEMARK OFFICE

CERTIFICATE OF CORRECTION

PATENT NO. : 8,635,893 B2
APPLICATION NO. : 13/828141
DATED : January 28, 2014
INVENTOR(S) : Miller et al.

It is certified that error appears in the above-identified patent and that said Letters Patent is hereby corrected as shown below:

In the Specification

Column 5

Line 4, change “a” to --an--.

Line 6, change “a is” to --an--.

Line 8, delete the second occurrence of “is”.

Column 7

Line 67, change “break” to --breaker--.

In the Claims

Column 16

Claim 1, line 8, change “comprising;” to --comprising:--.

Claim 4, line 48, change “position” to --positions--.

Column 17

Claim 12, line 17, change “portion” to --portions--.

Claim 15, line 32, change “comprising;” to --comprising:--.

Column 18

Claim 22, line 20, change “portion” to --portions--.

Claim 24, line 29, change “manually-drive” to --manually-driven--.

Signed and Sealed this
Twentieth Day of May, 2014

Michelle K. Lee

Michelle K. Lee
*Deputy Director of the United States Patent and Trademark Office*